US007533550B2

(12) United States Patent
Herdman

(10) Patent No.: US 7,533,550 B2
(45) Date of Patent: May 19, 2009

(54) RAPID-CHANGE LOCK

(75) Inventor: Rodrick A. Herdman, West Chester, OH (US)

(73) Assignee: EZ Change Lock Company, West Chester, OH (US)

( * ) Notice: Subject to any disclaimer, the term of this patent is extended or adjusted under 35 U.S.C. 154(b) by 45 days.

(21) Appl. No.: 10/708,658

(22) Filed: Mar. 17, 2004

(65) Prior Publication Data

US 2004/0221630 A1 Nov. 11, 2004

Related U.S. Application Data

(60) Provisional application No. 60/481,298, filed on Aug. 27, 2003, provisional application No. 60/469,025, filed on May 8, 2003.

(51) Int. Cl.
*E05B 27/04* (2006.01)

(52) U.S. Cl. ..... 70/340; 70/341; 70/383; 70/384; 70/386; 70/493

(58) Field of Classification Search ..... 70/382–386, 70/337–343, 493, 495, 378, 392, DIG. 44, 70/DIG. 71, DIG. 75
See application file for complete search history.

(56) References Cited

U.S. PATENT DOCUMENTS 1,218,065 A 3/1917 Diesel
1,650,568 A 11/1927 Hurd
1,967,042 A 7/1934 Schachinger
2,023,847 A 12/1935 Liss
2,113,007 A 4/1938 Swanson
2,202,329 A 5/1940 Braune (Continued)

FOREIGN PATENT DOCUMENTS

CA 695186 9/1964

(Continued)

OTHER PUBLICATIONS

Schliessanlagen GmbH Pfaffenhain Catalog, 2002, "Locking Systems for Highest Demands", "Profile cylinder system K14", "Profile cylinder system V14", "System W14", "Profilcylinder-System Integral".

(Continued)

*Primary Examiner*—Lloyd A Gall
(74) *Attorney, Agent, or Firm*—Hasse & Nesbitt LLC; Daniel F. Nesbitt

(57) ABSTRACT

A changeable lock assembly suitable for re-keying a lock without disassembly of the lock. The assembly includes a housing having a bore therein, and a plug rotatably mounted in the bore. The plug includes a longitudinal axis and a keyway. The keyway is adapted to receive at least a first user key and a second user key. The lock further includes a change member movable within the lock between a first position to a second position. The change member can move solely in response to operation of the second key. Thus, when the change member is in the first position, the first key operates the lock, and when the change member is in the second position, the first key does not operate the lock. The lock assembly can also employ a change tool that, when inserted into a change slot, can move a change ball from the second position back to the first position.

20 Claims, 45 Drawing Sheets

U.S. PATENT DOCUMENTS

| | | | | |
|---|---|---|---|---|
| 2,294,495 | A | 9/1942 | Woodruff | |
| 2,427,837 | A | 9/1947 | Connell | |
| 2,596,720 | A | 5/1952 | Pastor et al. | |
| 2,629,249 | A | 2/1953 | Mendelsohn | |
| 2,687,640 | A | 8/1954 | Mir et al. | |
| 2,818,723 | A | 1/1958 | Levin | |
| 3,070,987 | A | 1/1963 | Baker et al. | |
| 3,183,692 | A | 5/1965 | Check | |
| 3,234,768 | A | 2/1966 | Russell et al. | |
| 3,257,831 | A | 6/1966 | Schlage | |
| 3,260,080 | A | 7/1966 | Wellekens | |
| 3,286,494 | A | 11/1966 | Sussina | |
| 3,395,558 | A | 8/1968 | Russell et al. | |
| 3,425,248 | A | 2/1969 | Duval | |
| 3,431,757 | A | 3/1969 | Hori | |
| 3,492,843 | A | 2/1970 | Schieber et al. | |
| 3,512,382 | A | 5/1970 | Check et al. | |
| 3,516,271 | A | 6/1970 | Nelson et al. | |
| 3,589,153 | A | 6/1971 | Hill | 70/384 |
| 3,599,456 | A | 8/1971 | Bessim | 70/383 |
| 3,605,462 | A | 9/1971 | Hermann | |
| 3,667,262 | A | 6/1972 | Hill | 70/384 |
| 3,710,603 | A | 1/1973 | Miller | 70/38 A |
| 3,774,424 | A | 11/1973 | Ehrat | 70/383 |
| 3,910,083 | A | 10/1975 | Burlingame | 70/383 |
| 3,967,481 | A | 7/1976 | Schlage | 70/431 |
| 4,030,325 | A | 6/1977 | Ehrat | 70/383 |
| 4,068,508 | A | 1/1978 | Genakis | 70/373 |
| 4,116,026 | A | 9/1978 | Flint | 70/383 |
| 4,142,391 | A * | 3/1979 | Paig | 70/461 |
| 4,151,731 | A | 5/1979 | Tucker | 70/378 |
| RE30,198 | E | 1/1980 | Oliver et al. | 70/378 |
| 4,231,242 | A | 11/1980 | Hill et al. | 70/347 |
| 4,233,828 | A | 11/1980 | Dauenbaugh | 70/383 |
| 4,282,731 | A | 8/1981 | Taksony | 70/419 |
| 4,376,382 | A | 3/1983 | Raymond et al. | 70/338 |
| 4,403,486 | A | 9/1983 | Miyake | |
| 4,412,437 | A | 11/1983 | Smith | 70/338 |
| 4,429,555 | A | 2/1984 | Slasbury | 70/366 |
| 4,440,009 | A | 4/1984 | Smith | 70/385 |
| 4,631,941 | A | 12/1986 | Sjunnesson | 70/337 |
| 4,638,651 | A | 1/1987 | Surko, Jr. | 70/419 |
| 4,655,063 | A | 4/1987 | Foshee et al. | 70/419 |
| 4,712,401 | A | 12/1987 | Monohan | 70/382 |
| 4,712,402 | A | 12/1987 | Monahan | |
| 4,732,023 | A | 3/1988 | Shen | 70/383 |
| 4,741,188 | A | 5/1988 | Smith | 70/383 |
| 4,747,281 | A | 5/1988 | Monohan | 70/383 |
| 4,776,187 | A | 10/1988 | Evans et al. | 70/38 A |
| 4,836,002 | A | 6/1989 | Monohan | 70/382 |
| 4,942,749 | A | 7/1990 | Rabinow | 70/495 |
| 4,966,021 | A | 10/1990 | Boag | 70/383 |
| 5,000,019 | A | 3/1991 | Foster | 70/338 |
| 5,088,306 | A | 2/1992 | Field | 70/375 |
| 5,138,856 | A | 8/1992 | Chun | |
| 5,168,734 | A | 12/1992 | Duval et al. | 70/369 |
| 5,177,466 | A | 1/1993 | Lai | 70/358 |
| 5,343,724 | A | 9/1994 | Sornes | 70/340 |
| 5,450,662 | A | 9/1995 | Watts | 29/401.1 |
| 5,502,991 | A | 4/1996 | Sornes | 70/453 |
| 5,615,566 | A | 4/1997 | Brandt | 70/419 |
| 5,682,779 | A | 11/1997 | Dolev | 70/494 |
| 5,718,136 | A | 2/1998 | Aldieri et al. | 70/385 |
| 5,752,400 | A | 5/1998 | Kim | 70/368 |
| 5,799,519 | A | 9/1998 | Hsiao | 70/358 |
| 5,819,569 | A | 10/1998 | Herdman | 70/420 |
| 5,839,307 | A | 11/1998 | Field et al. | 70/283 |
| 5,894,750 | A | 4/1999 | Liaw | 70/359 |
| 5,921,121 | A | 7/1999 | Tang | 70/337 |
| 5,921,122 | A | 7/1999 | Lin | 70/368 |
| 5,964,111 | A | 10/1999 | Lambert | |
| D422,882 | S | 4/2000 | Andrews | D8/343 |
| 6,076,386 | A | 6/2000 | Etchells et al. | 70/369 |
| 6,079,240 | A | 6/2000 | Shvarts | 70/367 |
| 6,301,942 | B1 | 10/2001 | Shvarts | 70/367 |
| 6,425,274 | B1 | 7/2002 | Laitala et al. | 70/394 |
| 6,532,782 | B2 | 3/2003 | Chiu | 70/369 |
| 6,604,393 | B2 | 8/2003 | Larsen et al. | 70/208 |
| 6,722,171 | B1 | 4/2004 | Ruan | |
| 6,860,131 | B2 | 3/2005 | Armstrong et al. | |
| 6,935,146 | B1 | 8/2005 | Lin | |
| 2001/0047672 | A1 | 12/2001 | Fuller | 70/375 |
| 2002/0104346 | A1 | 8/2002 | Field et al. | 70/496 |
| 2003/0041630 | A1 | 3/2003 | Laitala et al. | 70/38 A |
| 2003/0159483 | A1 | 8/2003 | Kondratuk et al. | 70/493 |
| 2003/0217576 | A1 | 11/2003 | Koluch | 70/493 |
| 2004/0060333 | A1 | 4/2004 | Armstrong et al. | 70/493 |
| 2006/0010945 | A1 * | 1/2006 | Herdman | 70/493 |
| 2006/0021406 | A1 * | 2/2006 | Herdman | 70/493 |

FOREIGN PATENT DOCUMENTS

| | | |
|---|---|---|
| DE | 2517-689 | 11/1975 |
| DE | 2646-739 A1 | 4/1978 |
| EP | 0918124 A1 | 5/1999 |
| JP | 2005-002641 | 1/2005 |
| JP | 2005-076286 | 3/2005 |

OTHER PUBLICATIONS

Master Lock Brochure, Key Control Security, MO-15M, Apr. 2003.
U.S. Appl. No. 11/192,755, filed Jul. 29, 2005, Rodrick A. Herdman.
U.S. Appl. No. 11/178,627, filed Jul. 11, 2005, Rodrick A. Herdman.
U.S. Appl. No. 11/374,299, filed Feb. 23, 2006, Rodrick A. Herdman.

* cited by examiner

RAPID-CHANGE LOCK

CROSS REFERENCE TO RELATED APPLICATIONS

This application claims the benefit of U.S. Provisional Application No. 60/469,025, filed May 8, 2003 and U.S. Provisional Application No. 60/481,298, filed Aug. 27, 2003.

BACKGROUND OF INVENTION

This invention relates generally to cylinder locks, and more particularly to a programmable cylinder lock which allows for adapting the lock to operate upon insertion of a key having a different configuration than a key to which the lock was originally adapted.

In many organizations, such as businesses, apartment buildings, hotels, schools, etc., it is generally desirable to customize the locks to the particular organization. There are two general methods by which keys and locks may be customized. The first involves reconfiguring the drivers and tumblers in the lock so that a key with a particular top edge contour may operate the locks of the organization. The second involves configuring the keyways in the locks to accept keys having a unique pattern of longitudinal contours formed in their sides. The purpose of the exclusivity generated by these methods is to prevent unauthorized entry into the organization. When keys and locks formed by the second method are involved, it is not sufficient for opening the lock that one have a key having a top edge contour appropriate to the lock; the key must also include an appropriate longitudinal contour of grooves and/or ridges.

In general, standard, conventional locks include a housing that has a cylindrical bore therein. An elongated generally cylindrical plug is rotatably mounted within the bore. A plurality of cylindrical apertures or holes extend through the housing and can be aligned with corresponding cylindrical holes in the plug. Paired sets of drivers and tumblers are positioned within these holes (i.e., the drivers within the holes in the housing, the tumblers within the holes in the plug) and are capable of moving within the plug and housing in such a manner as to allow for rotational movement of the plug in response to a main key inserted in the lock. The arrangement and construction of the lock also causes one or more of these sets of drivers or tumblers to be positioned in the interface between the plug and housing to prevent relative rotation between the plug and the housing when the wrong main key or no main key is inserted in the lock. However, the relative positioning of the sets of drivers and tumblers, plug, and housing is such that, when the proper key is inserted, the drivers are substantially wholly within the holes in the housing and the tumblers are substantially wholly within the holes in the plug, such that the plug can be rotated without interference to an unlocking position.

Many locks or sets of locks also include two types of keys: tenant keys and master keys. In general, each tenant key will only open one lock of a particular subset of locks, whereas a master key may open all the locks of the subset. Over the course of time, the security of an organization may become compromised by the loss of control of one or more of the tenant keys. For example, in apartment buildings, hotels, or motels, a guest or renter may leave and inadvertently or intentionally retain a key. When this occurs, subsequent occupants or tenants cannot be secure in their persons and property. Thus it would be desirable to easily and quickly reprogram the locks to accept a new key or set of keys.

Locks that can be easily changed are also desired by businesses where several employees are in possession of keys to fit the locks. In such situations, an employee may be discharged or quit, but retain possession of a key. Further, an employee may lose a key, thus placing the security of the locked area in doubt. Locks that can be easily changed are also desired in matters of personal security. One example of such a situation is a school where teachers and/or administrators may wish to quickly change the configuration of locks on classroom doors to secure students inside the classroom and safely set apart from the hallways in the event that an undesirable or dangerous individual breaches the security of the school.

When keys are lost or are possessed adversely, the general response is to change the locks fitting the lost key to require a key with a new top edge contour to correspond to different length tumblers. Generally, the shape of the longitudinal inner walls of the keyway that confront the longitudinal contour on the side of the key is not changed due to the generally exorbitant cost of such a change.

There are several generally known methods in the prior art for changing the configuration of drivers and tumblers in standard cylinder locks. Some of these methods involve removing the drivers and tumblers from a lock and replacing them with a different set of drivers and tumblers. However, there are many disadvantages to these prior methods of changing locks. First, these methods are tedious and time consuming. Second, they generally require the presence of a locksmith. And finally, they require disassembly and reassembly of the actual lock structure along with removal and replacement of the lock in a door.

Thus, it would be desirable to provide and construct a lock that permits rapid change in the positioning of drivers and tumblers to accept a key of a different design or configuration. It would further be desirable to provide a lock that allows the operative key to be changed without removal of the plug from the lock, and/or other disassembly of the lock structure. It would be further desirable to provide a lock wherein such change could be effected in a more rapid fashion than is currently available in locks of the prior art.

SUMMARY OF INVENTION

The present invention relates to a changeable lock assembly comprising: a) a housing having a bore therein; b) a plug rotatably mounted in the bore, the plug having a longitudinal axis, and a first passage parallel to the longitudinal axis, and configured to receive a key selected from a subset of keys, said subset of keys comprising at least a first key and a second key, each key having at least one contour position; and c) a change member movable within the lock between a first position in the lock and a second position in the plug, the change member being movable from the first position to the second position solely in response to rotation of the plug by the operation of the second key; wherein when the change member is in the first position, the first key operates the lock, and wherein when the change member is in the second position, the first key does not operate the lock.

The present invention also relates to a changeable lock assembly that can be reconfigured to operate with different keys of a set of user key, without disassembling the lock, comprising: a) a housing having a generally cylindrical bore with an inner surface and a plurality of generally cylindrical driver chambers intersecting the bore surface; b) a plurality of generally cylindrical drivers, each driver being positioned and movable within one driver chamber and being urged toward the bore surface; c) a plug having a generally cylindrical periphery and rotatably mounted within the bore so as to form a shear line at the interface of the bore surface and the plug periphery, the plug further having: a longitudinal axis; a keyway intersecting the periphery and parallel to the longitudinal axis and configured to receive a key selected from a subset of keys, the subset of keys including at least a first key having a first contour edge that operates the lock in a first lock configuration but does not operate the lock in a second lock configuration, and a second key having a second contour edge that operates the lock in the second lock configuration but does not operate the lock in the first lock configuration, wherein the first contour edge and the second contour edge have at least a first contour position and a second contour position that are differently configured; a plurality of generally cylindrical tumbler chambers intersecting the periphery and the keyway and generally orthogonal to the longitudinal axis, each tumbler chamber being aligned with a driver chamber when the plug is at a first rotated position with respect to the housing so as to form a pin chamber; and a plurality of retainer cavities intersecting the periphery, each retainer cavity being spaced apart from a corresponding tumbler chamber and aligned with a corresponding driver chamber when the plug is at a second rotated position with respect to the housing; and a change tool slot configured parallel to the longitudinal axis, that extends from the front face of the plug and intersects a portion of each of the retainer cavities; d) a plurality of tumblers, each tumbler being positioned and movable within one tumbler chamber; e) a plurality of lock configuration change balls, each change ball being associated with one pin chamber, having a first position within the pin chamber between the driver and tumbler, and a second position within the retainer cavity, and being movable from the second position within the retainer cavity upon insertion of a change tool into the change tool slot.

The present invention further relates changeable lock assembly comprising: a) a housing having a bore therein; b) a plug rotatably mounted in the said the bore, the plug having: i) a longitudinal axis; ii) a first passage parallel to the longitudinal axis, and configured to receive a key selected from a subset of keys, said subset of keys comprising at least a first key and a second key, each key having at least one contour position; iii) a second passage configured in the plug to receive a change tool, and c) a change member movable within the lock between a first position in the lock and a second position in the plug, the change member being movable from the first position to the second position solely in response to rotation of the plug by the operation of the second key; wherein when the change member is in the first position, the first key operates the lock, and wherein when the change member is in the second position, the first key does not operate the lock.

The present invention further relates to a changeable lock assembly comprising: a) a housing having a bore therein; b) a plug rotatably mounted in the bore, the plug having a longitudinal axis, the plug further including a first passage parallel to the longitudinal axis, the first passage adapted to receive at least a first key and a second key; and c) first and second subsets of pin chambers, wherein each pin chamber of the first subset of pin chambers lies in a first plane perpendicular to the longitudinal axis, and wherein each pin chamber of the second subset of pin chambers lies in a second plane perpendicular to the longitudinal axis, and wherein the first plane and the second plane are not coplanar.

The present invention relates also to a changeable lock assembly, comprising a) a housing having a generally cylindrical bore with an inner surface and a plurality of generally cylindrical driver chambers intersecting the bore surface; b) a plurality of generally cylindrical drivers, each driver being received by and movable within one driver chamber and being urged toward the bore surface; c) a plug having a generally cylindrical periphery and rotatably mounted within the bore so as to form a shear line at the interface of the bore surface and the periphery, the plug further having: 1) a longitudinal axis; 2) a keyway configured parallel to the longitudinal axis and configured to receive a key selected from a subset of keys, the subset of keys including at least a first key and a second key, the first and second key each having an edge with at least one contour position that is differently configured; 3) a plurality of generally cylindrical tumbler chambers intersecting the periphery and the keyway and generally orthogonal to the longitudinal axis, the tumbler chambers being equal to the number of driver chambers and being aligned therewith when the plug is at a first position with respect to the housing so as to form a pin chamber, such that when the plug is in the first position and at least one of the drivers is urged so as to intersect the shear line, the plug cannot be rotated within the housing; 4) a plurality of retainer cavities intersecting the periphery and spaced apart from a corresponding tumbler chamber, the retainer cavities being aligned with a corresponding driver chamber when the plug is at a second position with respect to the housing; d) a plurality of tumblers, each tumbler being received by and movable within one tumbler chamber; e) a plurality of lock configuration change members, at least one change member being positioned in the each pin chamber between a driver and tumbler, at least one of the change members being responsive to the at least one contour position when the second key is inserted into the keyway such that the change member is disposed wholly within the driver chamber and can be moved within the lock to one of the retainer cavities when the plug is rotated from the first to second position; f) the plug being rotatable after insertion of: (1) the first key when the one change member is within tumbler chamber; and (2) the second key when the change member is in the one retainer cavity.

The present invention also relates to a method for reprogramming a lock, the method comprising: a) providing an adaptable lock assembly comprising a housing having a bore therein, a plug rotatably mounted in the bore, the plug having a longitudinal axis, the plug further including a first orifice parallel to the longitudinal axis, the first orifice adapted to receive a key selected from a subset of keys, the subset of keys including at least a first key and a second key, and a change member movable within the lock between a first position in the lock and a second position in the plug, the change member being movable from the first position to the second position solely in response to rotation of the plug by operation of the second key, wherein when the change member is in the first position, the first key operates the lock, and wherein when the change member is in the second position, the first key does not operate the lock; b) providing a subset of keys, the subset of keys including at least a first key and a second key, each of the first key and the second key including a top contour, the second key having a different top contour than the first key, the first key being operable to operate the lock; c) inserting the second key into the first orifice; and d) moving the change member from the first position to the second position such that the first key is inoperable to operate the lock.

The present invention relates also to a method of making a changeable lock plug by machining a standard lock plug, comprising the steps of: a) providing a standard lock plug having a keyway, an axial centerline and a circumferential surface, the standard plug further having a plurality of tumbler chambers extending through the circumferential surface along a first line extending parallel to the axial centerline, wherein each tumbler chamber extends into the keyway and has a centerline that is spaced apart by a first distance from an adjacent tumbler chamber; and b) machining a plurality of retainer cavities into the standard plug through the circumferential surface along a second line extending parallel to the axial centerline, wherein each retainer cavity extends into the plug body is displaced radially from a corresponding tumbler chamber by an arc angle along the circumferential surface.

The present invention also relates to a method of machining a plug for a variable change lock, comprising: a) providing a plug body having a keyway, an axial centerline, and a circumferential surface; b) machining a plurality of tumbler chambers through the circumferential surface along a first line extending parallel to the axial centerline, wherein each tumbler chamber extends into the keyway and has a centerline that is spaced apart by a first distance from an adjacent tumbler chamber; c) machining a plurality of retainer cavities through the circumferential surface along a second line extending parallel to the axial centerline, wherein the retainer cavities extend into the plug body, and each retainer cavity is displaced radially from a corresponding tumbler chamber by an arc angle along the circumferential surface; and d) machining a slot through the circumferential surface and along the second line.

The present invention also relates to a lock kit, comprising: A) a subset of keys including at least a first key having a first contour edge that operates the lock in a first lock configuration but does not operate the lock in a second lock configuration, and a second key having a second contour edge that operates the lock in the second lock configuration but does not operate the lock in the first lock configuration, wherein the first contour edge and the second contour edge have at least a first contour position and a second contour position that are differently configured; B) a change tool; C) a changeable lock assembly that can be reconfigured to operate with different keys without disassembling the lock, comprising: a) a housing having a generally cylindrical bore with an inner surface and a plurality of generally cylindrical driver chambers intersecting the bore surface; b) a plurality of generally cylindrical drivers, each driver being positioned and movable within one driver chamber and being urged toward the bore surface; c) a plug having a generally cylindrical periphery and rotatably mounted within the bore so as to form a shear line at the interface of the bore surface and the plug periphery, the plug further having: 1) a longitudinal axis; 2) a keyway intersecting the periphery and parallel to the longitudinal axis and configured to receive a key selected from the subset of keys; 3) a plurality of generally cylindrical tumbler chambers intersecting the periphery and the keyway and generally orthogonal to the longitudinal axis, each tumbler chamber being aligned with a driver chamber when the plug is at a first rotated position with respect to the housing so as to form a pin chamber; and 4) a plurality of retainer cavities intersecting the periphery, each retainer cavity being spaced apart from a corresponding tumbler chamber and aligned with a corresponding driver chamber when the plug is at a second rotated position with respect to the housing; and 5) a change tool slot configured parallel to the longitudinal axis, that extends from the front face of the plug and intersects a portion of each of the retainer cavities; d) a plurality of tumblers, each tumbler being positioned and movable within one tumbler chamber; e) a plurality of lock configuration change balls, each change ball being associated with one pin chamber, having a first position within the pin chamber between the driver and tumbler, and a second position within the retainer cavity, and being movable from the second position within the retainer cavity upon insertion of the change tool into the change tool slot; D) instructions for use; and E) a means for securing the keys, lock assembly, change tool, and the instructions.

The present invention solves the problems and eliminates the drawbacks of locks as described above in the background of the invention. The present invention does so by providing both an adaptable or changeable lock and a method of using the lock in order to reprogram the lock to accept a second key having a different top contour than a first key. The present invention provides a lock that permits rapid change in the positioning of drivers and tumblers to accept one or more keys of a different design or configuration, without removal of the plug from the housing of the lock, and without disassembly of the lock assembly. The present invention provides a lock that allows the operative key to be changed without removal of the plug from the lock, or other disassembly of the lock assembly.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
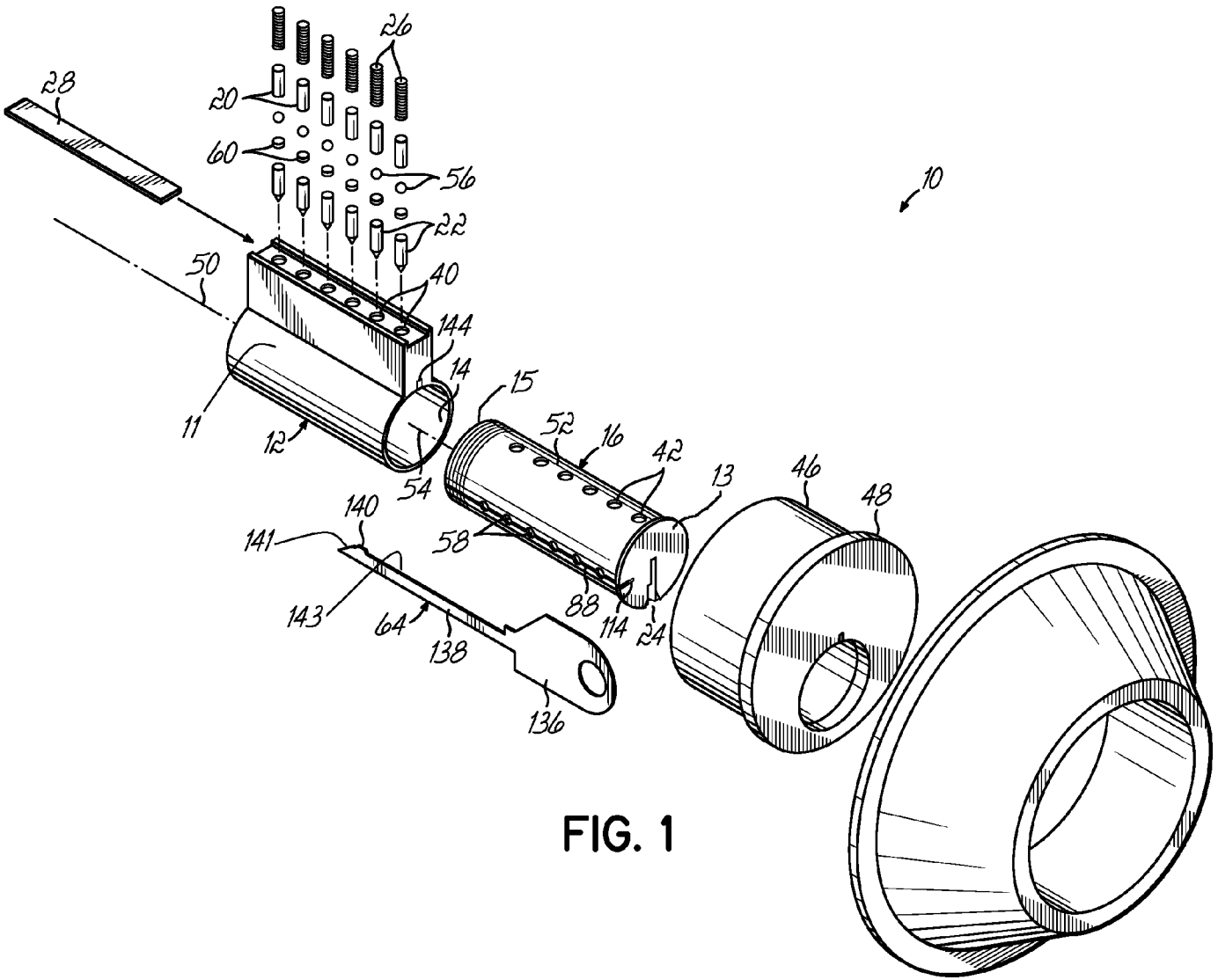
FIG. 1 is a perspective, disassembled view of the components of one embodiment of a lock assembly of the present invention.

The lock includes a housing with a bore disposed through the housing and a plug (or lock core) rotatably mounted within the bore. The plug has a longitudinal axis and a first orifice or passage parallel to the longitudinal axis to provide a keyway that is adapted to receive a key. The housing and plug also each include a plurality of paired sets of radially extending apertures or holes, respectively, which are adapted to receive, respectively, the drivers and tumblers of the lock. The radially extending holes in the housing form driver chambers. The radially extending holes in the plug form tumbler chambers. When the lock is in a first position wherein the drivers and tumblers can move in a vertical direction (in the Figure), the vertical apertures of the plug are aligned with the vertical apertures of the housing. In this first lock position or first rotated position, the tumbler chambers are aligned with the respective driver chambers, each resulting pair of extended apertures or holes forms a pin chamber. The drivers and tumblers can move within the aligned set of pin chambers. The lock can also include a change member, for example, a change ball in the form of a ball bearing, that is adapted to be disposed within the pin chamber as part of the paired driver/tumbler stack or set, or alternatively can be disposed within a separate retainer recess or cavity located in or otherwise associated with the plug. This change member can have a size smaller than that of the other members of the driver/tumbler stack or set. By moving a change member or change members between one or more of the pin chambers and the retainer cavities, one may alter the driver/tumbler configuration such that the lock will accept and operate with a second key having a differing top contour, but will not operate with the originally operable first key.

With the lock of the present invention, a subset of keys can be provided, each key configured such that it can be the operable key for the lock. In one embodiment of the present invention, as an operator progresses through each key of the subset of keys for a particular lock, at least one additional change member is displaced from a pin chamber and into a retainer cavity. As this occurs, any keys of the subset of keys that are configured to move less than the current number and configuration of change members that are displaced will no longer operate the lock. Using any key of the subset of keys that is configured to move more than the current number and configuration of change members that are displaced can displace at least one additional change member, and thus change the driver/tumbler configuration of the lock to match that new key. For example, if a lock includes six driver/tumbler stacks or sets, then there can be up to seven keys in an operable subset, with each successive key displacing at least one more change member than the previous key. Thus, each key will have a nearly identical top contour to the previous key in the set, with the exception that at least one additional contour location will be raised, as will be explained in greater detail below. This embodiment of the lock of the present invention thus allows for reconfiguring driver/tumbler stacks or sets in the absence of a change tool, thereby allowing for rapid, automatic rekeying, simply by using a new key of the subset of keys.

Once all the change members have been displaced into retainer cavities, thus reaching the end of a key set, the lock can be reset to the first key in the set through the use of a change tool. In order to effect this change, the plug includes a second orifice or passage to provide a change slot, which is configured in the plug in a direction parallel to the longitudinal axis thereof, and intersects each of the retainer cavities. When the retainer cavities are aligned in a plane with the driver chambers of the housing, and the change tool is inserted in the change slot, any change members in the retainer cavities will be displaced there from and into the driver chambers, thus returning the change members to the driver/tumbler stack and resetting the lock to operate with a subsequently-inserted key from the set of keys.

The method of using this embodiment of the lock of the present invention involves inserting a first key to which the lock is programmed to operate into the keyway of the lock. This key then can be used to rotate the plug within the housing of the lock. The first key is then removed from the longitudinal slot. A second key, having a different though complementary top edge contour than the first key, is then inserted. The second key is complementary to the first key in that each raised contour position of the first key is found on the second key. The second key is different in that it has at least one additional contour position or location raised, which the first key does not have; the top edge contour of the second key otherwise matches the top edge contour of the first key. As this happens, the driver/tumbler stack associated with that raised contour location is lifted such that the change member of that driver/tumbler stack is raised above the shear line of the lock and is disposed in the respective driver chamber of the housing. As the plug rotates by rotating the second key, the retainer cavities will come into alignment with the respective driver chambers of the housing. As this occurs, the force of a spring or other biasing mechanism disposed or positioned above the driver in the respective driver chamber forces any change member raised above the shear line of the lock down into a corresponding retainer cavity. As the second key and plug are rotated back to the original position, the additional change member is then disposed in a retainer cavity offset from the tumbler chambers of the plug, whereby the lock has been reset to operate with the second key. The first key is now inoperable due to its inability to lift the now additionally changed driver/tumbler stack sufficiently to allow rotation of the plug.

Alternate embodiments of the invention can include an embodiment that involves the use of a change tool with each reconfiguration of the drivers and tumblers of the lock. This embodiment can expand the number of keys in a particular set of keys, since instead of moving change members from the tumbler chamber, via the driver chamber, into the retainer cavities as one progresses through a set of keys, one may shift change members back and forth between the tumbler chambers and retainer cavities. This embodiment of the invention can also include keys having at least two raised contour locations, which prevent automatic lock changing. However, more keys can be provided to a key set. For example, by staggering two raised contour locations over a total of six contour locations, 15 different key combinations can be achieved. Similarly, a subset of keys having four raised contour locations over a total of six contour locations provides for 15 different key combinations.

Yet another alternate embodiment of the present invention can include a memory block that is disposed in the plug of the lock and is adapted to intersect the change slot and the openings to the retainer cavities. This memory block prevents different keys from being inserted into the lock in an unauthorized fashion by partially blocking the openings to the retainer cavities. Thus any change members raised above the shear line cannot fit through the openings and into the retainer cavities as they are rotated into alignment with the driver chambers, unless an authorized user inserts a change tool which displaces the memory block away from the change slot such that the full breadth of the opening to each of the retainer cavities is exposed to receive a change member.

Yet another alternate embodiment can include at least one radial tumbler disposed in a radially extending slot in the plug. The radial slot is disposed in or associated with a sidewall of the plug radially outwardly from the longitudinal axis of the plug. These radial tumblers can include notches to accept a sidebar which is disposed between the housing and plug of the lock. This sidebar and radial tumbler configuration adds extra security to the lock in that a user will need a key not only having a proper top edge contour but also a proper longitudinal contour in order to move the radial tumblers to a proper position to allow the sidebar to move inwardly from the housing of the lock into the plug, thereby allowing the plug to rotate to operate the lock.

The method of reconfiguring the lock of the present invention as described above can be used to reconfigure the drivers and tumblers in order to change tenant keys that can properly operate the lock. The method involves the use of a change tool when an authorized or operable user key is inserted into the lock, re reset the lock to allow another user key of the subset of keys to become the operarable user key.

Yet another embodiment of the present invention allows for master keys that can operate the lock properly without reconfiguring the driver and tumbler arrangement. In particular, in one embodiment, this alternate embodiment includes at least one master shim or pin, preferably with at least one master shim being disposed in each tumbler chamber of the plug. These master shims are disposed in the driver/tumbler stack directly beneath the change member. The master shims are each sized larger than the change members and are also sized larger than the openings to the retainer cavities. Thus, when a master key is inserted into the keyway of the plug, all of the driver/tumbler stacks are raised so that the bottom tumbler lies beneath the shear line and within the tumbler chamber of the plug, while each of the master shims lies directly above the shear line of the lock and in the driver chamber of the housing. When the plug is rotated in the lock such that the retainer cavities come into alignment with the driver chambers of the housing, the master shims can not fall through the opening and into the retainer cavities due to their larger size. The master shims also prevent any change members from moving into the retainer cavities, because the master shims are disposed between the retainer cavities and any change member in a driver chamber, and will block the opening to the retainer cavities through which the change members could enter. Thus, there is no pathway for the change member to enter the retainer cavities. As such, one may operate a master key to open any lock in a particular facility system without reconfiguring the driver/tumbler stack of the lock. In an embodiment of the present invention that includes a memory block, there is no need for the driver/tumbler stack to include master shims, since the change members can be prevented from entering the retainer cavities by the memory block.

Referring to FIG. 1, an embodiment of the lock 10 includes a housing 12 with a generally cylindrical bore 14 through the housing 12 for receiving a generally cylindrical plug 16. The plug 16 has a periphery that is sized to rotate within the housing 12. The housing and plug of the lock include vertical apertures within which drivers and tumblers are disposed. The housing 12 has a plurality of generally cylindrical driver chambers 40 that intersect with the inner surface of the bore, while the plug 16 has a plurality of correspondingly generally cylindrical tumbler chambers 42. When the driver chambers 40 of the housing and the tumbler chambers 42 of the plug are aligned, a plurality of pin chambers 18 are formed. Each pin chamber 18 has disposed therein a plurality of generally cylindrical drivers 20 and a plurality of generally pencil-shaped tumblers 22, consisting of a cylindrical body with a tapered end. The tumblers 22 are positioned in the tumbler chambers 42 such that the tapered end extends into a first passage of the plug 16 in the form of a keyway 24. The drivers 20 are positioned and movable within the pin chambers 18 above corresponding tumblers 22. A biasing means in the form of driver spring 26 is located within each driver chamber 40 between a rectangular top plate 28 removably secured or attached to the housing 12, and the respective driver 20 to bias or urge the paired driver 20 and tumbler 22 stack in a downward fashion such that the tapered end of the tumbler 22 projects into the keyway 24 when no key is inserted therein. The driver spring 26 is typically a tempered, stainless steel to prevent material deformation upon multiple cycles of compression and extension. Preferably, the spring material is a made of non-metallic stainless steel wire of about size 008, and is available as part number C108x008x520 from W. B. Jones Spring Co., Inc., of Wilder, Ky. Typically, the driver chambers 40 and tumbler chambers 42 have a generally circular cross section.

Figure 2B:
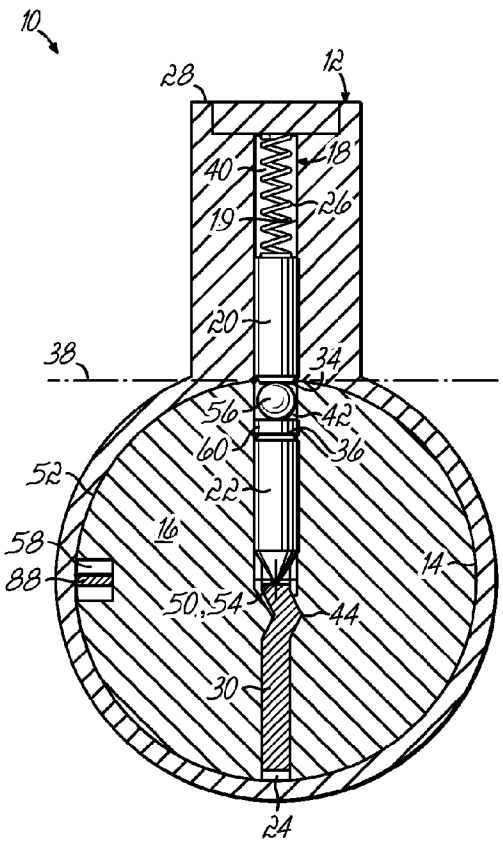
FIG. 2B is a cross-sectional view of the housing and plug taken along line 2B-2B of FIG. 2A.
Figure 2A:
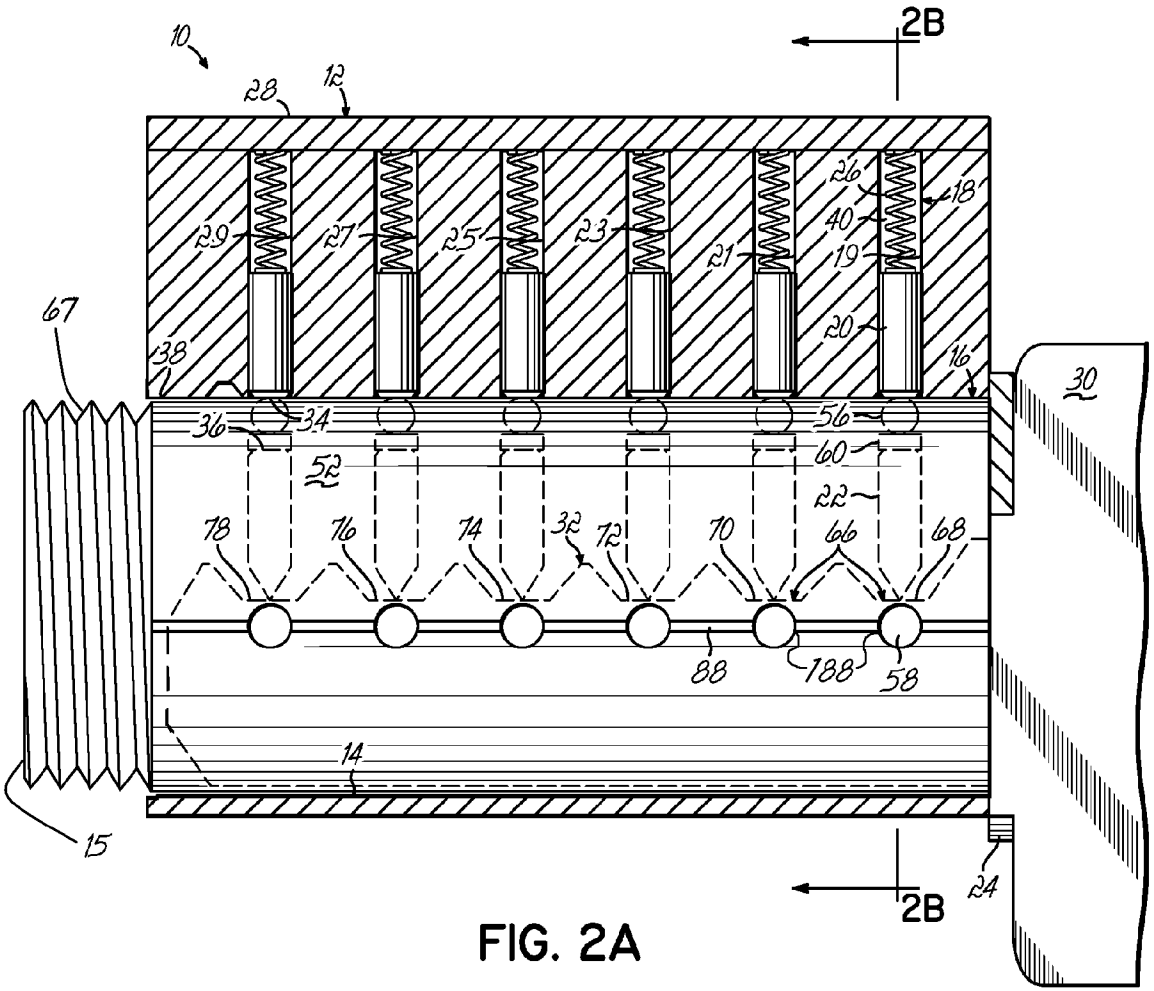
FIG. 2A is a cross-sectional view of the housing with a side view of the plug of a lock assembly of the present invention, depicting a series of change members and retainer cavities when a first operable key is inserted in the keyway.

FIG. 2A shows a cross-sectional view of the housing 12 and a plan view of the drivers 20 and plug 16 disposed within the housing. FIG. 2B is a sectional view of the lock through line 2B-2B of FIG. 2A, which shows the plug 16 and housing 12 in sectional view, and the hardware (driver 20, biasing means 25, change member 56. master shim 60 and tumbler 22) in plan view. To improve the understanding of the invention, the retaining cavities 58 and change slot 88 shown in FIG. 2A (and in similar subsequent figures) have been displaced from the longitudinal centerline 54 if the plug 16 (see FIG. 2B) so that the tumblers 22 and contour positions 68, 70, 72, 74, 76 and 78 of key 30, shown in phantom lines, can be viewed.

In FIGS. 2A and 2B, when a first key 30 of a subset of user keys is inserted into the keyway 24, the paired stacks of tumblers 22 and drivers 20 are raised to a height consistent with a top edge contour 32 of the key. If a proper (or operable) key has been inserted, a lower end 34 of the respective driver 20 or an upper end 36 of the respective tumbler 22 is disposed along a shear line 38 of the lock 10. The shear line 38 is located at the interface of where the outer circumference or periphery of the plug 16 confronts or opposes the inner surface of the bore 14. Thus, the proper or operable key will raise the respective tumblers 22 and drivers 20 to allow for rotation of the plug 16 within the housing 12. As the plug 16 rotates, each driver 20 will be disposed substantially wholly within the respective driver chamber 40 of the housing 12, while each tumbler 22 will be disposed substantially wholly within the respective tumbler chamber 42 of the plug 16. The first key 30 can have a longitudinal contour 44 configured at least along one side of the key and a top edge contour 32. Alternatively, longitudinal contours 44 can be configured on both sides of the key.

More specifically, and as shown in FIG. 1, the body 46 of the lock 10, of the illustrated embodiment, is generally cylindrical in configuration and is provided with a generally circular flange 48 at one end thereof to abut a door or other member in which the lock 10 may be installed. A portion of the body 46 can be threaded (not shown) near the end opposite of the flange 48 to permit the lock 10 to be secured to an object (not shown) requiring locking. The bore 14 is formed in and extends through the housing 12 about and along a longitudinal axis 50 and passes through both ends of the housing 12.

The plug 16 of the illustrated embodiment includes a cylindrical body 52 configured such that in the assembled lock 10, the periphery of the plug 16 confronts or opposes the surface of the bore 14 of the lock 10, with the longitudinal axis 50 of the bore 14 and a longitudinal axis 54 of the plug 16 being substantially coaxial. Latch end 15 of the plug 16 extending from the housing 12 can be provided with threads 67, with which a mating lock nut (not shown) can be threaded to secure the plug 16 within the bore 14 of the housing 12. A latch member (not shown) can be secured on the latch end 15 of the plug 16 to engage a recess or bolt (also not shown) to lock the object in which the lock 10 is installed.

When the respective driver chambers 40 of the housing and the tumbler chambers 42 of the plug are aligned, a plurality of pin chambers 18 are formed, extending from the keyway 24 in the plug to and through the top end of the housing. The pin chambers 18 extend in a manner substantially orthogonal with respect to the longitudinal axis 54 of the plug 16. The portion of the pin chambers 18 represented by the tumbler chambers 42 intersect the bore 14 and extend through a portion of the plug 16 to intersect the keyway 24, while the portion of the pin chamber 18 represented by the driver chambers 40 extend into and through the housing 12 of the lock 10. Thus, the driver chamber 40 portion of each pin chamber 18 intersects the housing 12 and the bore 14, while the tumbler chamber portion 42 of each pin chamber 18 intersects the periphery of the plug 16 and the keyway 24. Biased by the driver spring 26 between the top plate 28 and each driver 20, driver 20 disposed within each driver chamber 40 is urged generally toward the bore 14. When no key is inserted into the keyway 24, the force of the driver spring 26 can cause at least a portion of each driver 20 to project into the tumbler chamber 42 portion, of the pin chamber 18 within the plug.

Each tumbler chamber 42 is axially aligned with a respective driver chamber 40 when the plug 16 is in an initial or first position shown in FIGS. 2A and 2B, and has not been rotated. A portion of each tumbler 22 within tumbler chamber 42 can extend into the keyway 24 due to the biasing or urging force created by the combination of the respective driver 20 and driver spring 26. Additionally, the upper end 36 of each tumbler 22 can contact and engage the lower end 34 of each driver 20. While the illustrated embodiment of the lock 10 of the present invention is depicted as having a particular number or plurality of paired stacks or sets of drivers 20 and tumblers 22, alternate embodiments of the lock 10 may include one pair of driver and tumbler 20, 22, or multiple pairs of drivers and tumblers 20, 22 of lesser or greater number than that depicted in the illustrated embodiment.

The lock 10 of the present invention also includes a lock configuration change member 56, which, as in the illustrated embodiment, can be in the form of a generally spherical change member or change ball, such as a ball bearing. Change member 56 is configured to be disposed within the pin chamber 18 and incorporated as part of each paired stack or set of drivers 20 and tumblers 22. Alternatively, the change member 56 can be disposed in a separate retainer cavity 58 configured in or otherwise associated with the plug 16. Each change member 56 is movable such that it can be displaced from a first position in the pin chamber 18, more specifically in tumbler chamber 42, to a second position within the respective retainer cavity 58. Conversely, change member 56 can be displaced from the second position within the retainer cavity 58 to the first position in the pin chamber 18. By moving a change member 56 between one or more of the pin chambers 18 and the respective retainer cavities 58, one can alter the configuration of one or more of the paired stacks or sets of drivers 20 and tumblers 22 to accept and render operable keys having a differing top contour 32. Thus, when a change member 56 is in a first position, it can be incorporated as part of a paired stack or set of drivers 20 and tumblers 22. In a driver/tumbler stack having a change member 56, the driver 20 and tumbler 22 can each contact and engage a respective side of the change member 56 when it is disposed between the driver 20 and the tumbler 22. In a driver/tumbler stack where the change member 56 has been displaced to the second position, the driver 20 and the tumbler 22 can contact and engage one another. Alternatively, as will be explained in more detail below, the driver/tumbler stack can include a generally circular master shim 60 disposed amongst or between the driver 20, tumbler 22, and change member 56 of the respective stack or set. A lock 10 of the present invention can be provided with a subset of keys that can operate the particular lock, and are adapted to displace one or more change members 56, as will be described in greater detail below.

Each retainer cavity 58 has an opening having a circular cross section for receiving change members 56. Typically, the change member 56 has a diameter smaller, more typically just slightly smaller, than the cross section of the retainer cavity 58. The spherical shape of the change member 56 allows rolling movement within the cavity 58 and driver/tumbler chambers 40 and 42 of the lock, and to project the same cross-sectional shape regardless of its orientation. Also, the spherical shape of the change member 56 has no corners or edges which can obstruct its free movement. A barrel- or cylindrical-shaped change member can be used in a lock of the present invention, although it may have a tendency to tilt or tumble within a chamber, and increase the potential of becoming lodged within the chamber and jamming the lock. For the purpose of describing succeeding embodiments of the present invention, the change member 56 will hereinafter be referred to as the change ball 56.

Referring now to FIGS. 2A-13D, a first embodiment of the lock 10 of the present invention is illustrated. This illustrated embodiment of the present invention allows an operator to change the configuration of drivers 20, tumblers 22, and change balls 56 of a lock that operates with a first user key 30, to accept and render operable a second user key 62, and render inoperable the first key 30, without the use of a change tool 64 (see FIG. 1). Thus, the second key 62 is used to change the configuration of drivers 20, tumblers 22, and change balls 56 in the lock 10 in order to foreclose the use of the first key 30, without removal and disassembly of the lock itself. A subset of user keys can be provided wherein the use of each subsequent operating key can reconfigure or re-key the lock 10 to foreclose any previous operating key from operating the lock 10. This progression can be determined by the differing top edge contours 32 of each of the keys. As an operator progresses through using each key of the subset of keys for a particular lock 10, at least one additional change member of ball 56 is displaced from one of the pin chambers 18 into the respective retainer cavity 58. As this occurs, any key of the subset of keys that is configured to displace less than the current number and configuration of change balls 56 that are displaced will no longer operate the lock 10. Using any key of the subset that is configured to displace one or more additional change balls than the current number and configuration of change balls 56 that are displaced, will change the corresponding configuration of driver 20, tumbler 22, and change ball 56 to match that key. For example, if a lock includes six pin chambers 18 having drivers 20, tumblers 22, and/or change balls 56, then there can be up to seven keys in an operable set, with each successive key displacing at least one more change ball 56 than the previous key. One key of the seven key set would displace none of the change balls 56. This key can be termed the null or base key. Each successive key will have a nearly identical top contour to a previous key in the set, with the exception that at least one additional contour location 66 will be raised, as will be explained in greater detail below.

In the illustrated embodiment of FIGS. 2A-12B, the lock 10 of the present invention is shown as having first, second, third, fourth, fifth, and sixth pin chambers identified, respectively, as 19, 21, 23, 25, 27, 29, each adapted to house a set of a driver 20, a tumbler 22, and a change ball 56. A key inserted into a keyway 24 is shown as having first, second, third, fourth, fifth, and sixth contour locations identified, respectively, as 68, 70, 72, 74, 76, 78. When a key is fully inserted into keyway 24, these first, second, third, fourth, fifth, and sixth contour locations 68, 70, 72, 74, 76, 78 register with the corresponding first, second, third, fourth, fifth, and sixth pin chambers 19, 21, 23, 25, 27, 29, respectively. Each of these contour locations 68, 70, 72, 74, 76, 78 can be a raised contour location or a lowered contour location. With particular reference to FIG. 2A, one can see that the first key 30 has no raised contour locations 66, such that no change balls 56 are raised above the shear line 38.

When a key is inserted in the keyway 24, a raised contour location 66 will raise the upper end 36 of the respective tumbler 22 flush with the shear line 38 of the lock 10, such that any change ball 56 disposed in a first position will be raised above the shear line 38 and into the driver chamber 40 of the housing 12. Referring to FIG. 3A, a second user key 62 is shown as having a first contour location 68 that is raised. The second key 62 can rotate the plug 16 and operate the lock since, when it raises the respective drivers 20, tumblers 22, and change balls 56 of the pin chambers 18, the junction between any two of those components proximate to the shear line 38 is flush therewith. None of these components, and particularly neither the driver 20 nor the tumbler 22, spans across the shear line. In particular, the raised first contour location 68 of the second key 62 raises change ball 56 disposed within the first pin chamber 19, above the shear line 38. Once the plug 16 has been rotated to displace the change ball 56 of the first pin chamber 19 into its corresponding retainer cavity 58, the first key 30 is rendered inoperable due to its lowered first contour location 68 (see FIG. 6A). Referring to FIG. 7A, a third key 63 has raised first and third contour locations 68, 72. Raised third contour location 72 displaces an additional change ball 56 that is disposed in the third pin chamber 23. Thus, a subsequent key, having at least one additional raised contour location 66, will render inoperable any other previously-operable key that has a lowered contour position corresponding to a raised contour position 66 of the subsequent key. The set of keys can include a fourth key 80 (shown in FIG. 13A) having raised first and third, and an additional raised fifth contour location 76, a fifth key 82 (shown in FIG. 13B) having raised first, third, and fifth contour locations 68, 72, 76 and an additional raised second contour position 70, a sixth key 84 (shown in FIG. 13C) having raised first, second, third, and fifth contour locations 68, 70, 72, 76 and an additional raised fourth contour position 74, and a seventh key 86 (shown in FIG. 13D) having raised first, second, third, fourth, and fifth contour locations 68, 70, 72, 74, 76, and an additional raised sixth contour position 78. It is to be understood that the set of six keys shown is simply illustrative, and can be any number of similarly configured keys, with a maximum number equal to one more than the number of pin chambers 18 in the lock 10.

Once all the change balls 56 have been displaced into respective retainer cavities 58, thus reaching the end or having used the last of the subset of user keys, the lock 10 can be reset to the first key 30 in the subset through the use of the change tool 64. Alternatively, the lock 10 can be reset any time an operator desires, not just when all of the keys of a set have been used. In order to effect this change, the plug 16 includes a second orifice or passage in the form of change slot 88. Change slot 88 is typically configured in the plug 16 in a direction parallel to the longitudinal axis 54 of the plug 16, and typically extends from the front face of the plug and intersects a portion of each of the retainer cavities 58. When the plug 16 has been rotated to a position where the retainer cavities 58 are aligned with the driver chambers 40 of the housing 12, and the change tool 64 is fully inserted in the change slot 88, any change balls 56 disposed in the retainer cavities 58 will be displaced out of the retainer cavities 58 and into the driver chambers 40. When the plug 16 is then rotated back to its original position, the change balls 56 are returned to the corresponding stack or set of drivers 20 and tumblers 22, and the lock 10 is reset.

The change slot 88 is preferably configured into the plug 16 along the longitudinal line passing through the centers of the retainer cavities 58. This configuration allows the change tool 64 inserted into the change slot 88 to raise a change ball 56 contained therein at its center of weight and to its maximum height. Additionally, the change slot 88 is configured to minimize the width thereof to that necessary to accommodate a change tool 64 that can effectively raise the change balls 56 out of the retainer cavities 58. In a typical door lock, having six or so pin chambers, the width of the change slot is typically about 0.020 inches (about 0.50 mm) or less. If the width of the change slot 88 is too large, a member such as a master shim 60 (discussed herein after) might catch the corner 188 of the opening to the retainer cavity 58 at the intersection with the change slot 88 (see FIG. 2A). With time, the repeated impact of the master shim against the corner 188 can cause wear at the corner 188, which could eventually permit a shim to twist and jamb into the opening.

The method of using the lock 10 of this embodiment of the present invention involves inserting a first key 30 to which the lock 10 is programmed to operate into the longitudinal keyway 24 of the lock 10. This key then can be used to rotate the plug 16 within the housing 12. The first key 30 is then removed from the longitudinal keyway 24. The second key 62 has a different though complementary top edge contour 32 than the first key 30. The top edge contour 32 of the second key 62 also has raised contour locations 66 that match the top edge contour 32 of the first key 30, to raise any paired stacks or sets of drivers 20 and tumblers 22 in like manner as would also be raised by the first key 30, and at least one additional raised contour 66. As the second key 62 is inserted, the additional raised contour 66 on the second key causes at least one change ball 56 to be raised above the shear line 38 of the lock 10 and disposed in the respective driver chamber 40 in the housing 12.

When the second key 62 and plug 16 are rotated clockwise, the retainer cavities 58 will come into alignment with the driver chambers 40. As this occurs, the spring force of the driver spring 26 disposed above each driver 20 in the driver chamber 40, forces the change ball 56, situated above the shear line 38, down into its corresponding retainer cavity 58. When the second key 62 is rotated along with the plug 16 back to its original position, the additional change ball 56 is now disposed in a retainer cavity 58 offset from the pin chamber 18, and thus the lock 10 has been reset to operate with the second key 62.

While only one change ball 56 at a time is being described moving from a tumbler chamber 42 to the retainer cavity 58, the invention provides that more than one change ball 56 at a time can be moved from the tumbler chambers 42 to the retainer cavities 58.

Referring now to FIGS. 2A and 2B, the illustrated embodiment of the lock 10 is depicted with an operable first key 30 inserted into the keyway 24. The first key 30 has a top edge contour 32 with no contour location 66 raised. All six contour locations 68, 70, 72, 74, 76, 78, have a lowered position. The Figures show that these lowered contour locations 68, 70, 72, 74, 76, 78 keep the change balls 56 disposed within the tumbler chambers 42 when the first key 30 is inserted. Since the drivers 20, tumblers 22, and change balls 56 in each of the pin chambers 18 are raised such that no driver or tumbler spans or straddles the shear line 38, the first key 30 operates the lock by rotating the plug 16 within the housing 12.

It should be recognized that when the lower portion of a change ball 56, below its centerline, spans the shear line, the rotation along the shear line of the plug within the housing will cause the ball 56 to be forced into the drive chamber 40. If the centerline or the upper portion of the change ball lies along the shear line, the plug will not rotate in the bore of the housing, and may become jammed.

Figure 3B:
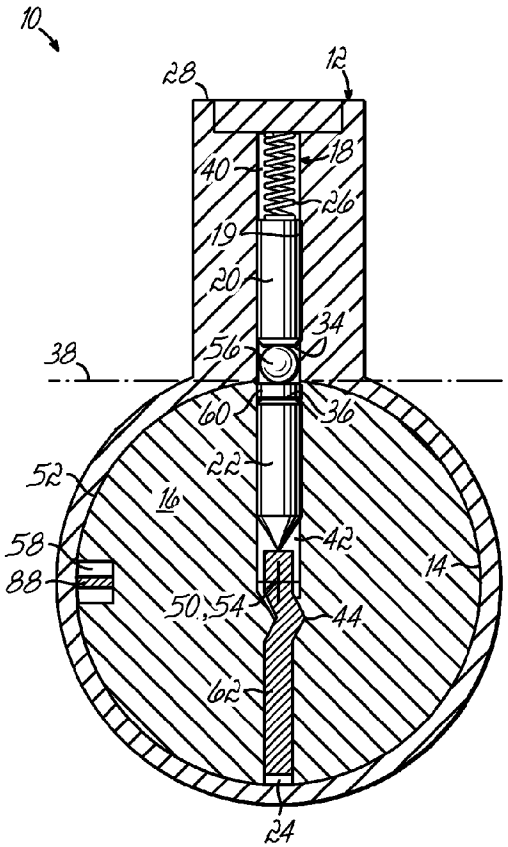
FIG. 3B is a cross-sectional view of the housing and plug taken along line 3B-3B of FIG. 3A.
Figure 3A:
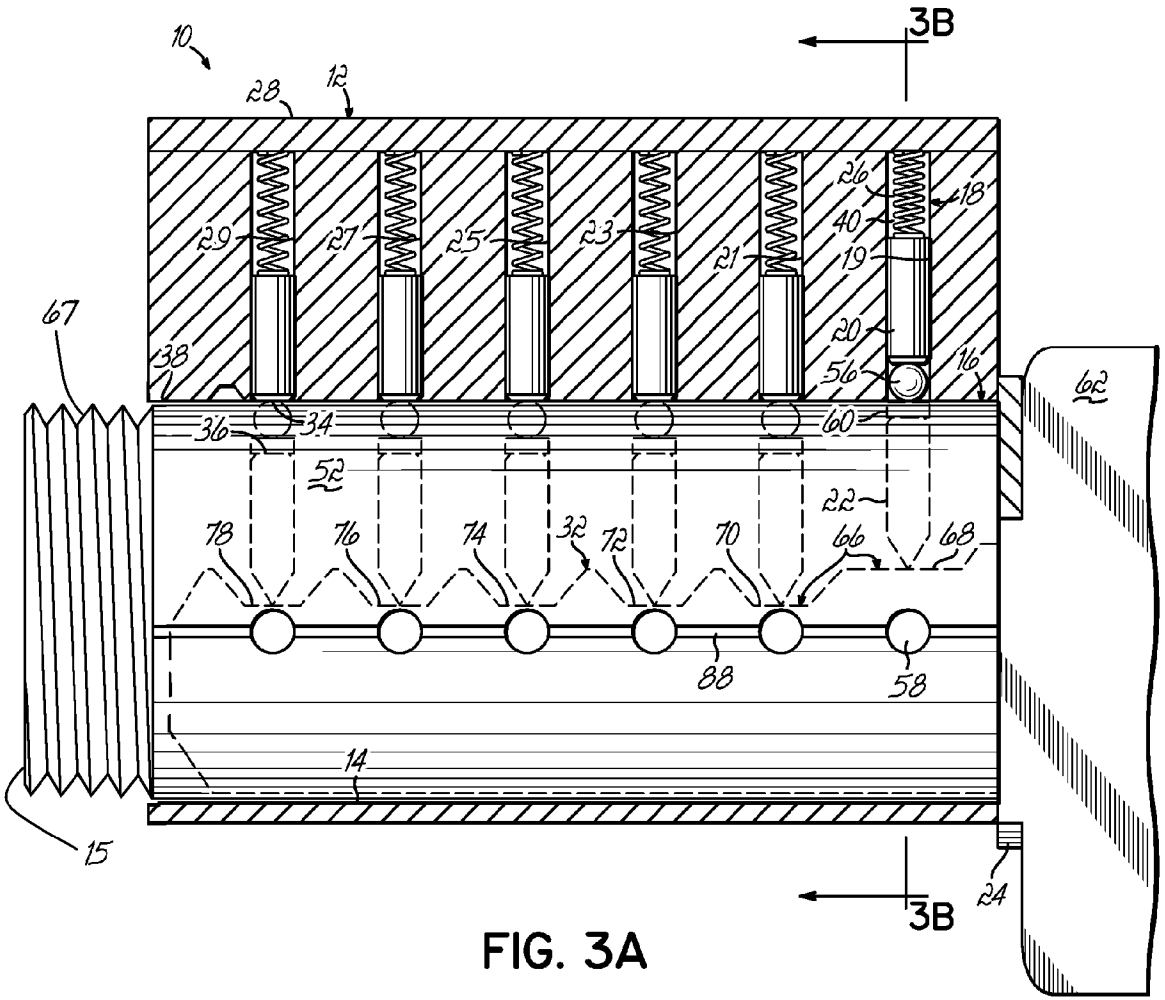
FIG. 3A is a cross-sectional view of the housing, with a side view of the plug of the lock assembly depicting the positioning of the change members and retainer cavities when a second key is inserted into the keyway.

Referring now to FIGS. 3A and 3B, the plug 16 and housing 12 are depicted with the first key 30 removed and a second key 62 now inserted in the keyway 24 of the lock 10. This second key 62 has a top edge contour 32 that differs from that of the first key 30, particularly in that the first contour location 68 is raised. The first key 30 has a first contour location 68 that is lowered. The raised first contour location 68 of the second key 62 causes the change ball 56 in the first pin chamber 19 to be raised above the shear line 38. Since the drivers 20, tumblers 22, and change ball 56 of each of the series of pin chambers 18 are positioned with no driver, tumbler, or change ball spanning or straddling the shear line 38, this second key 62 can operate the lock 10.

Figure 4B:
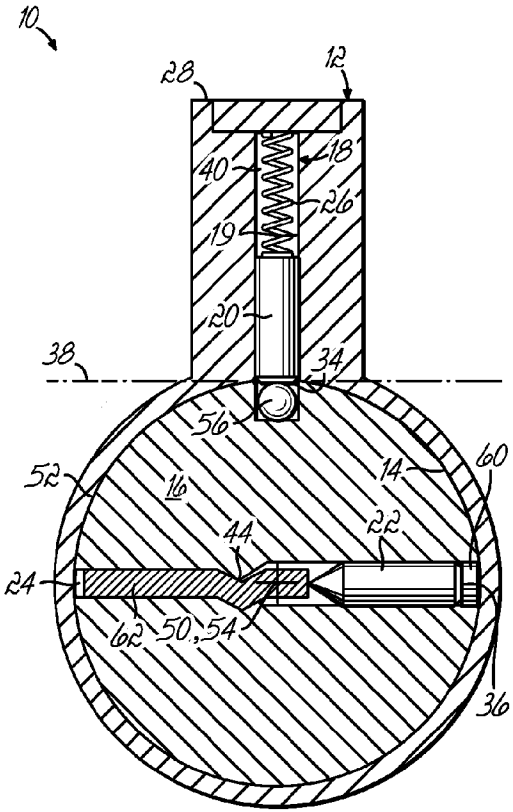
FIG. 4B is a cross-sectional view of the housing and plug taken along line 4B-4B of FIG. 4A.
Figure 4A:
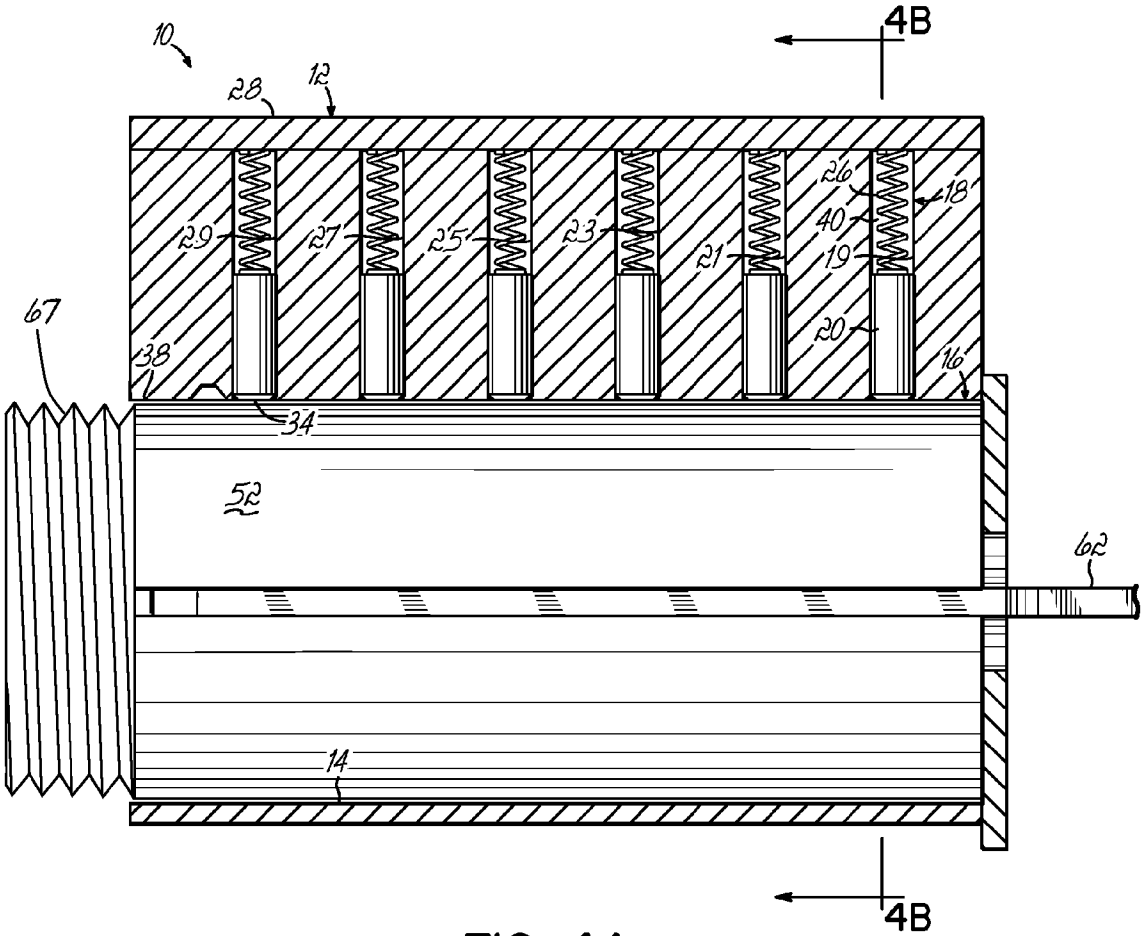
FIG. 4A is a cross-sectional view of the housing, with a side view of the plug of the lock assembly depicting the second key inserted and rotated one-quarter turn clockwise.

Referring now to FIGS. 4A and 4B, the lock 10 of the present invention is depicted with the second key 62 inserted in the plug 16 and rotated one-quarter turn clockwise, which brings the retainer cavities 58 into alignment with the driver chambers 40 in the housing. The driver spring 26 disposed above the driver 20 in the first driver chamber 40 of first pin chamber 19 then forces the change ball 56 that was disposed above the shear line 38 down into a corresponding retainer cavity 58.

Figure 5B:
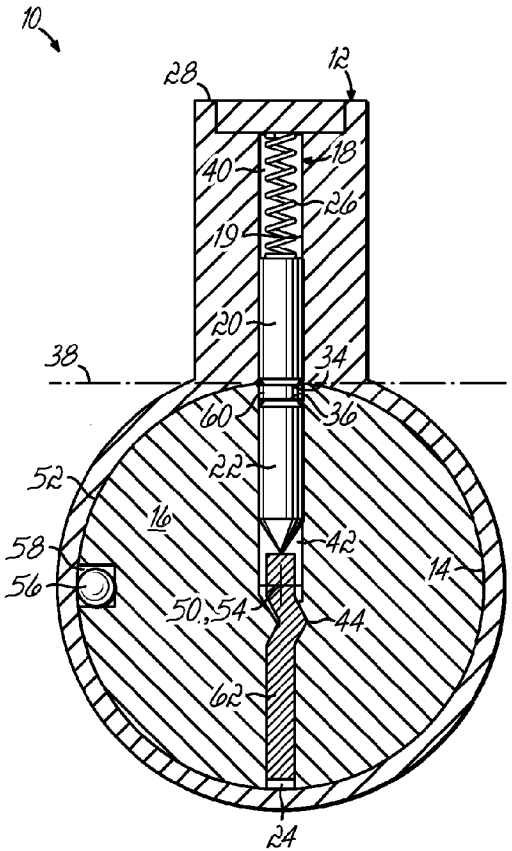
FIG. 5B is a cross-sectional view of the housing and plug taken along line 5B-5B of FIG. 5A.
Figure 5A:
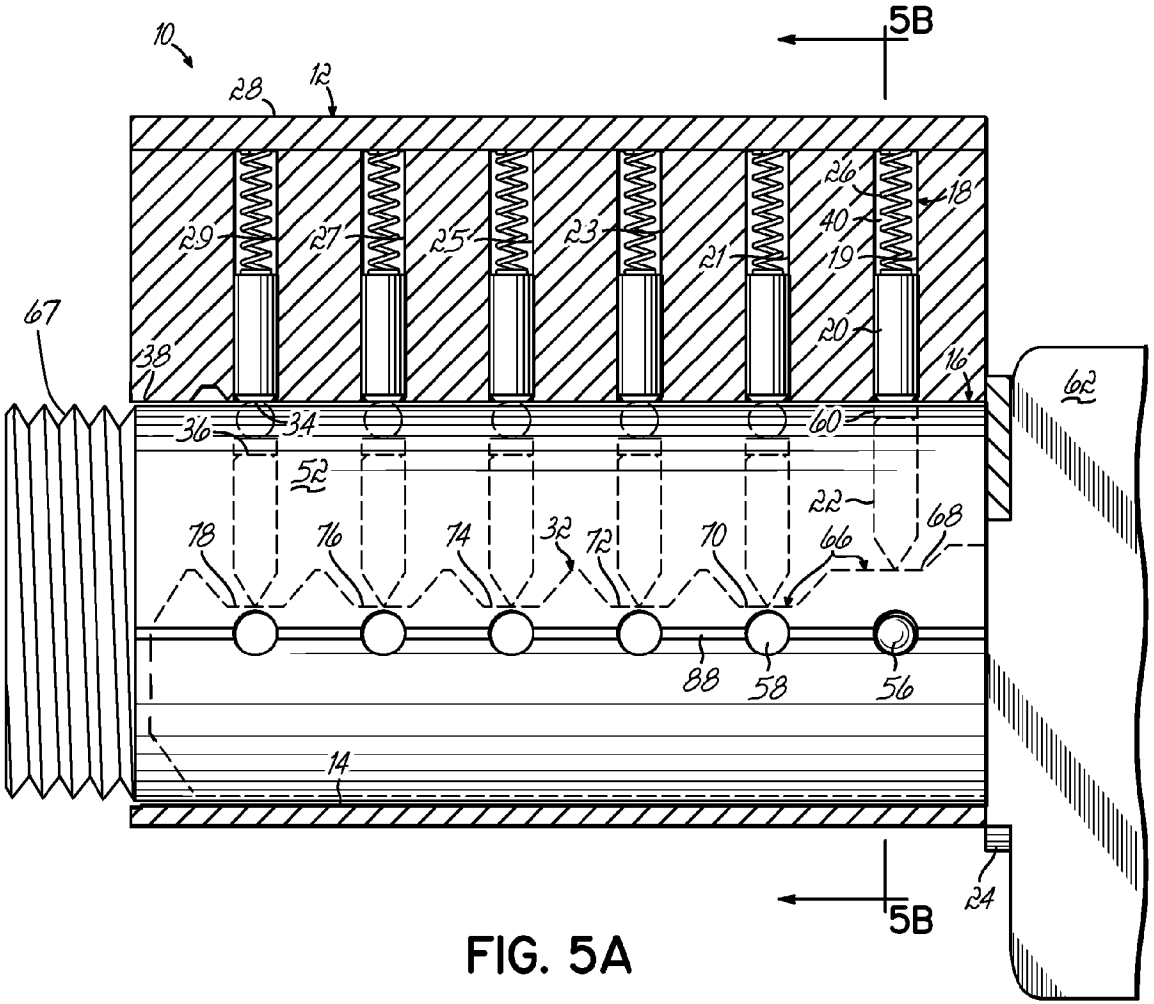
FIG. 5A is a cross-sectional view of the housing, with a side view of the plug of the lock assembly showing the plug rotated back to an originating position with the second key still inserted in the keyway.

Referring now to FIGS. 5A and 5B, the plug 16 with the second key 62 inserted in the keyway 24 has been rotated back to its original position. The change ball 56 associated with the first pin chamber 19, when in its first position, is now been displaced into its second position within one of the retainer cavities 58 disposed in or associated with the plug 16. The various drivers 20, tumblers 22, and change balls 56 are disposed within the pin chambers 18 such that the lower ends 34 of all the drivers 20 are positioned along and flush with the shear line 38 and within the driver chambers 40. Thus, the second key 62 operates the lock by rotating the plug 16 within the housing 12.

Figure 6B:
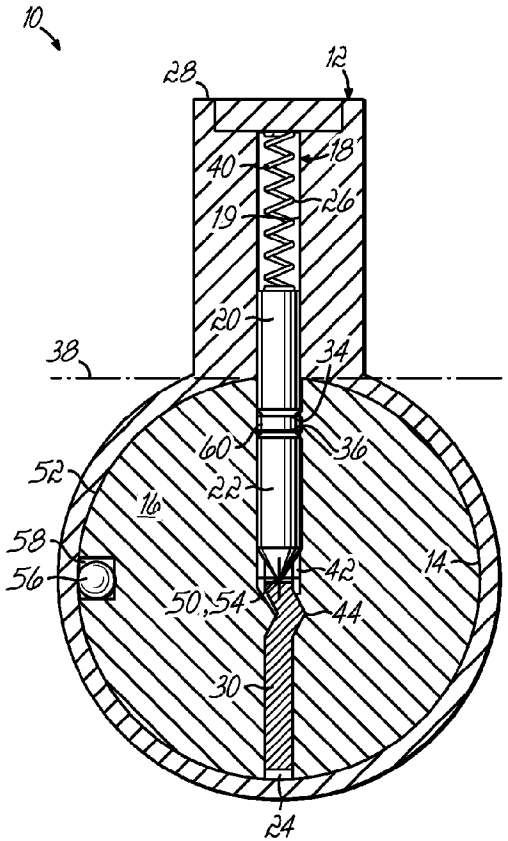
FIG. 6B is a cross-sectional view of the housing and plug taken along line 6B-6B of FIG. 6A.
Figure 6A:
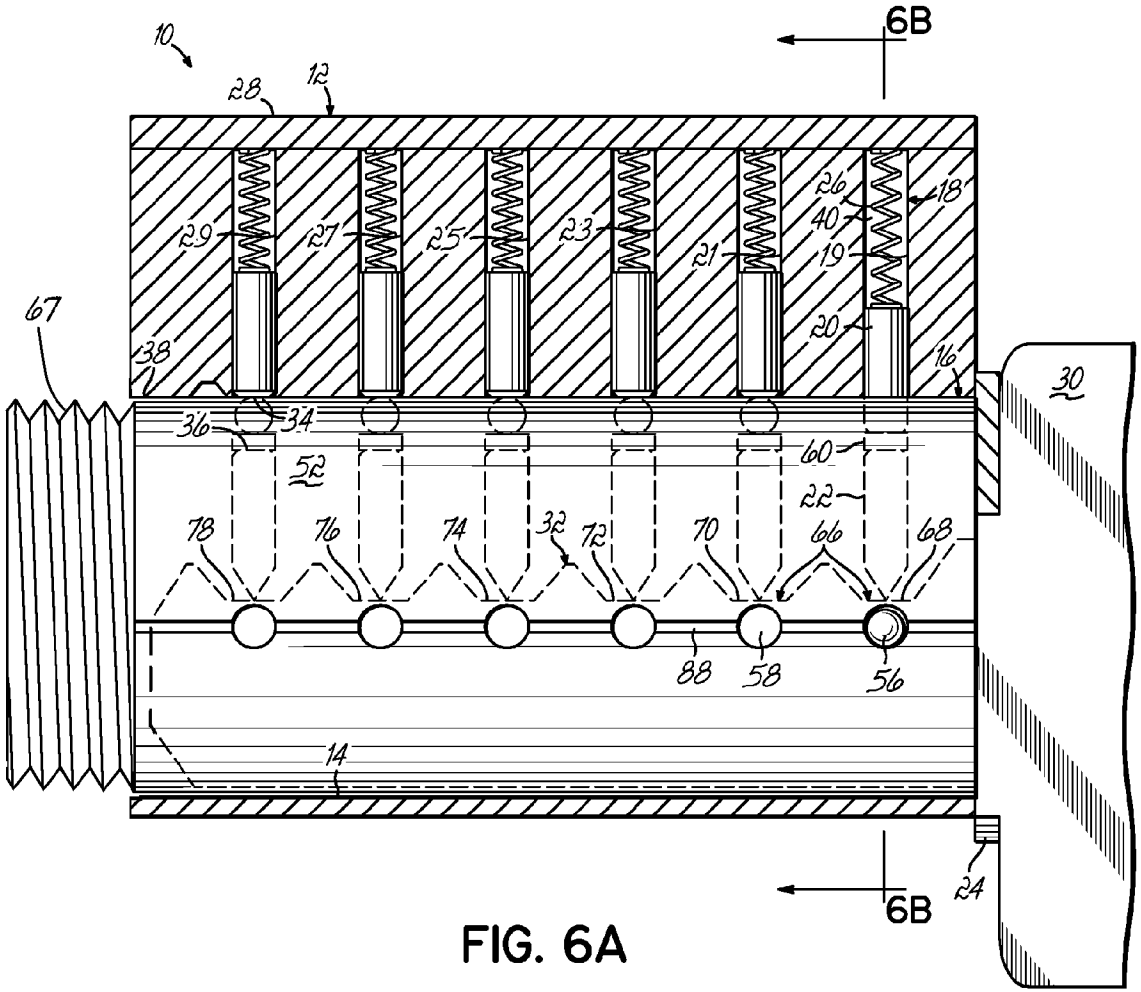
FIG. 6A is a cross-sectional view of the housing, with a side view of the plug of the lock assembly showing the first key, now inoperable, inserted into the keyway.

Referring now to FIGS. 6A and 6B, the second key 62 has been removed from the keyway 24 and the first key 30 has been reinserted. The Figures illustrate that the first key 30 now is foreclosed from operating or cannot operate the lock 10. The differing first contour location 68, which is a lowered position in this first key 30, cannot sufficiently raise the driver 20 and tumbler 22, such that the driver 20 is disposed partially within the driver chamber 40 and partially within the tumbler chamber 42 of the first pin chamber 19. Since the driver 20 of the first pin chamber 19 spans the shear line 38 of the lock 10, the plug 16 will not rotate within the housing 12, and thus first key 30 is foreclosed from operating the lock 10.

Figure 7B:
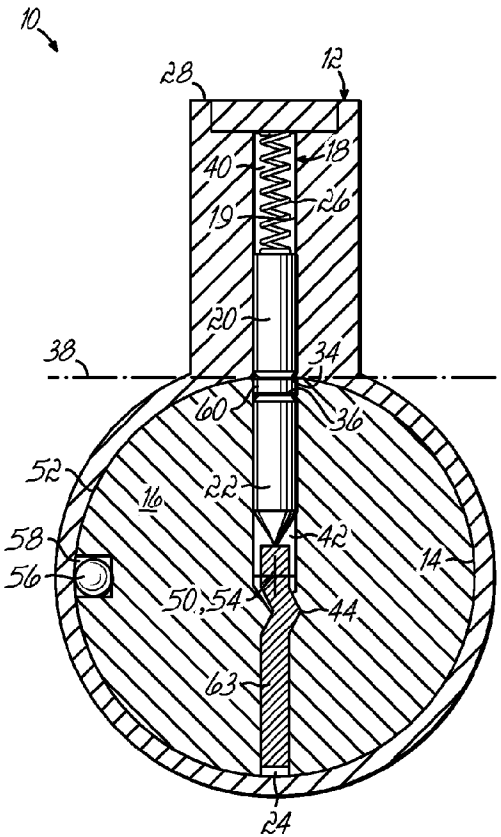
FIG. 7B is a cross-sectional view of the housing and plug taken along line 7B-7B of FIG. 7A.
Figure 7A:
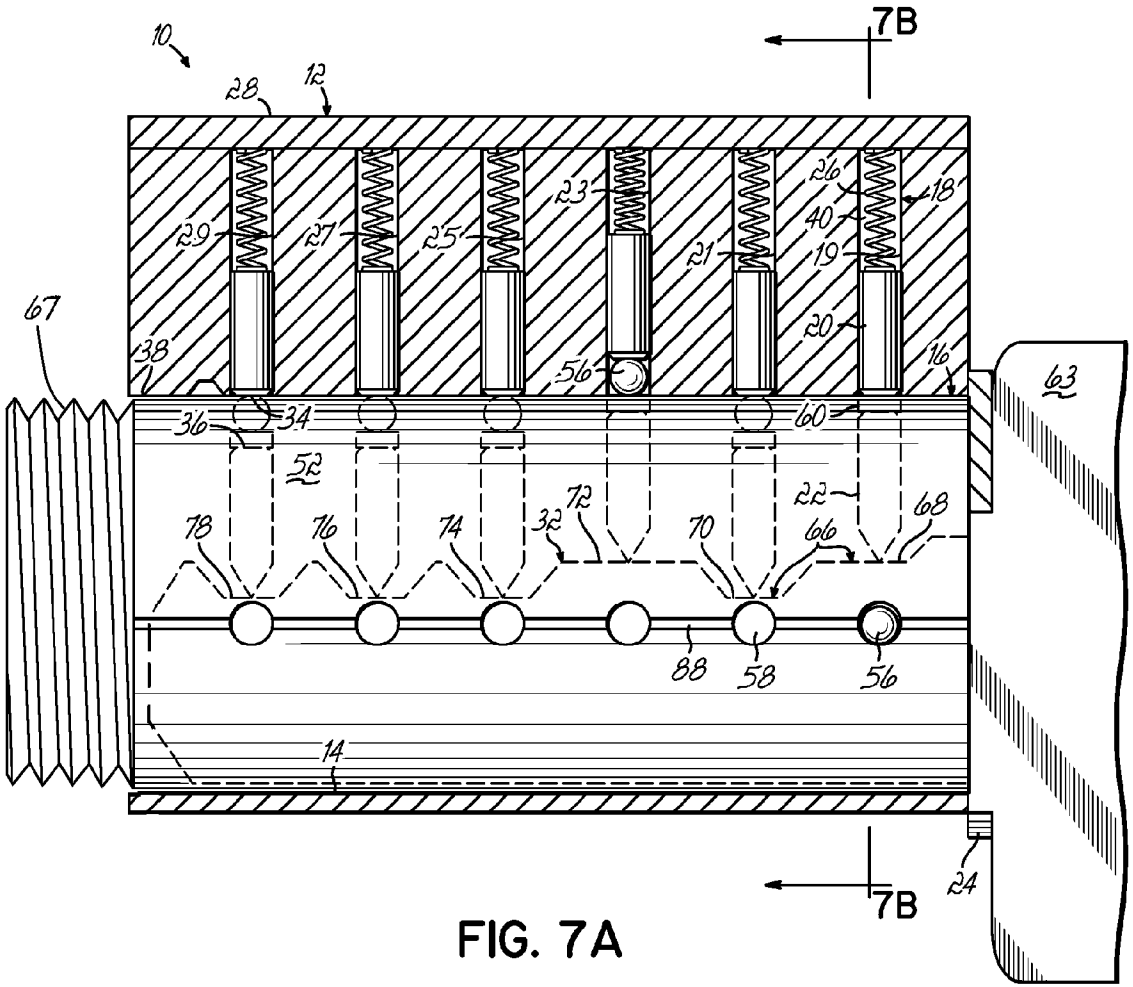
FIG. 7A is a cross-sectional view of the housing, with a side view of the plug of the lock assembly depicting the positioning of the change members and retainer cavities when a third key is inserted into the keyway.

Referring now to FIGS. 7A and 7B, the plug 16 and housing 12 are depicted with the second key 62 removed and a third key 63 now inserted in the keyway 24. This third key 63 has a top edge contour 32 that differs from that of the second key 62. The third contour location 72 of the third key 63 is raised, whereas in the second key 62, the third contour location 72 is lowered. Like the second key 62, the third key 63 includes a raised first contour location 68. With the third key 63 inserted, this third raised contour location causes the change ball 56 of the third pin chamber 23 to be raised above the shear line 38. Since the drivers 20, tumblers 22, and change balls 56 of each of the pin chambers 18 are aligned such that no member is spanning or straddling the shear line 38, this third key 63 can now operate the lock 10.

Figure 8B:
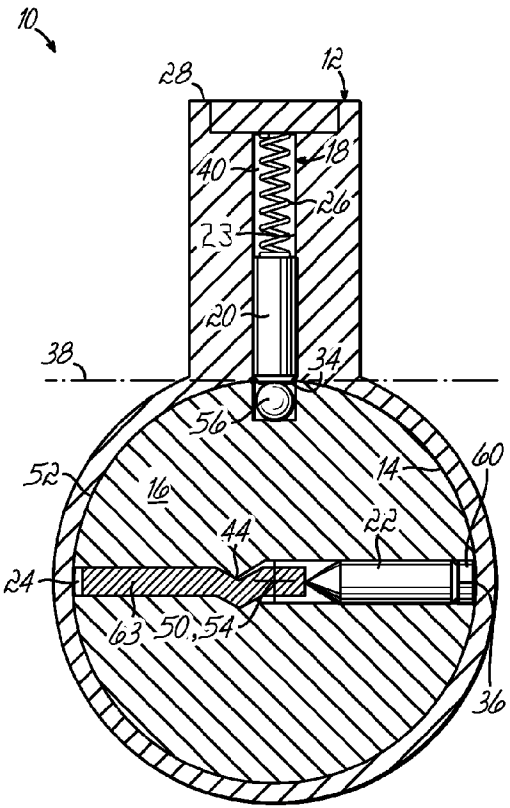
FIG. 8B is a cross-sectional view of the housing and plug taken along line 8B-8B of FIG. 8A.
Figure 8A:
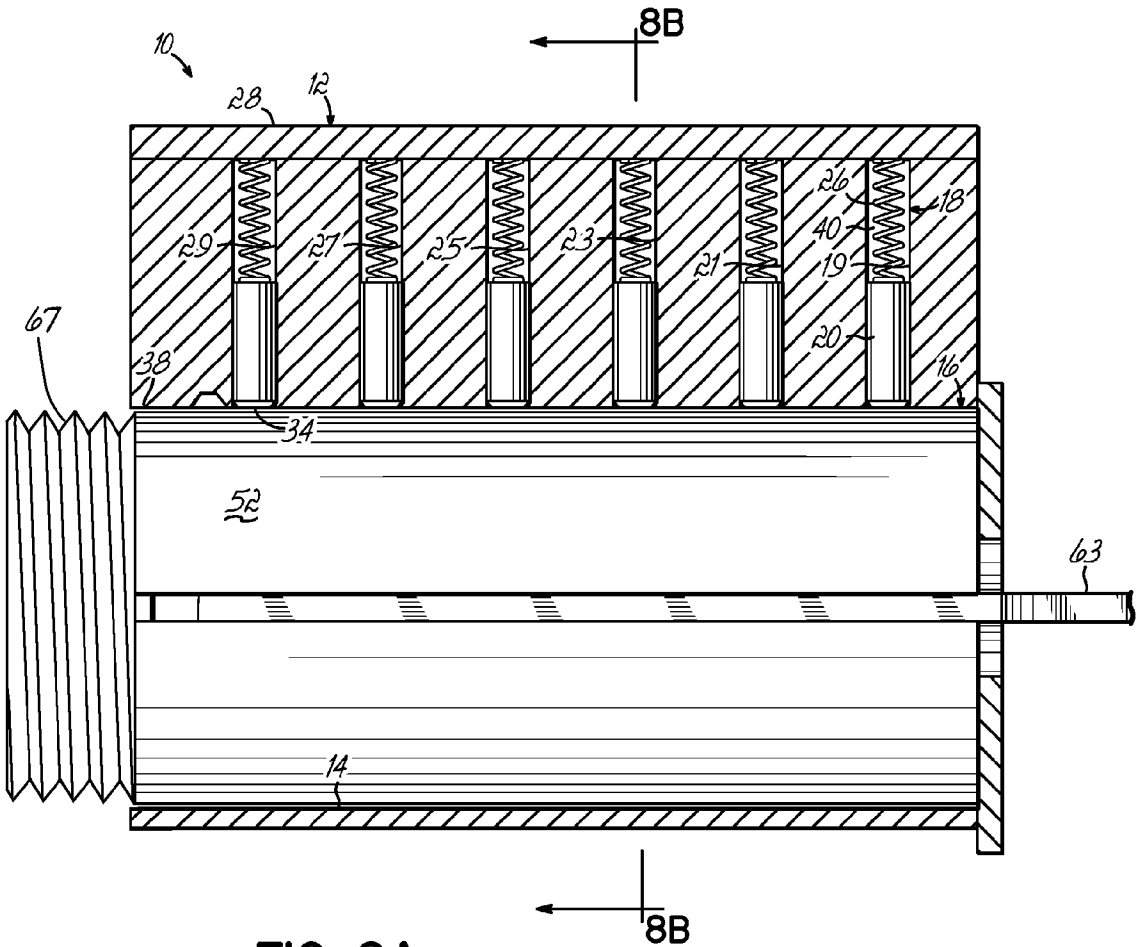
FIG. 8A is a cross-sectional view of the housing, with a side view of the plug of the lock assembly depicting the third key inserted and rotated one-quarter turn clockwise.

Referring now to FIGS. 8A and 8B, the lock 10 of the present invention is depicted with the third key 63 inserted and rotated one-quarter turn clockwise, which brings the retainer cavities 58 into alignment with the driver chambers 40. The driver spring 26 disposed in the third driver chamber 40 of the third pin chamber 23 then forces the change ball 56 that was disposed above the shear line 38 down into a corresponding retainer cavity 58.

Figure 9B:
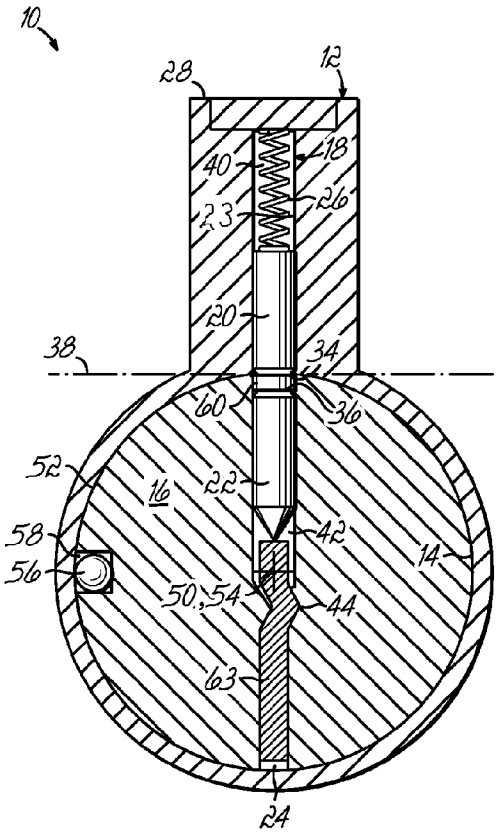
FIG. 9B is a cross-sectional view of the housing and plug taken along line 9B-9B of FIG. 9A.
Figure 9A:
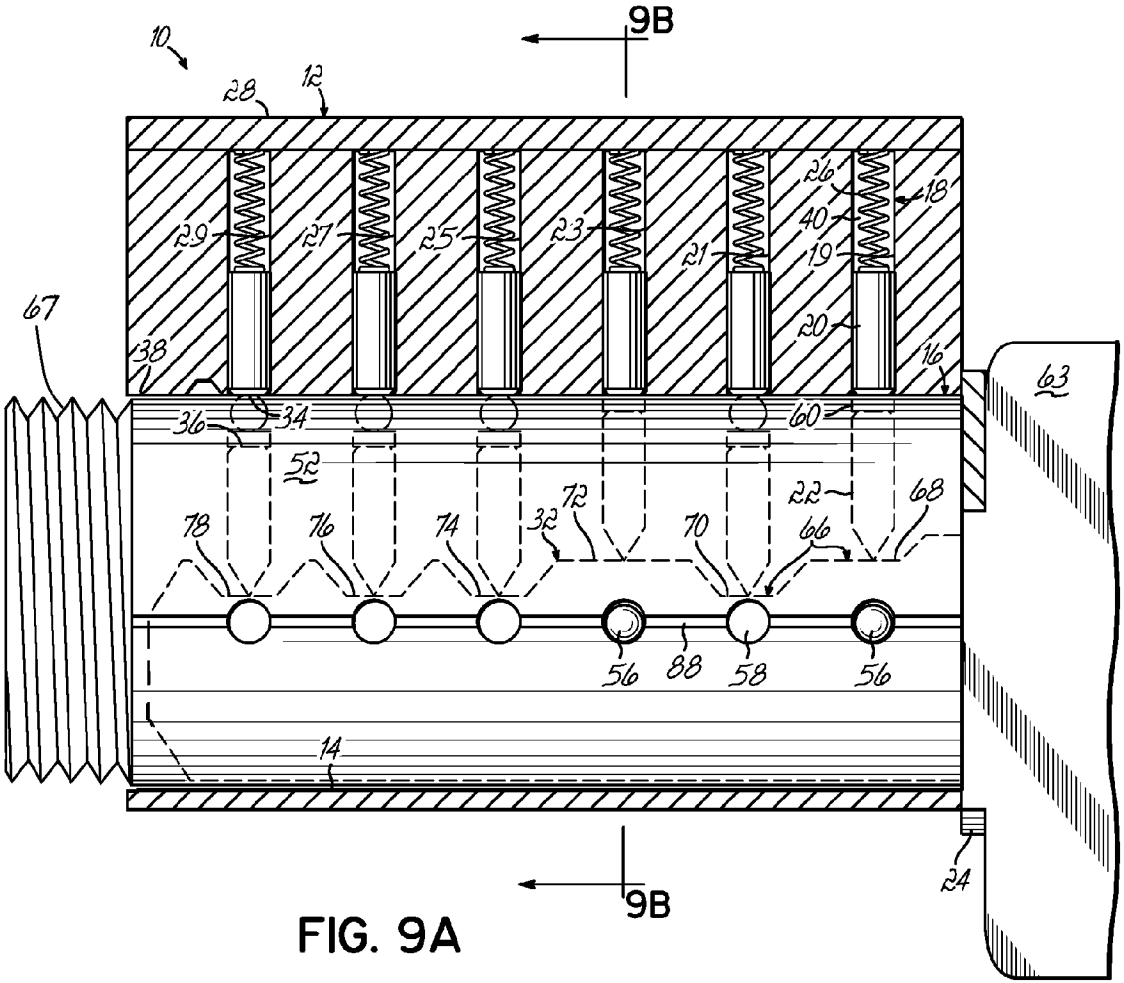
FIG. 9A is a cross-sectional view of the housing, with a side view of the plug of the lock assembly showing the plug rotated back to its original position with the third key still inserted in the keyway.

Referring now to FIGS. 9A and 9B, the plug 16 with the third key 63 inserted in the keyway 24 has been rotated back to its original position. The change ball 56, associated with the third pin chamber 23 when in its first position, is now been displaced into its second position within one of the retainer cavities 58 disposed in or associated with the plug 16. The various drivers 20, tumblers 22, and change balls 56 are disposed within the pin chambers 18 such that the lower ends 34 of all the drivers 20 are positioned along and flush with the shear line 38, and all drivers 20 are disposed fully within the driver chambers 40 of the housing 12. Thus, the third key 63 operates the lock by rotating the plug 16 within the housing 12.

Figure 10B:
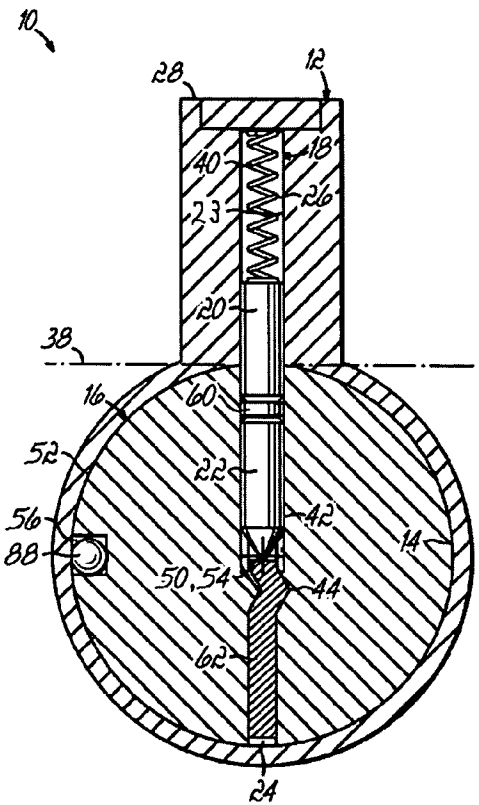
FIG. 10B is a cross-sectional view of the housing and plug taken along line 10B-10B of FIG. 10A.
Figure 10A:
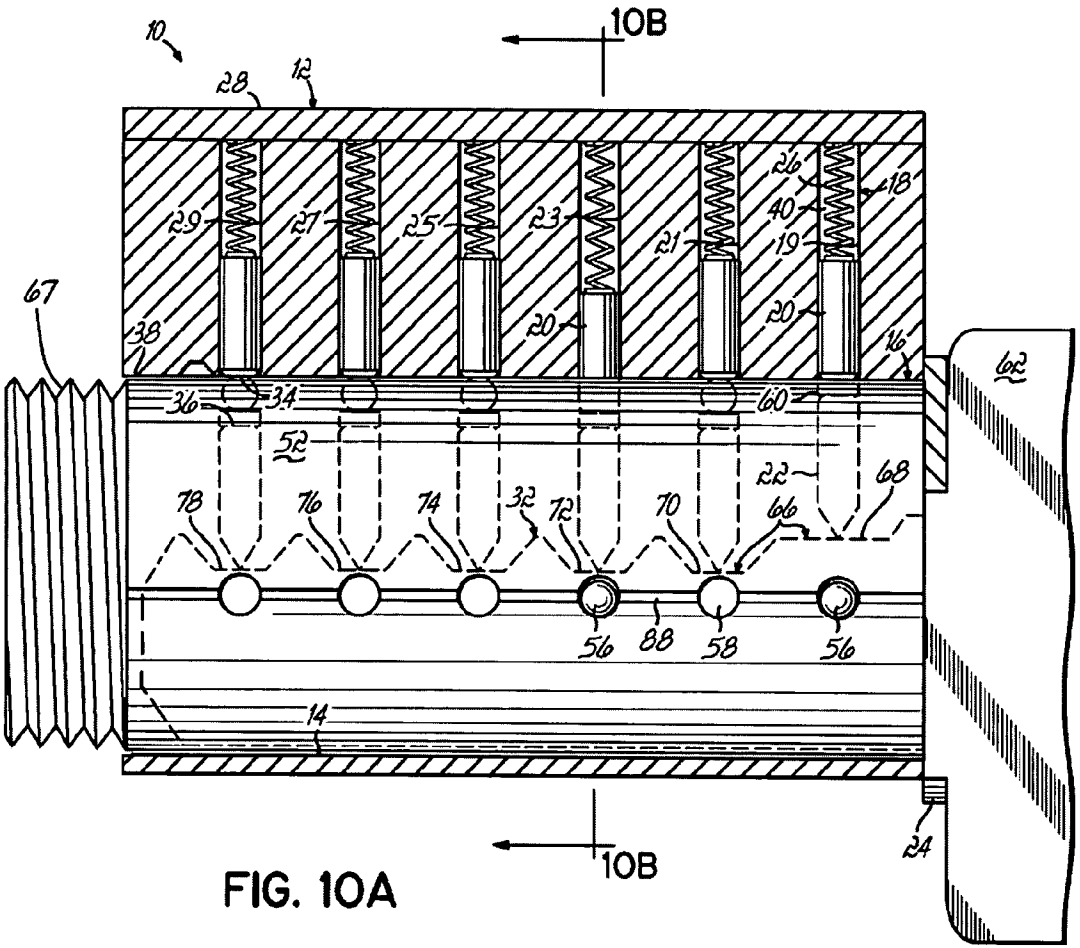
FIG. 10A is a cross-sectional view of the housing with a side view of the plug of the lock assembly showing the second key, now inoperable, inserted into the keyway.
Figure 11B:
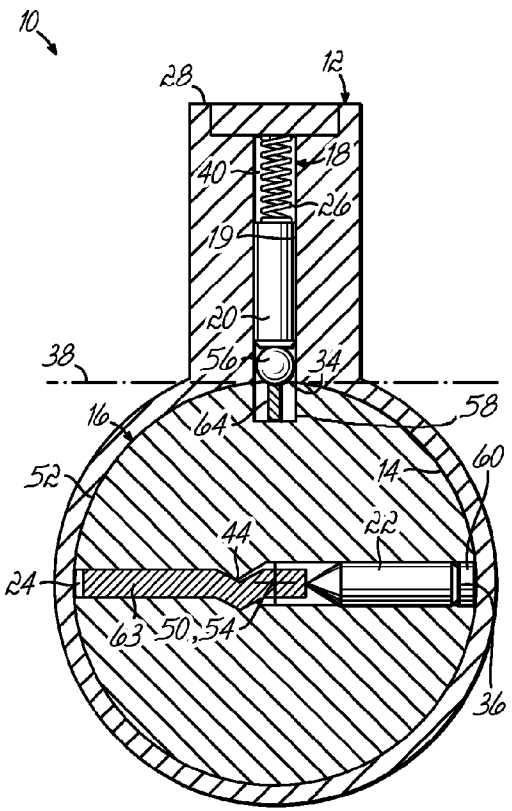
FIG. 11B is a cross-sectional view of the housing and plug taken along line 11B-11B of FIG. 11A.
Figure 11A:
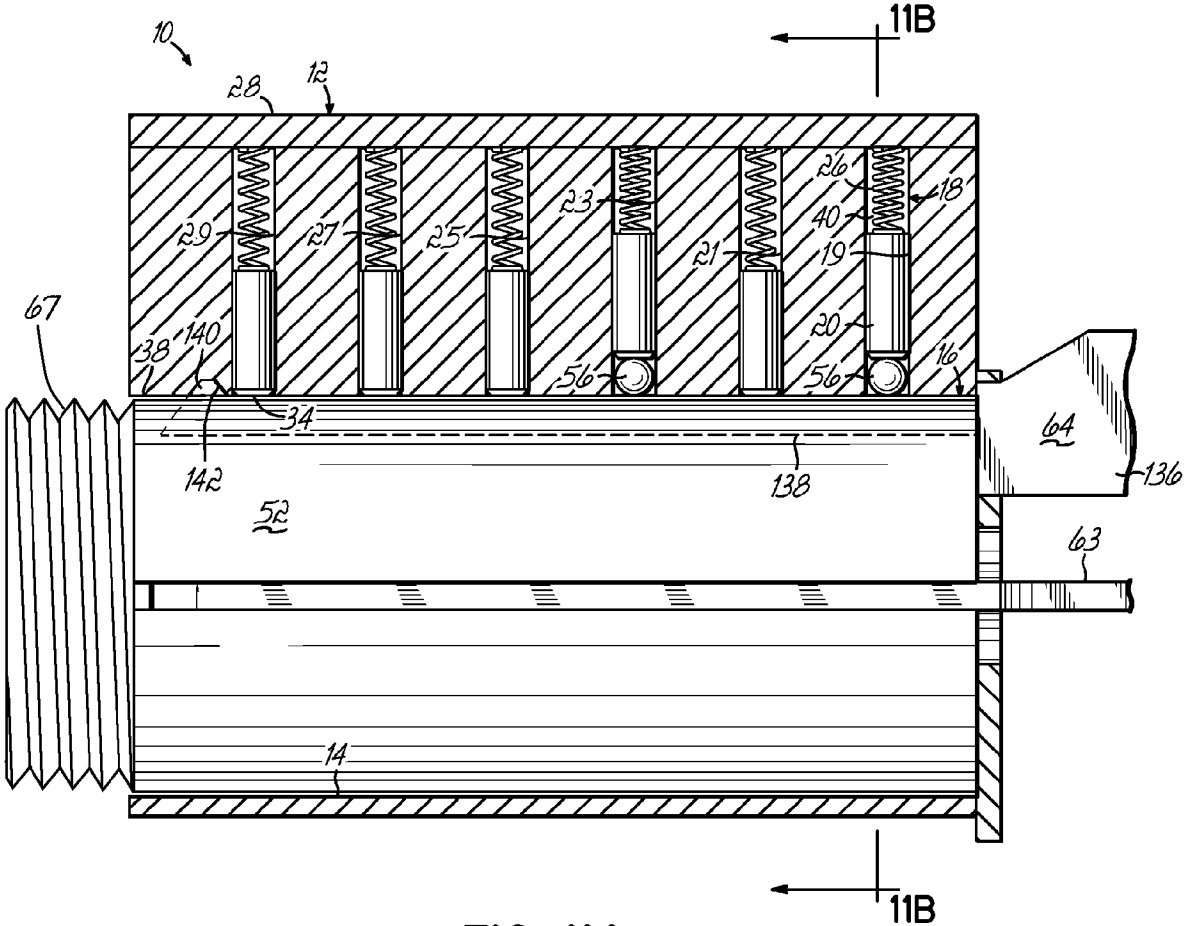
FIG. 11A is a cross-sectional view of the housing, with a side view of the plug of the lock assembly showing the third key inserted in the keyway and the plug rotated one-quarter turn with a change tool inserted in a change slot.

Referring now to FIGS. 10A and 10B, the third key 63 has been removed from the keyway 24 and the second key 62 has been reinserted. The Figures illustrate that the second key 62 now cannot operate the lock 10. The differing third contour location 72, which is a lowered position in the second key 62, cannot sufficiently raise the driver 20 and tumbler 22 of the third pin chamber 23 such that the driver 20 is disposed partially within the driver chamber 40 and partially within the tumbler chamber 42 of the third pin chamber 23. Since the driver 20 of the third pin chamber 23 spans the shear line 38, the second key 62 will not rotate the plug 16 within the housing 12, and thus second key 62 is foreclosed from operating the lock 10.

Referring now to FIGS. 11A-12B, the resetting of the lock 10 to again accept the first key 30 is shown. The lock 10 is shown with the third key 63 (an operable user key) inserted and with plug 16 rotated one-quarter turn clockwise to bring the retainer cavities 58 into alignment with driver chambers 40 of the pin chambers 18. A change tool 64 is inserted into the change slot 88 of the plug 16, causing any change balls 56 disposed in their second position in the retainer cavities 58 to be displaced out of the retainer cavities 58, and into the driver chambers 40.

With the change tool 64 still inserted in the change slot 88, the plug 16 is then rotated back one quarter turn counterclockwise to an original position (not shown) wherein the driver chamber 40 and the tumbler chambers 42 are now aligned. The change balls 56, which has been isolated in the driver chamber 40 by the change tool 64, remain disposed in the driver chambers 40 in the housing 12 just above the shear line 38.

Figure 12B:
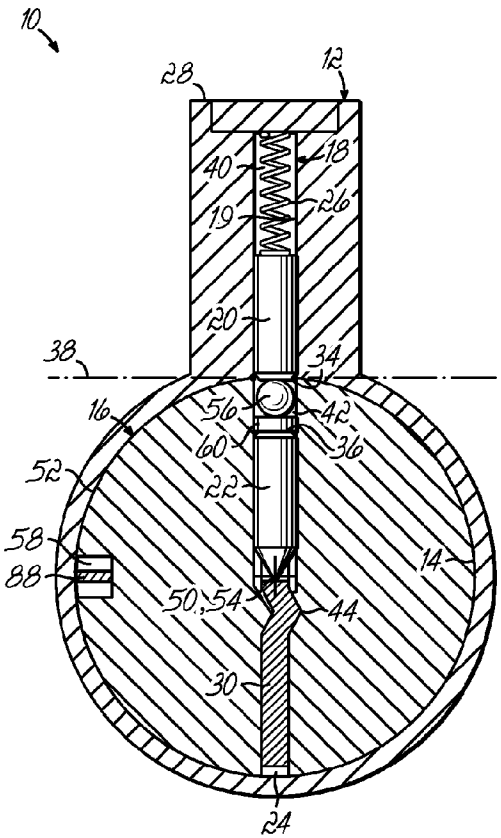
FIG. 12B is a cross-sectional view of the housing and plug taken along line 12B-12B of FIG. 12A.
Figure 12A:
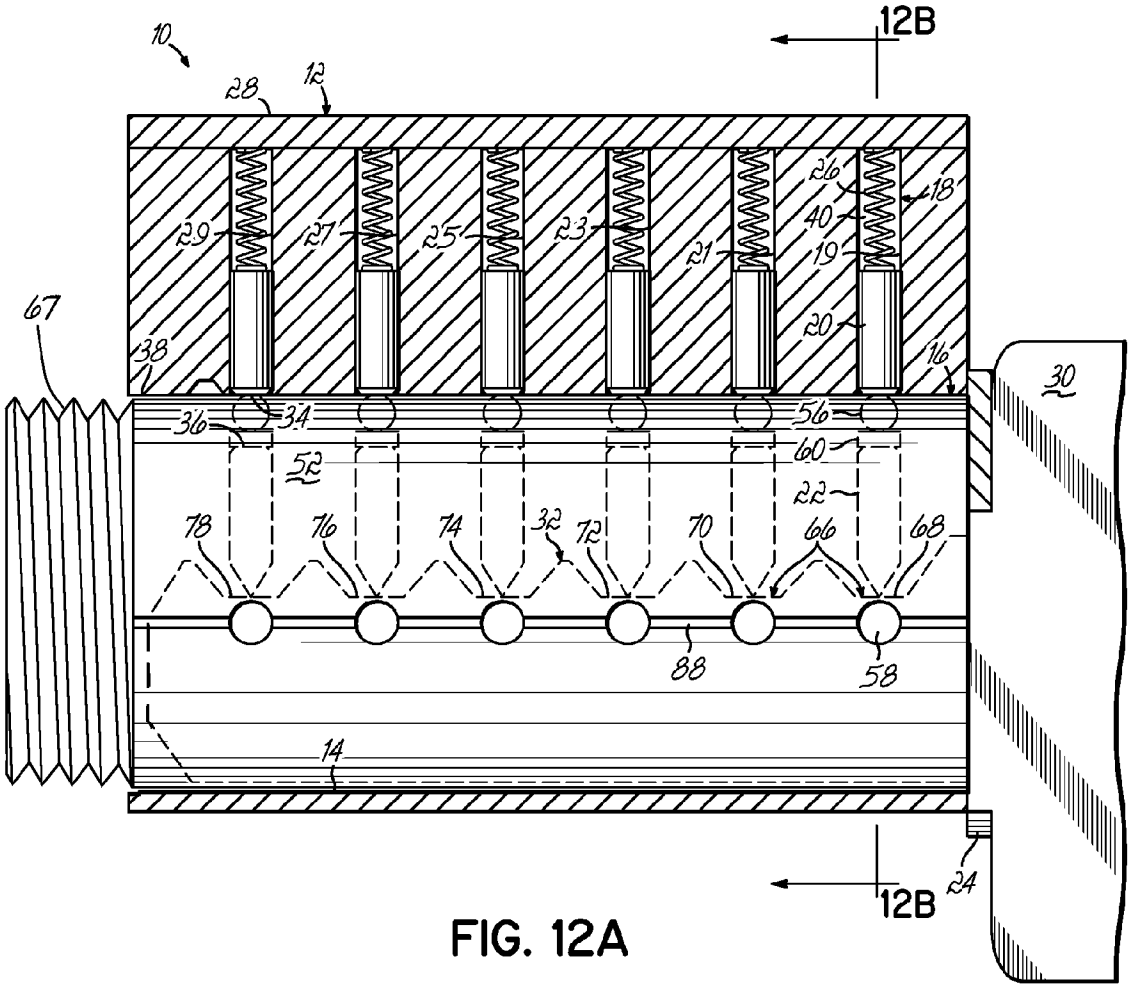
FIG. 12A is a cross-sectional view of the housing, with a side view of the plug of the lock assembly showing the plug rotated to its original position and the first key inserted in the keyway with the change tool now removed from the change slot to make the first key operable again.
Figure 13A:
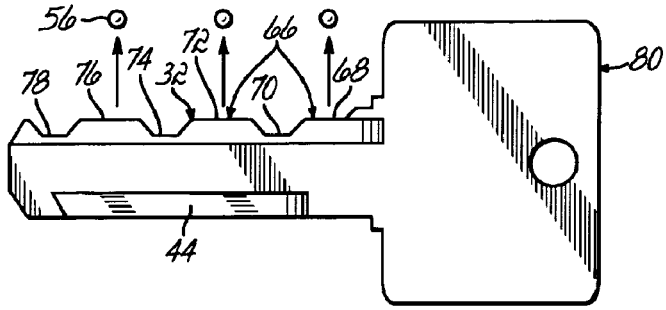
FIG. 13A is a perspective side view of a fourth key to operate the lock assembly depicting a top contour to raise certain of the change members of the lock assembly.
Figure 13B:
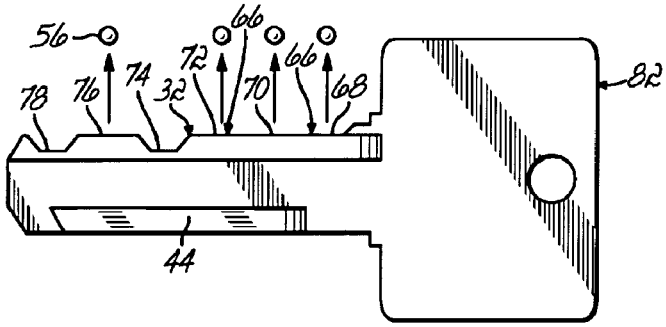
FIG. 13B is a perspective side view of a fifth key to operate the lock assembly depicting a top contour to raise certain of the change members of the lock assembly.
Figure 13C:
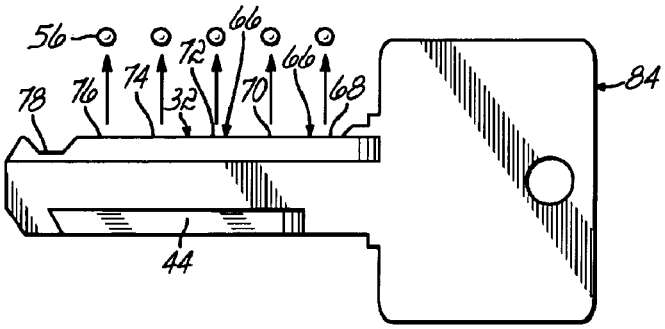
FIG. 13C is a perspective side view of a sixth key to operate the lock assembly depicting a top contour to raise certain of the change members of the lock assembly.
Figure 13D:
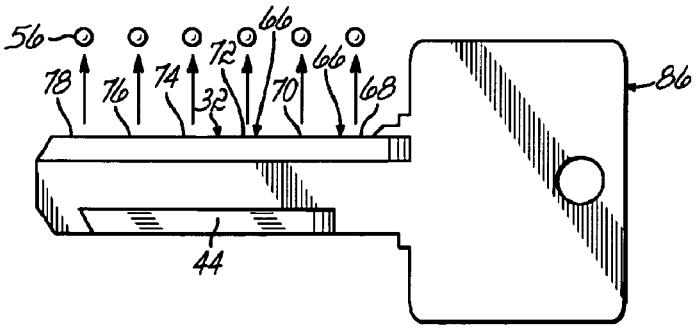
FIG. 13D is a perspective side view of a seventh key to operate the lock assembly depicting a top contour to raise certain of the change members of the lock assembly.

Referring now to FIGS. 12A and 12B, when each change ball 56 is within its respective pin chamber 18 and the plug 16 is in its first rotated position, the lock has been reset. After the third key 63 has been removed from the keyway 24, the first key 30 can be reinserted. The first key 30 cannot and does not raise any of the change balls 56 above the shear line 38 of the lock 10. Thus, the lock 10 has been reset by use of the change tool 64 to enable the first key 30 to operate the lock 10.

The embodiment of the lock 10 depicted in FIGS. 2A-12B also allows for a master key which can properly operate the lock 10 without reconfiguring the arrangement of drivers 20, tumblers 22, and change balls 56. In particular, and referring now to FIGS. 14A-15B, the illustrated embodiment includes a plurality of master shims 60, with at least one shim being disposed in each pin chamber 18 of the lock 10. These shims 60 are disposed in the pin chambers 18 beneath the change ball 56 in the stack. The master shims 60 are each sized larger (in the embodiment illustrated, of a larger diameter) than the change balls 56. The master shims 60 are also of a larger size or diameter than the openings to the retainer cavities 58, such that a master shim 60 cannot pass into a retainer cavity 58. Typically, the master shims 60 have a cylindrical diameter larger than that of the change ball 56, and of the retainer cavities 58. For the same reason, the size of the drivers 20 positioned in the driver chambers 40 are typically sized larger than the opening of the retainer cavity 58 to prevent the respective driver from entering through the opening and into the retainer cavity when the plug 16 is rotated within the housing 12 to align the retainer cavities 58 and the driver chambers, which would jamb the lock.

Figure 14B:
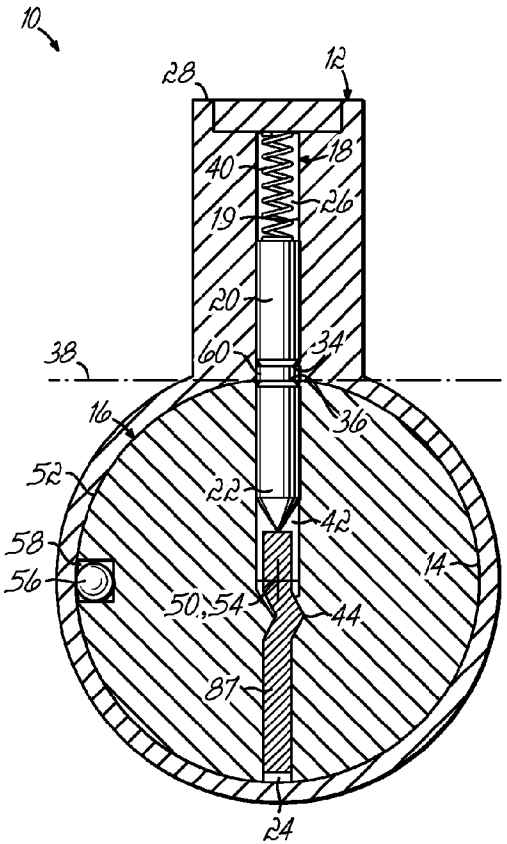
FIG. 14B is a cross-sectional view of the housing and plug taken along line 14B-14B of FIG. 14A.
Figure 14A:
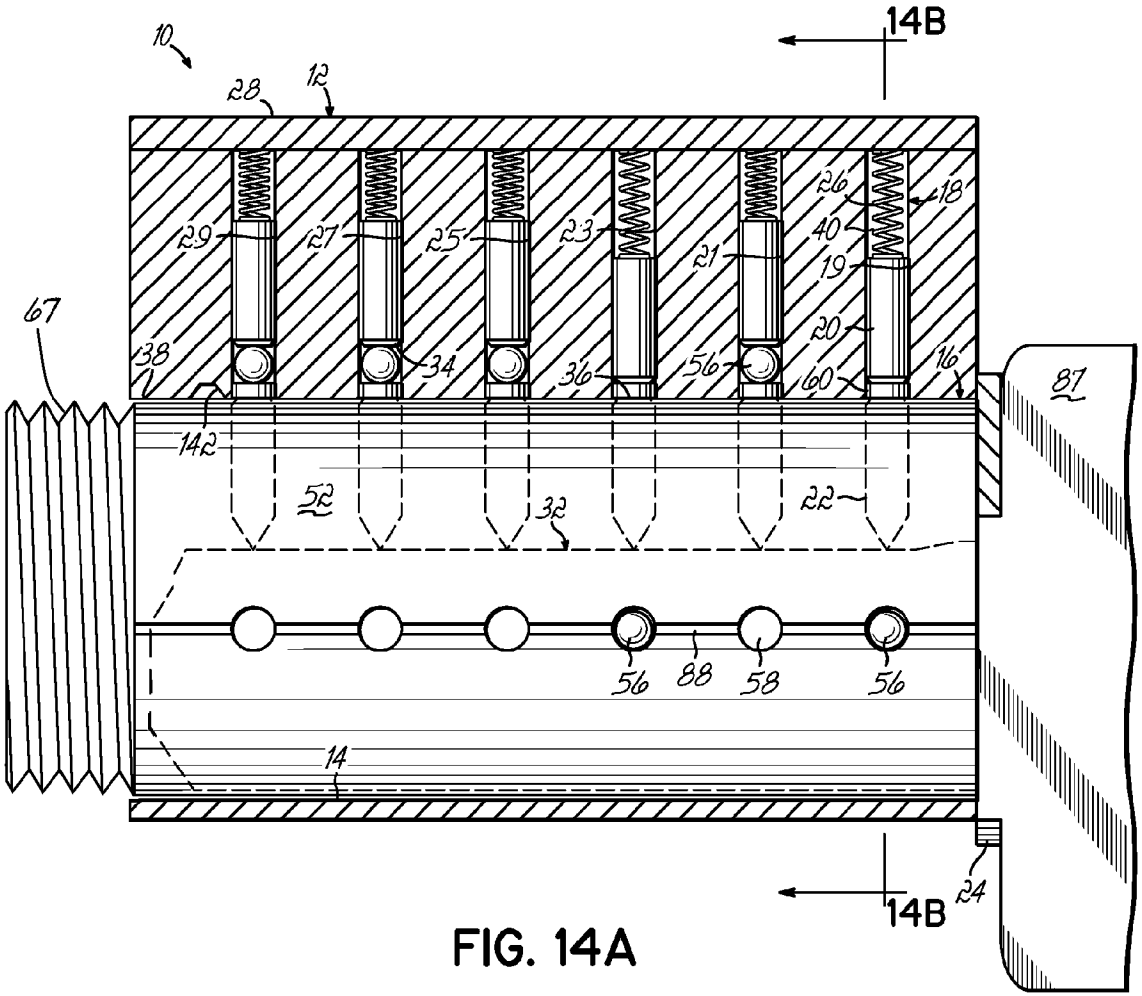
FIG. 14A is a cross-sectional view of the housing, with a side view of the plug of one embodiment of the lock assembly with a master key inserted in the keyway.
Figure 15B:
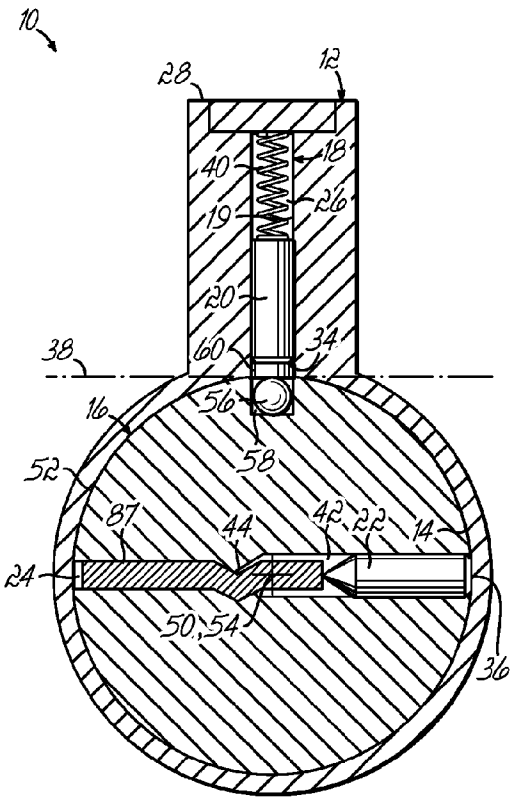
FIG. 15B is a cross-sectional view of the housing and plug taken along line 15B-15B of FIG. 15A.
Figure 15A:
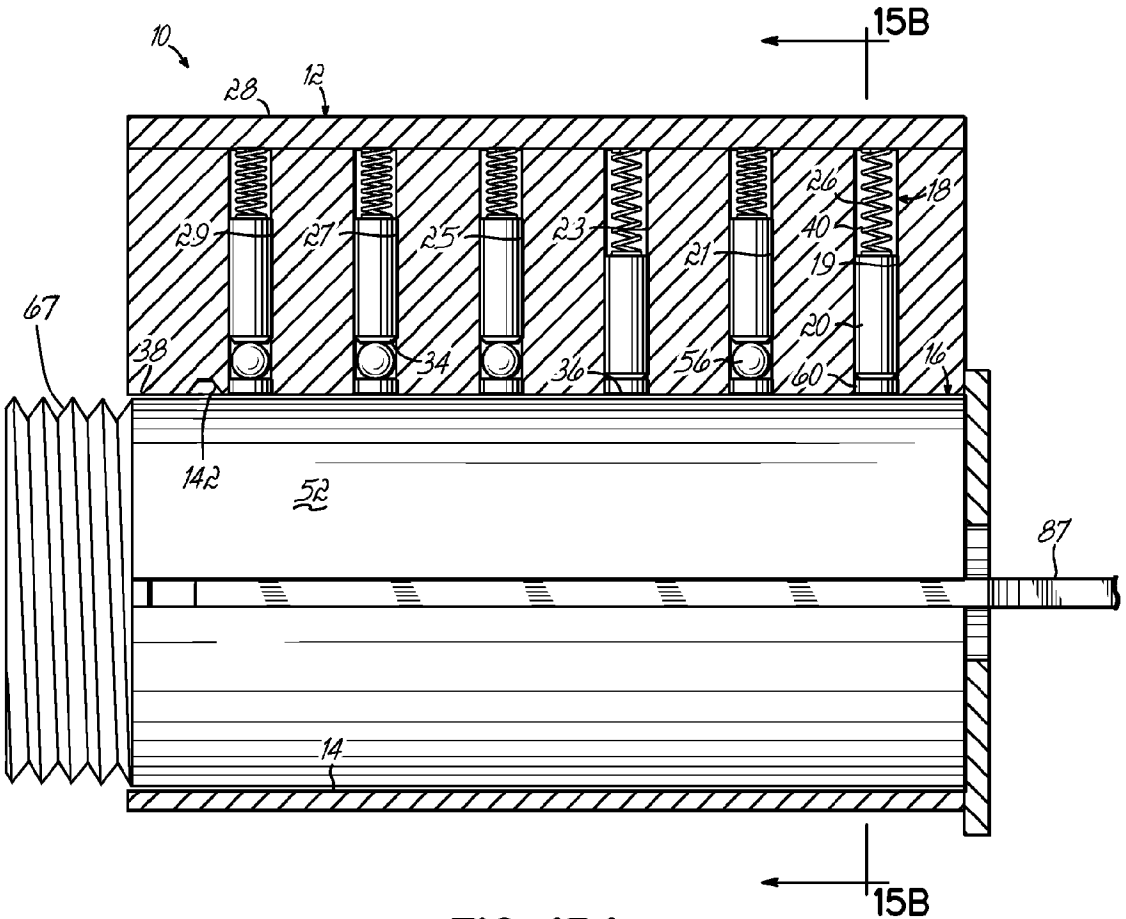
FIG. 15A is a cross-sectional view of the housing, with a side view of the plug of one embodiment of the lock assembly rotated one-quarter turn with a master key inserted in the keyway.

Referring to FIGS. 14A-14B, a master key 87 is configured such that, when inserted into the keyway 24 of the plug 16, all of the drivers 20, tumblers 22, change balls 56, and master shims 60 are raised so that the tumblers 22 lie below the shear line 38 and are disposed within the tumbler chamber 42, while each of the master shims 60 lie directly above the shear line 38 and in the driver chambers 40. Referring to FIGS. 15A-15B, when the plug 16 is then rotated one quarter turn clockwise within the housing 12, such that the retainer cavities 58 come into alignment with the driver chambers 40, a master shim 60 cannot be biased by spring force into the retainer cavities 58 because the diameter is larger than that of the opening to the retainer cavity 58. At the same time, the master shim 60, positioned between the retainer cavity 58 and the change member 56, can block the pathway of and prevent the change ball 56 from being displaced from within the driver chamber 40 into the retainer cavities 58. As such, one may operate or use a master key to open any lock 10 in a particular facility system without reconfiguring the drivers 20, tumblers 22, and change balls 56 of the lock 10.

The illustrated embodiment shown in FIGS. 2A-12B, depicts the tumblers each having the same length, which assists in illustrating the principles of operation of the invention. However, in an alternative embodiment, the length of the various tumblers in the set of tumbler chambers can differ and vary. For a given set of selected tumblers in a lock, a first key 30 will have a top edge contour 32 having contour positions that are configured, or machined, with either higher or lower contour heights, to raise the top of each change ball 56 to the shear line 38 when the first key 30 is inserted into the keyway, so that no change members are disposed in a retainer cavity. A second key 62 in this alternative embodiment has a different though complementary top edge contour 32 that is otherwise similar to the top edge contour 32 of the first key 30, except that at least one contour position 66 is raised. As the second key 62 is inserted, the additional at least one raised contour 66 on the second key 62 causes at least one change ball 56 to be raised above the shear line 38 of the lock 10 and disposed in the driver chamber 40 of the housing 12.

The subset of keys is made to accommodate the tumbler and driver combinations used in the pin chambers of the particular changeable lock. With a typical key, the height of any contour position can be cut to accommodate the height of the corresponding tumbler selected for use in each pin chamber. Generally, a longer tumbler 22 requires a lower contour cut, and a short tumbler requires a higher contour cut. When cutting the key contour positions, the landing width of the position should be sufficiently wide to prevent a tumbler from beginning to descend prematurely off the end of the contour landing in any one of the pin chambers if the key is withdrawn slightly from the keyway.

A second embodiment of the invention is depicted in FIGS. 16A-22N wherein like numbers designate like components. The second embodiment illustrates the use of a change tool 64 for reconfiguring the drivers 20, tumblers 22, and change balls 56 of the lock 10. This embodiment can expand the number of keys in a particular subset of user keys compared to the first embodiment. Instead of moving additional change balls 56 from the pin chambers 18 into the retainer cavities 58 as one progresses through a subset of user keys, as described in the first embodiment, the second embodiment enables one to move change balls 56 back and forth between the first position in the pin chambers 18 and the second position in the retainer cavities 58. Typically, the movement of change balls 56 to and from the retainer cavities 58 and the pin chambers 18 permits the reconfiguration of the lock to operate with a different user key of the subset of user keys. The movement of the change balls to and from also typically involves, at some point in the process, a resetting of the lock, wherein all the change members are returned back into their respective pin chambers. The lock is in a reset configuration when all the change members 56 are in the pin chambers, with an authorized or an operable user key inserted in the keyway, or with no key inserted. The contour locations 66 used in this second embodiment also prevent the "automatic" change described above for the first embodiment with respect to FIGS. 2A-12B, as explained in greater detail below.

Figure 16B:
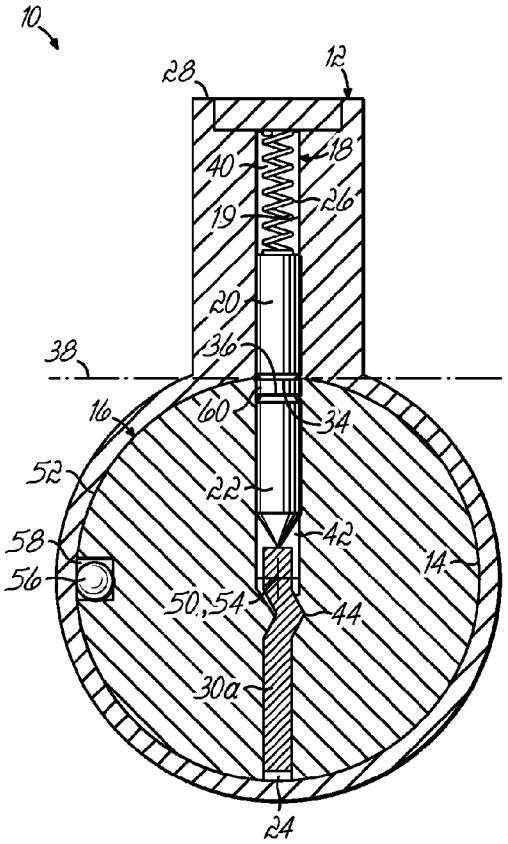
FIG. 16B is a cross-sectional view of the housing and plug taken along line 16B-16B of FIG. 16A.
Figure 16A:
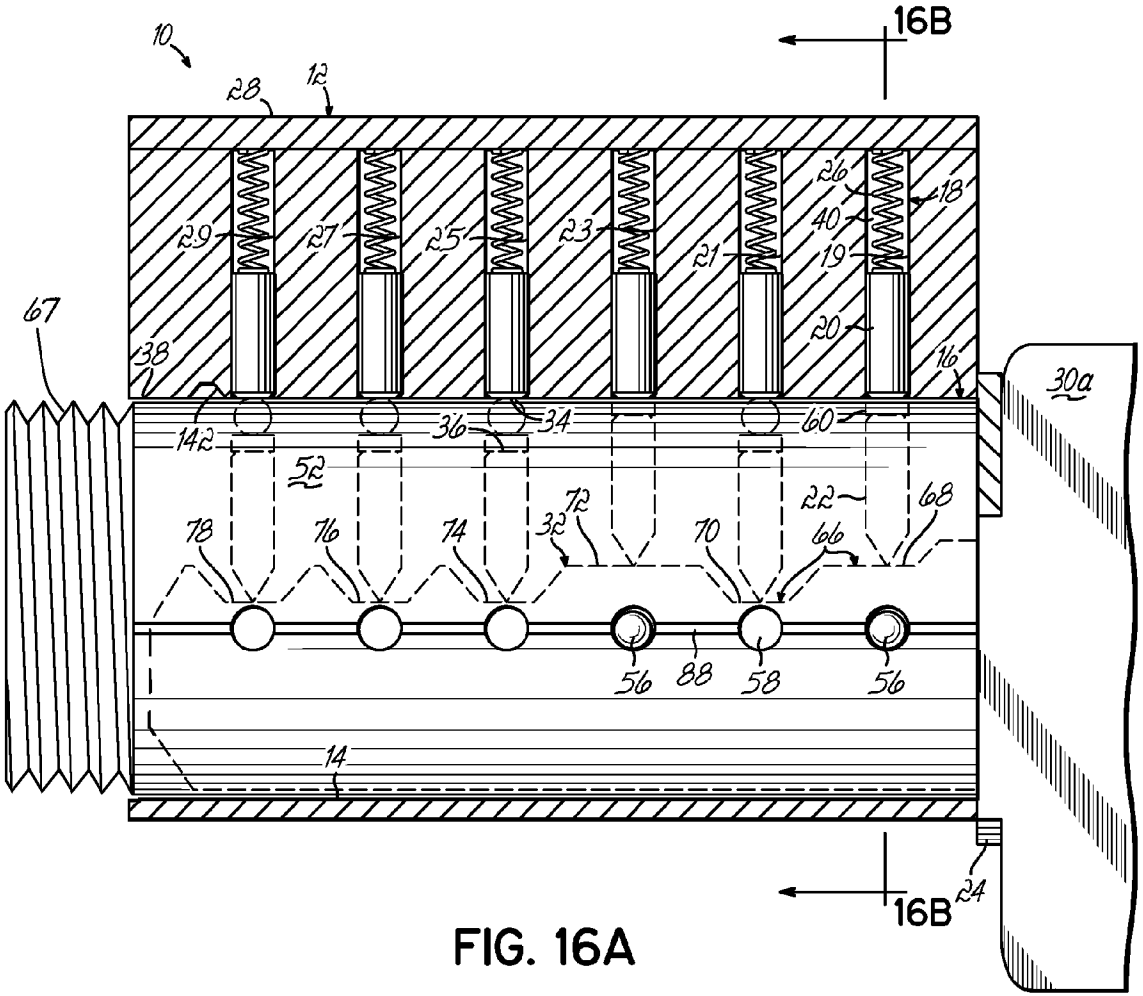
FIG. 16A shows a second embodiment of a lock assembly, showing a cross-sectional view of the housing, with a side view of the plug, depicting a series of change members and retainer cavities when a first operable key is inserted in the keyway.

FIG. 16A shows that a first key 30*a* has raised first and third contour locations 68, 72, while the remaining contour locations 70, 74, 76, 78 are lowered. Upon a first use of the first key 30*a* after the lock has been reset, the change balls 56 in the first and third pin chambers 19, 23 will be raised above the shear line 38 and, upon rotation of the plug, deposited or displaced into the second position in their respective retainer cavities 58, as shown in FIGS. 16A and 16B.

The lock 10 may be reset to operate with a second key 62*a* in the key set through the use of the change tool 64. In order to effect this change, the plug 16 includes a second passage, shown as change slot 88. The change slot 88 is configured in the plug 16 in a direction parallel to the longitudinal axis 54, and is positioned to intersect each of the retainer cavities 58. When the plug 16 is rotated to align the retainer cavities 58 with the driver chambers 40, and the change tool 64 is inserted in the change slot 88, any change balls 56 disposed in the retainer cavities 58 are displaced out of the retainer cavities 58 and into the driver chambers 40 in the housing 12. This facilitates the return of the change balls 56 to the stack of drivers 20 and tumblers 22, and the resetting of the lock 10.

Figure 18B:
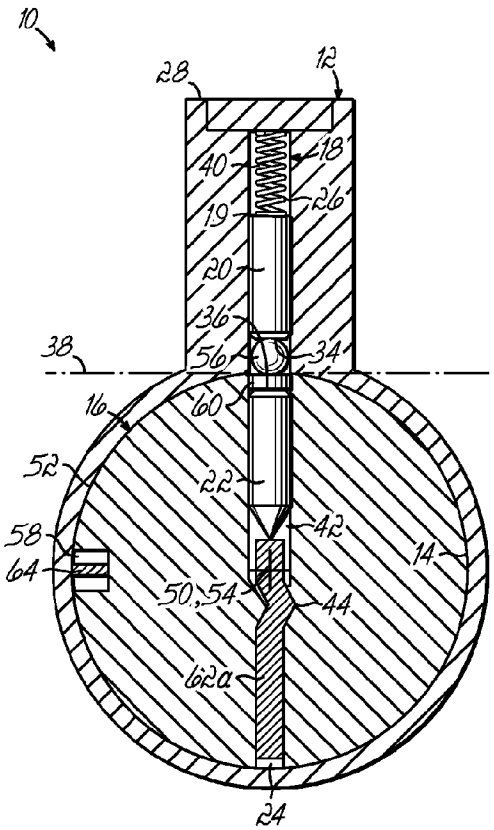
FIG. 18B is a cross-sectional view of the housing and plug taken along line 18B-18B of FIG. 18A.
Figure 18A:
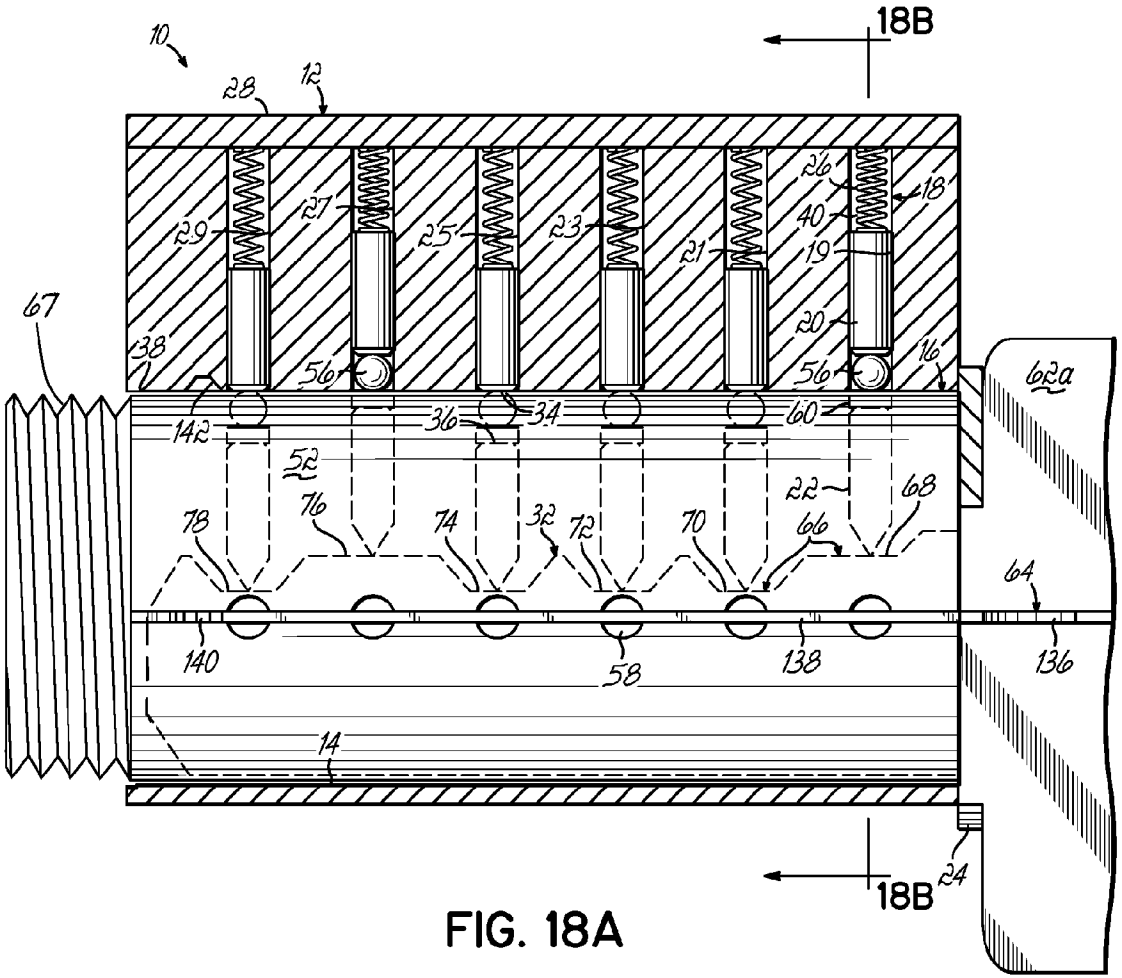
FIG. 18A is a cross-sectional view of the housing, with a side view of the plug of the lock assembly showing the plug rotated to an original position with a second key inserted in the keyway and the change tool still inserted in the change slot.

The method of using the lock 10 of this embodiment of the present invention provides a means for rapidly changing the internal configuration of the drivers, tumblers and change members of the lock to reconfigure the lock to operate exclusively with one of many different keys in a set of keys. The method of using the rapid change lock does not require disassembly, or removal of the plug from the housing. The method involves inserting a first key 30*a* into the longitudinal keyway 24 of a lock 10 that is programmed or configured to operate with the first key 30*a*. This first key 30*a* then can be used to rotate the plug 16 within the housing 12. After the plug 16 is rotated one-quarter turn clockwise(that is, about 90.degree. in the illustrated embodiment) to bring the change slot 88 into alignment with the driver chambers 40, the change tool 64 can be inserted into the change slot 88, forcing any change balls 56 disposed in the retainer cavities 58 into the driver chambers 40. With the change tool 64 in the inserted position, the plug 16 is then rotated back one-quarter turn counter-clockwise to its original position. The first key 30*a* is then removed from the keyway 24. Removal of the first key 30*a* from the keyway allows the driver springs 26 disposed above the drivers 20 force any change balls 56 from the driver chambers 40 into the tumbler chambers. This resets the lock, or said another way, places the lock into a reset configuration. A second key 62*a* is then inserted. The second key 62*a* has a different though complementary top edge contour 32 to the first key 32*a*; that is, it is otherwise similar to the top edge contour 32 of the first key 30*a* except that a different two of the contour positions 66 are raised. When key 62*a* is inserted, at least two change balls 56 are raised above the shear line 38 and are disposed in the driver chambers 40 of the housing 12 as shown in FIGS. 18A and 18B. As the second key 62*a* and plug 16 are rotated onequarter turn clockwise, the retainer cavities 58 will come into alignment with the driver chambers 40 of the housing 12. The change tool 64 is then removed from the change slot 88, whereby the driver springs 26 disposed above the drivers 20 force the change balls 56 located above the shear line 38 down into the corresponding retainer cavities 58. As the second key 62*a* is rotated along with the plug 16 back to its original position (see FIGS. 20A and 20B), the disposed change balls 56 remain deposited in the retainer cavities 58, offset from the pin chambers 18, thereby reconfiguring the lock to operate with the second key 62*a*.

The illustrated second embodiment will now be described in additional detail. In FIGS. 16A and 16B, the lock 10 of the second embodiment is depicted with the first key 30*a* inserted into the keyway 24 and with the first and third change balls 56 disposed in the respective retainer cavities 58. The first key 30*a* can operate the lock 10 since its insertion causes none of the driver or tumbler members of any of the pin chambers 18 or any of the change balls 56, to span the shear line 38. The first key 30*a* has a top edge contour 32 having first and third contour locations 68, 72 in a raised position, and with the remaining four contour locations 70, 74, 76, 78, in a lowered position. The FIGS. show that the lowered contour locations 70, 74, 76, 78 keep the change balls 56 disposed within their respective tumbler chambers 42 when the first key 30*a* is inserted. The raised first and third contour locations 68, 72 lift the drivers 20 and tumblers 22 such that the lower ends 34 of the drivers 20 are positioned along the shear line 38 with the drivers 20 disposed entirely in the first and third driver chambers 40. The change balls 56 associated with the first and third pin chambers 19, 23 have been displaced into and are disposed in the corresponding retainer cavities 58 in the plug 16.

Figure 17B:
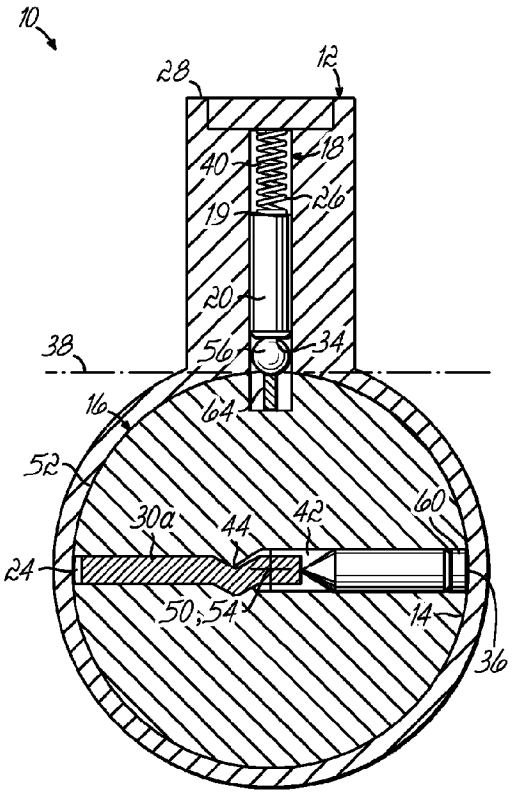
FIG. 17B is a cross-sectional view of the housing and plug taken along line 17B-17B of FIG. 17A.
Figure 17A:
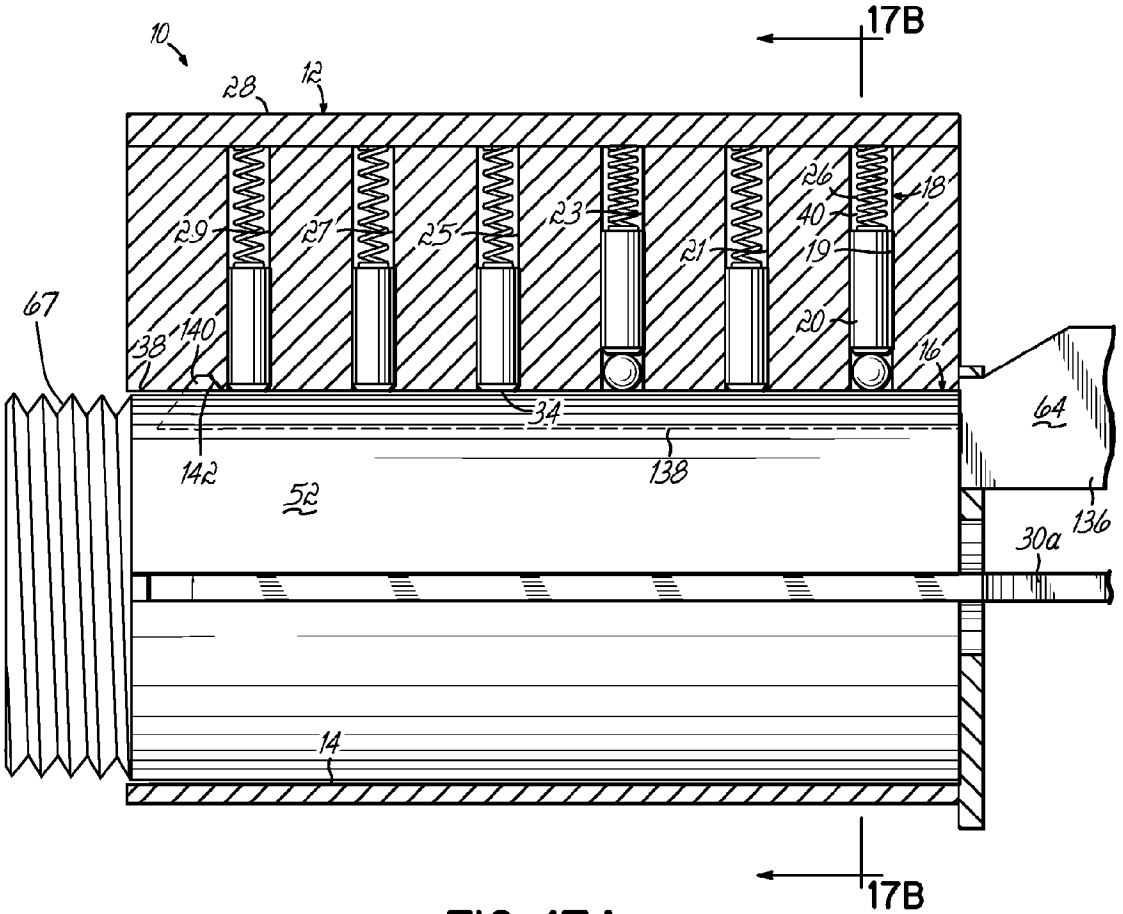
FIG. 17A is a cross-sectional view of the housing, with a side view of the plug of the lock assembly showing the first key inserted in the keyway and the plug rotated one-quarter turn with a change tool inserted in a change slot.

Referring now to FIGS. 17A-21B, the lock 10 can be reset and reconfigured to accept a second key 62*a*, without disassembling the lock 10. In FIGS. 17A and 17B, the lock 10 is shown with the first key 30*a* inserted and the plug 16 rotated one-quarter turn clockwise to bring the retainer cavities 58 into alignment with the driver chambers 40. The change tool 64 is inserted into the change slot 88, causing change balls 56 to be displaced out of the retainer cavities 58 and into the driver chambers 40 associated with the first and third pin chambers 19, 23.

With the change tool 64 still inserted in the change slot 88, the plug 16 is rotated back one-quarter turn counter-clockwise to the original position. The change balls 56 remain disposed in the driver chambers 40 in the housing 12 as the plug 16 is rotated back to its original position. Referring now to FIGS. 18A and 18B, the first key 30*a* has been removed from the lock 10 and a second key 62*a* has been inserted. The second key 62*a*, as seen in the illustrated embodiment, has raised first and fifth contour locations 68, 76, which raise the change balls 56 in the first and fifth positions (corresponding to pin chambers 19, 27) above the shear line 38.

Figure 19B:
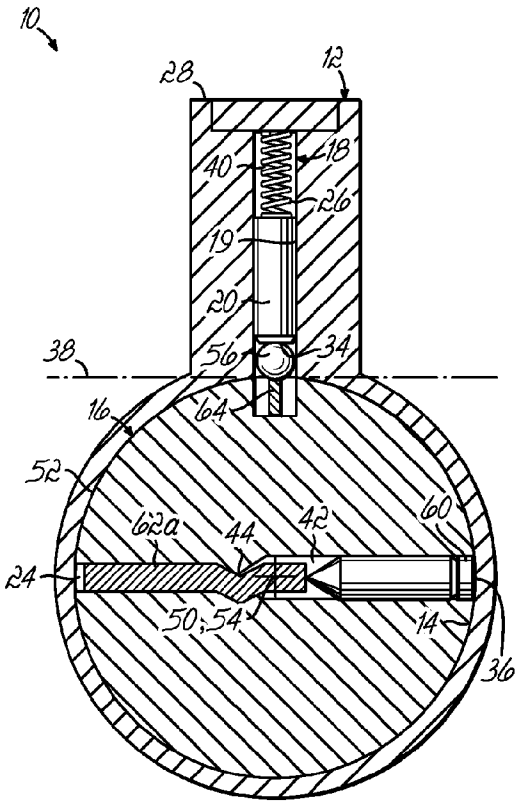
FIG. 19B is a cross-sectional view of the housing and plug taken along line 19B-19B of FIG. 19A.
Figure 19A:
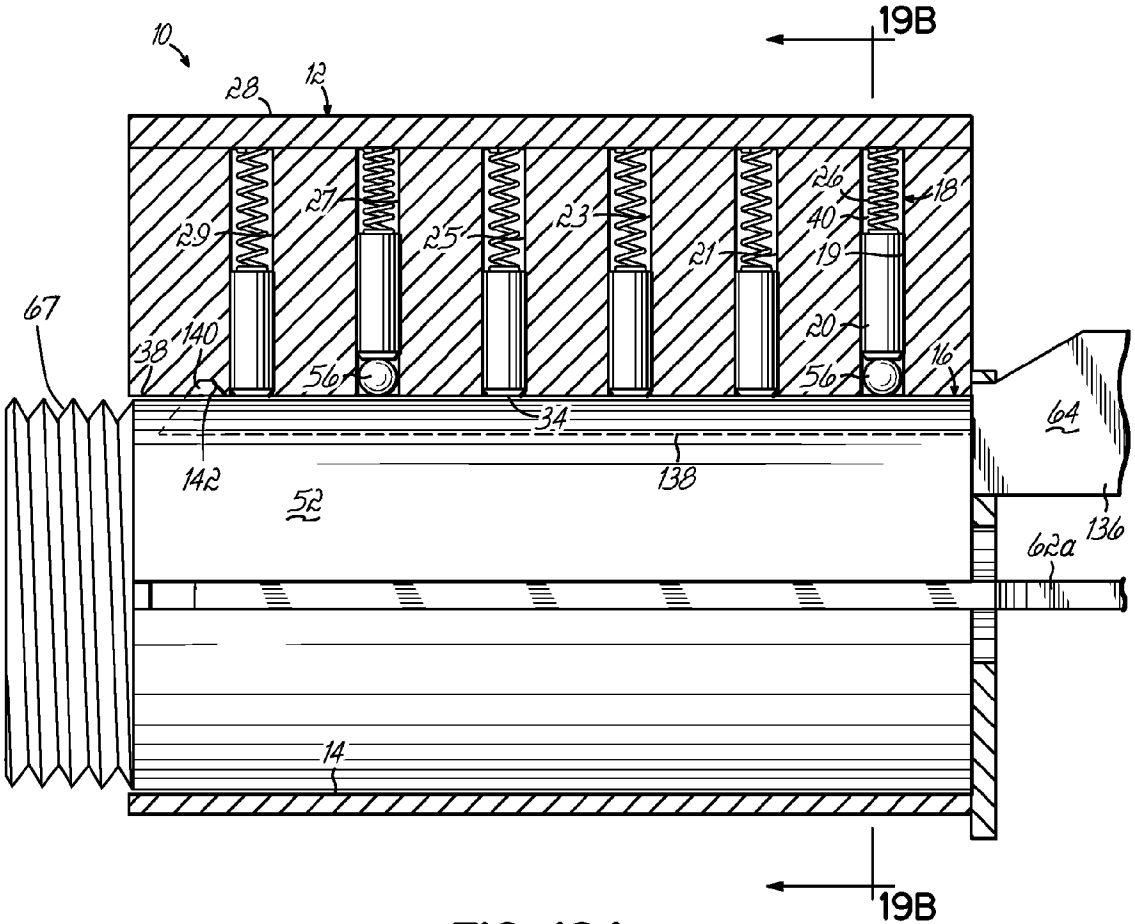
FIG. 19A is a cross-sectional view of the housing, with a side view of the plug of the lock assembly showing the second key inserted in the keyway and the plug rotated one-quarter turn with the change tool inserted in the change slot.
Figure 20B:
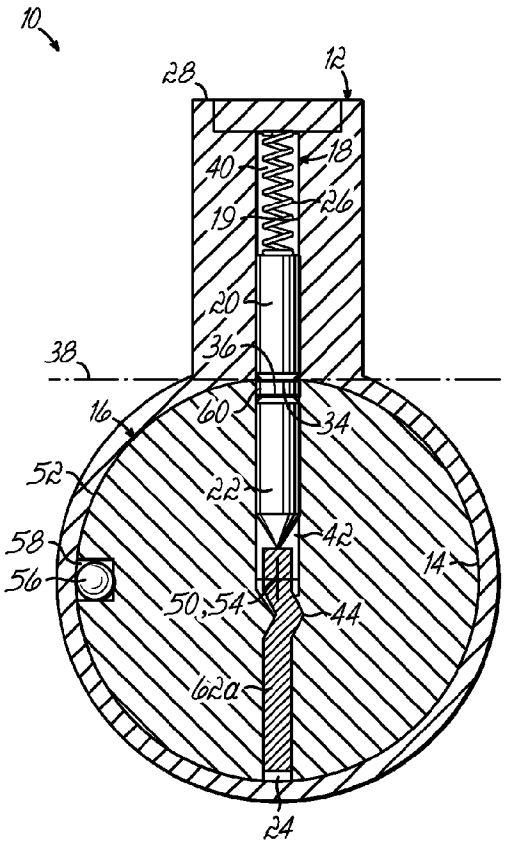
FIG. 20B is a cross-sectional view of the housing and plug taken along line 20B-20B of FIG. 20A.
Figure 20A:
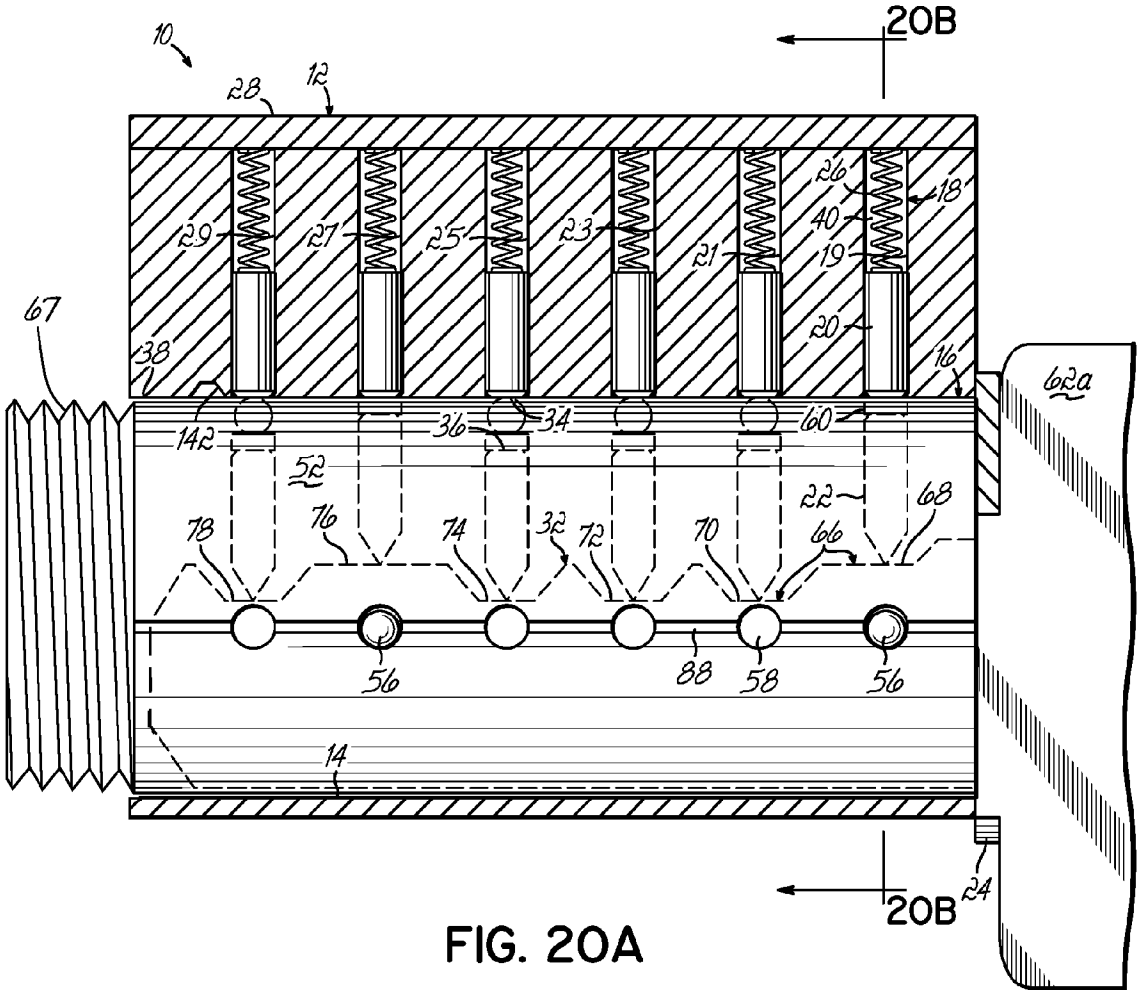
FIG. 20A is a cross-sectional view of the housing, with a side view of the plug of the lock assembly showing the plug rotated to its original position with the second key inserted in the keyway and the change tool now removed from the change slot.
Figure 21B:
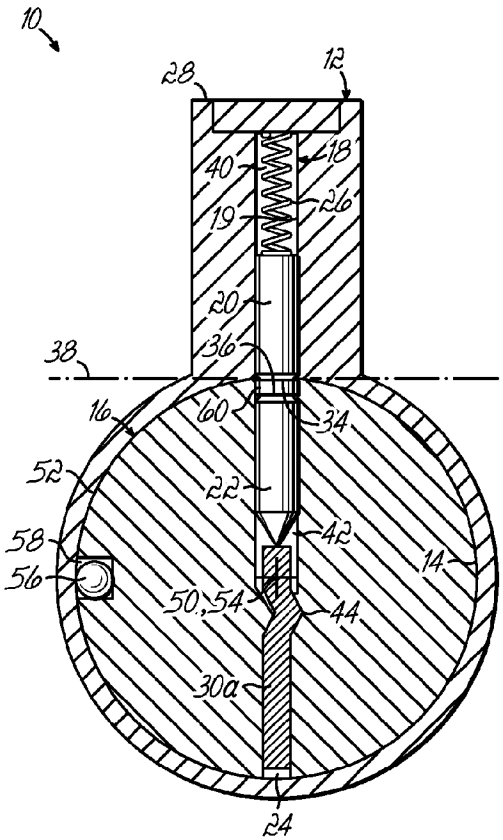
FIG. 21B is a cross-sectional view of the housing and plug taken along line 21B-21B of FIG. 21A.
Figure 21A:
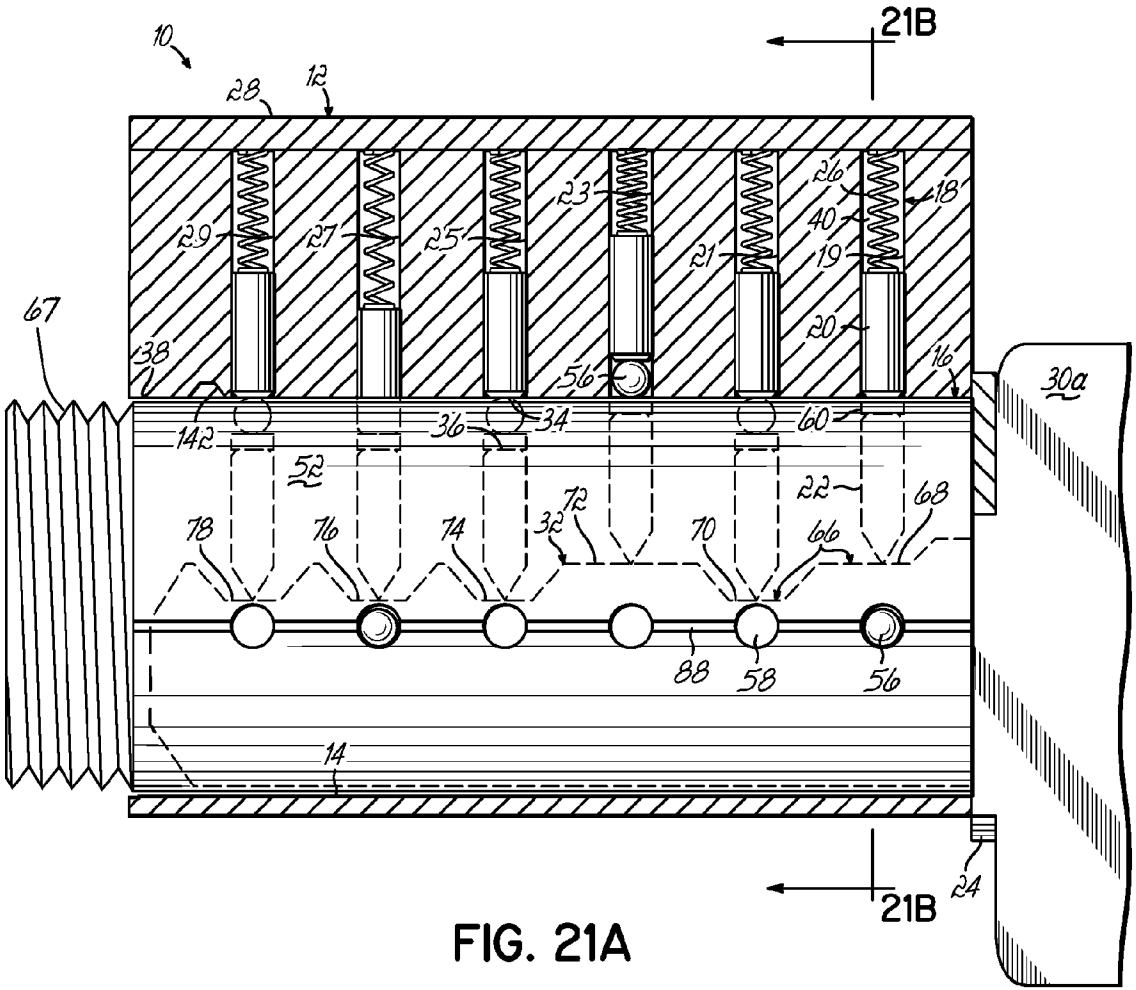
FIG. 21A is a cross-sectional view of the housing, with a side view of the plug of the lock assembly showing the second key removed from the keyway and a first key, now inoperable, inserted in the keyway.

Referring now to FIGS. 19A and 19B, the plug 16 with second key 62*a* inserted is then rotated one-quarter turn clockwise to bring the change slot 88 into alignment with the driver chambers 40. The change tool 64 is then removed from the change slot 88, allowing the driver springs 26 disposed above the drivers 20 in the first and fifth positions to force the respective change balls 56 into the retainer cavities 58. When the second key 62*a* is then rotated back to the original position, shown in FIGS. 20A-20B, the lock 10 has been reset and reconfigured to enable the second key 62*a* to operate the lock 10. FIGS. 21A and 21B show that the first key 30*a* cannot operate the lock since the driver 20 of the fifth pin chamber 27 will span the shear line 38 and prevent rotation of the plug 16.

Figure 22A:
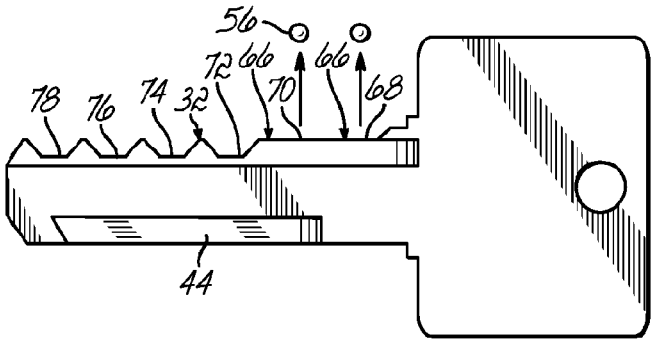
FIG. 22A is a perspective side view of a third key to operate the lock assembly depicting a top contour to raise certain of the change members.
Figure 22B:
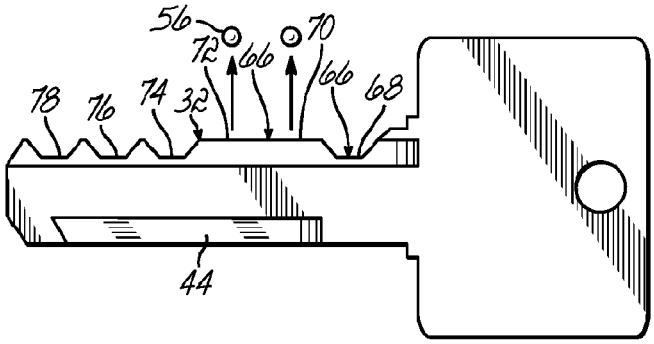
FIG. 22B is a perspective side view of a fourth key to operate the lock assembly depicting a top contour to raise certain of the change members.
Figure 22C:
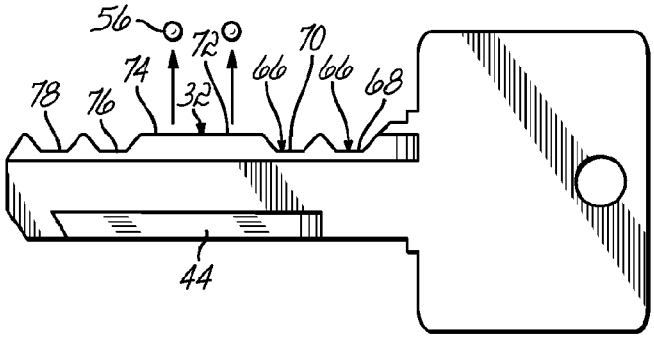
FIG. 22C is a perspective side view of a fifth key to operate the lock assembly depicting a top contour to raise certain of the change members.
Figure 22D:
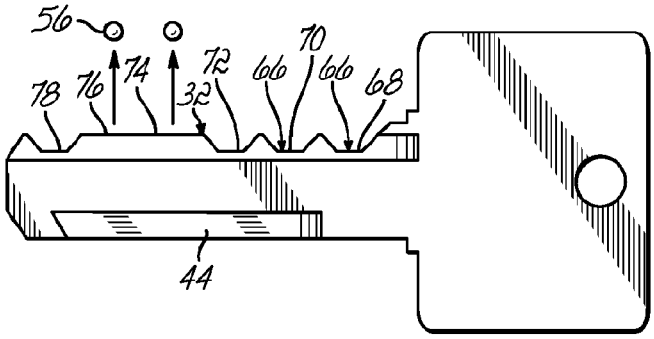
FIG. 22D is a perspective side view of a sixth key to operate the lock assembly depicting a top contour to raise certain of the change members.
Figure 22E:
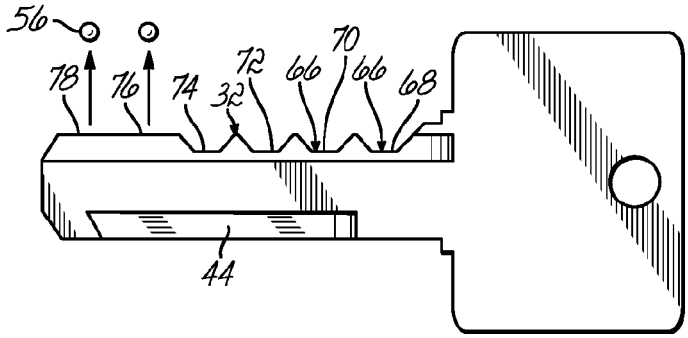
FIG. 22E is a perspective side view of a seventh key to operate the lock assembly depicting a top contour to raise certain of the change members.
Figure 22F:
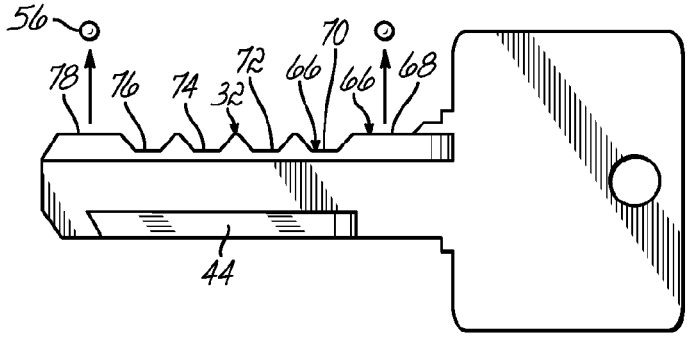
FIG. 22F is a perspective side view of an eighth key to operate the lock assembly depicting a top contour to raise certain of the change members.
Figure 22G:
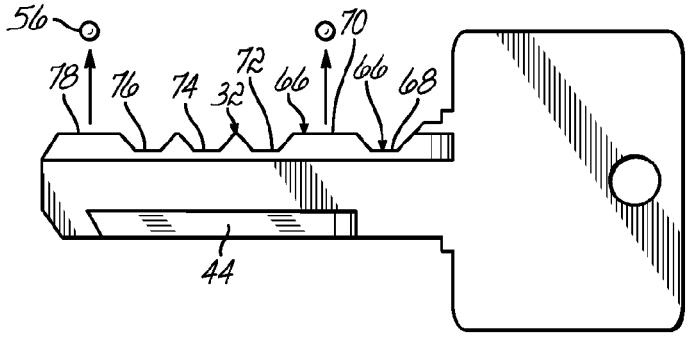
FIG. 22G is a perspective side view of a ninth key to operate the lock assembly depicting a top contour to raise certain of the change members.
Figure 22H:
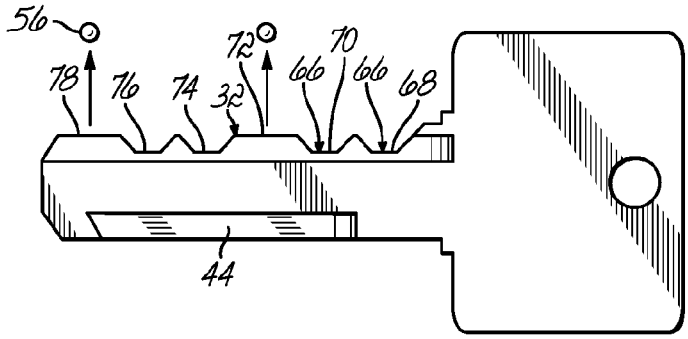
FIG. 22H is a perspective side view of a tenth key to operate the lock assembly depicting a top contour to raise certain of the change members.
Figure 22J:
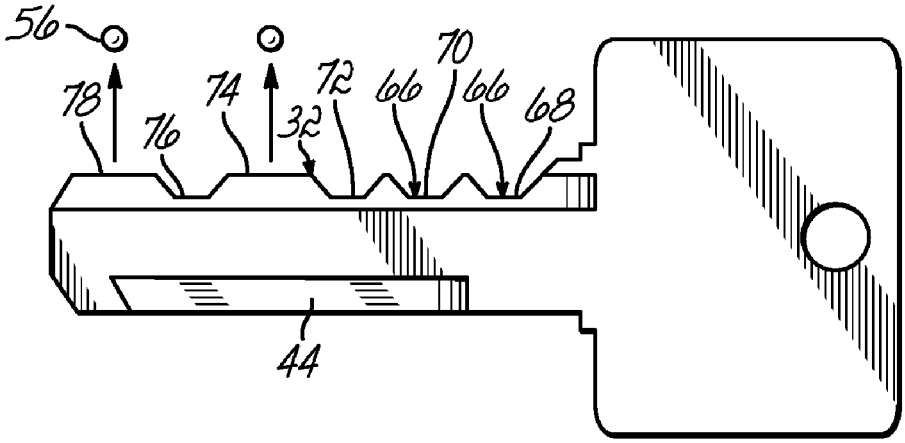
FIG. 22J is a perspective side view of an eleventh key to operate the lock assembly depicting a top contour to raise certain of the change members.
Figure 22K:
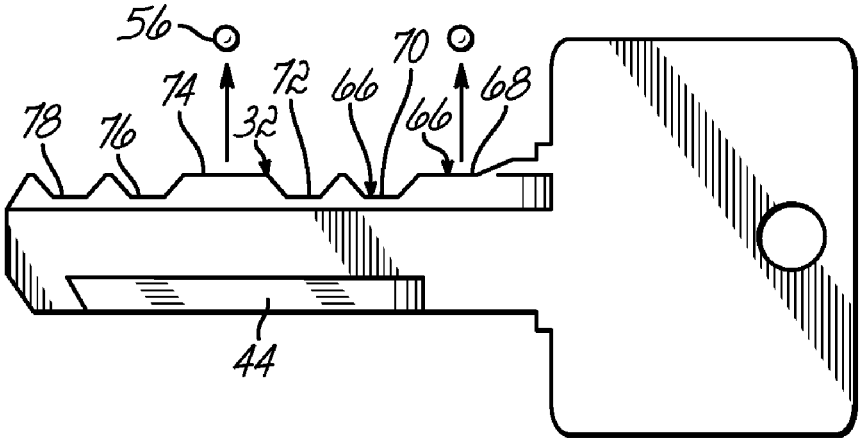
FIG. 22K is a perspective side view of a twelfth key to operate the lock assembly depicting a top contour to raise certain of the change members.
Figure 22L:
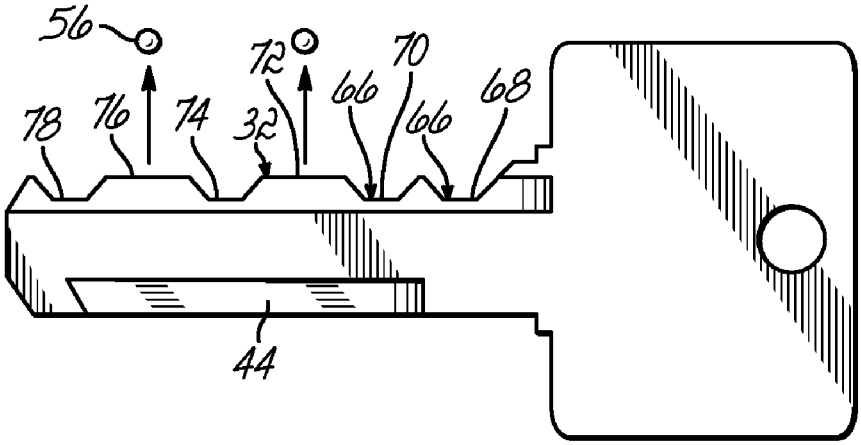
FIG. 22L is a perspective side view of a thirteenth key to operate the lock assembly depicting a top contour to raise certain of the change members.
Figure 22M:
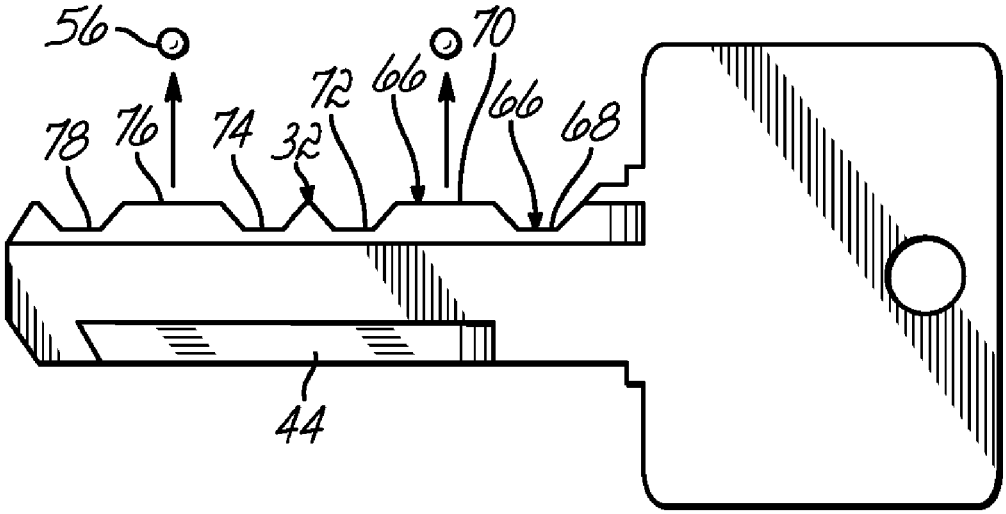
FIG. 22M is a perspective side view of a fourteenth key to operate the lock assembly depicting a top contour to raise certain of the change members.
Figure 22N:
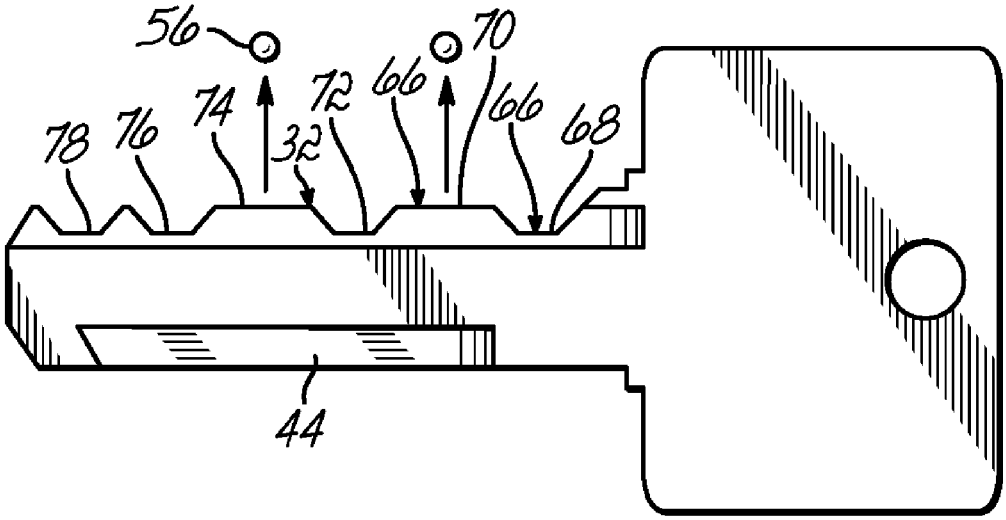
FIG. 22N is a perspective side view of a fifteenth key to operate the lock assembly depicting a top contour to raise certain of the change members.

FIGS. 22A-22N show various other keys of the subset of keys that can operate the second embodiment of the lock of the present invention. Each of the keys in FIGS. 22A-22N is configured to raise only two of the change balls above the shear line 38 of the lock 10. All of the keys are unique. That is, the keys are configured whereby the any two raised contour locations 66 are staggered, such that no two keys exhibit the same staggered pattern of two raised contour locations 66. This configuration prevents the lock 10 from being automatically changed without employing a change tool 64, as is the case with the first embodiment of the lock 10. It can be recognized that a key will not operate in a lock 10 when a lowered contour location 66 is present on the key in a position corresponding to a pin chamber 18 in which a change ball 56 has been displaced into its second position in a retainer cavity 58. When a lowered contour location 66 registers with a change ball 56 in its second position in its respective retainer cavity, the driver 20 in the corresponding pin chamber 18 will span across the shear line 38 of the lock 10, and the plug 16 cannot rotate. By staggering two high contour locations 66 on the key, as shown with the subset of keys in FIGS. 22A-22N, it is always assured that, for any key that is used with the exception of the operable key, a lowered contour location 66 will associate or register with a pin chamber 18 that has its change ball 56 displaced to the retainer cavity 58. This can be seen more particularly with reference to FIGS. 20A and 21 A. In FIG. 20A, the second key 62*a* which is operable is inserted into the lock 10. This second key 62*a* has raised first and fifth contour locations 68, 76. The change balls 56 corresponding to those first and fifth contour locations 68, 76 have been displaced into corresponding retainer cavities 58. No driver or tumbler member in the pin chambers 18 spans the shear line 38 of the lock 10. This second key 62*a* can operable the lock by rotating the plug 16 within the housing. In FIG. 21A, the second key 62*a* has been removed and the first key 30*a* is inserted. First key 30*a* has at least one lowered contour location 66 corresponding to a pin chamber 18 having a change ball 56 that has been displaced into a retainer cavity 58. In particular, the fifth contour location 76 is lowered, and registers with the fifth pin chamber 27 where the change ball 56 has been displaced into its corresponding retainer cavity 58. The first key 30*a* cannot raise the driver 20 and tumbler 22 in the fifth pin chamber 27 high enough, causing that driver 20 to span the shear line 38. As such, the first key 30*a* cannot operate the reconfigured lock 10 shown in FIG. 21.

The illustrated embodiment shown in FIGS. 16A-22N depicts the tumblers each having the same length, which assists in illustrating the principles of operation of the invention. However, in an alternative embodiment, the length of the various tumblers in the set of tumbler chambers can differ and vary. For a given set of selected tumblers in a lock, a first key 30*a* will have a top edge contour 32 having contour positions that are configured, or machined, with either higher or lower contour heights, to raise the top edge 36 of any two tumblers 22 to the shear line 38 when the first key 30*a* is inserted into the keyway. The two contour positions corresponding to the two tumblers 22 are configured to raise and displace two change members into the respective retainer cavities. A second key 62*a* in this embodiment will have a different though complementary top edge contour 32 that is otherwise similar to the top edge contour 32 of the first key 30*a*, except that a different pair of two contour positions 66 are configured to raise and displace the corresponding two change members 56 into the respective retainer cavities 58.

In another alternative of the second embodiment of the invention, the subset of keys can be configured so that each user key in the subset can raise four of the change balls above the shear line 38 of the lock 10 when inserted into the keyway 24. Each user key of the subset of user keys is configured with four raised contour locations 66, wherein no two keys exhibit the same staggered pattern of four raised contour locations 66. The maximum number of keys in the four-raised-contour subset is the same as that number for the two-raised-contour subset of keys described herein before. The four-raised-contour key has an added advantage of reducing the possibility of "incidental keying". This situation can occur when a lock is opened with a key from outside the subset of keys having one or more contour positions with a slightly different height. The slightly different contour height can cause the centerline of a change ball to be unintentionally raised above the shear line 38 when that key is inserted into the keyway. When the centerline of a change ball is just slightly above the shear line, the rotation of the plug within the bore of the housing will force the change ball into the driver chamber, from where it is then deposited into the retainer cavity upon rotation of the plug. When the legitimate user key is inserted into the lock, the absence of the unintentionally-displaced change ball in the pin chamber prevents the key from raising the driver 20 above the shear line, thus rendering the legitimate key inoperable.

In yet another alternative of the second embodiment, the subset of operable keys can be configured so that the individual user keys raise different numbers of the change balls above the shear line of the lock upon insertion into the keyway and rotation of the plug. In this alternative embodiment, each key in the subset must be configured to avoid allowing any one key from having all of the raised contour positions of any other key in the subset, since having such would enable the former key to change automatically the configuration of the lock that is operated by the latter key without requiring use of the change tool. Using a subset of keys that can raise different number of change balls typically limits the total number of keys in the subset of keys requiring a change tool. For example, a six-chamber lock with a subset of keys that can raise some combination of two change members, three change members, or four change members, is typically limited to less than 10 possible combinations. By comparison, a six-chamber lock with a subset of keys that only have two raised contour positions to move two change members, or only have four raised contour positions to move four change members, has 15 possible combinations, and a six-chamber lock with a subset of keys that only moves three change members has 10 possible combinations.

To lock out all user keys of the subset from operating the lock 10, an operator may have a "lockout" key having all contour locations 66 raised (shown as key 86 in FIG. 13D) or at least having each contour location 66 raised where any one of the subset of user keys has a raised contour. Use of the lockout key (which can also be termed a programming or configuration key) would raise any remaining change balls 56 above the shear line 38 upon insertion into the keyway, regardless of which user key could previously operate the lock. By simply rotating this lockout key one-quarter turn clockwise (in the illustrated embodiment), such that the retainer cavities 58 come into alignment with the driver chambers 40 of the housing, any and all change balls 56 are forced by spring 26 from the driver chambers 40 down into the retainer cavities 58. This renders the lock 10 operable only for the "lockout" key. If an operator tried to use any other user key of the subset, the lowered contour locations 66 would not raise one or more of the drivers 20 sufficiently high enough, causing that driver 20 to span the shear line 38.

Figure 42:
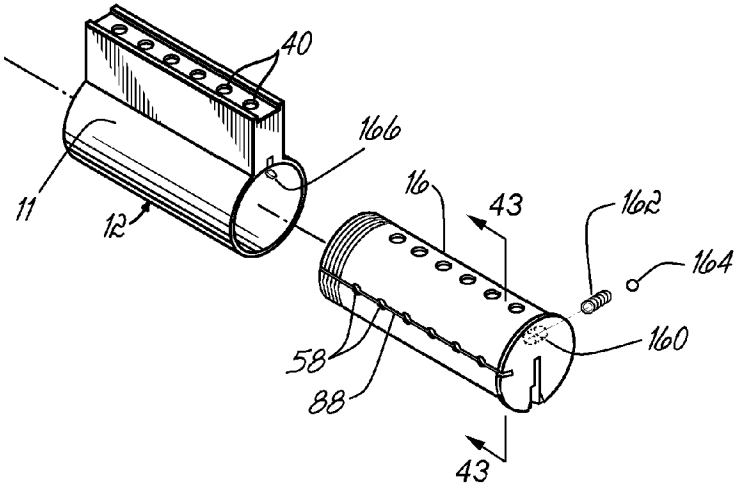
FIG. 42 shows a perspective, disassembled view of the components of an embodiment of the lock assembly of the present invention having a plug positioning means.

In a preferred embodiment, the lock is provided with a means for signaling to the user that the key and plug are in the first rotated position (or the key insertion position). A typical plug positioning means is a detent and pin. As shown in FIG. 42, the periphery of the plug 16 is provided with a first detent cavity 160, typically a rounded or cylindrical hole. A detent pin, shown as a detent ball 164, is disposed in the first detent cavity 160, and is biased radially outward toward the shear line or periphery of the plug by a biasing means, shown as a detent spring 162. A second detent cavity 166 is disposed in the inner surface of the bore 14 of the cylindrical portion 11 of housing 12, and is shown in FIG. 42 as a hole formed in the cylindrical portion 11 of the housing 12. The detent means is configured such that the first detent cavity 160 and the second detent cavity 166 align and register with one another when the tumbler chambers in the plug 16 are aligned with the drive chambers 40 of the housing 12. The second detent cavity 166 has a size or diameter less than the size or diameter of the detent ball 164, such that when the first and second detent cavities are aligned, the detent ball is retained substantially within the first detent cavity 160. Typically, the first detent cavity 160 is formed on the side of the plug 16 opposite the retainer cavities 58. The first detent cavity 160 is also typically disposed in the plug 16 longitudinally displaced from any of the retainer cavities 58. This ensures that the first detent cavity 160 cannot register or align with any of the retainer cavities 58 or drive chambers 40 when the plug 16 is rotated fully within the housing 12. Interference between the operation of the plug positioning means with the movement of a change ball 56 between a driver chamber 40 and a retainer cavity 58 is thereby avoided.

Figure 43B:
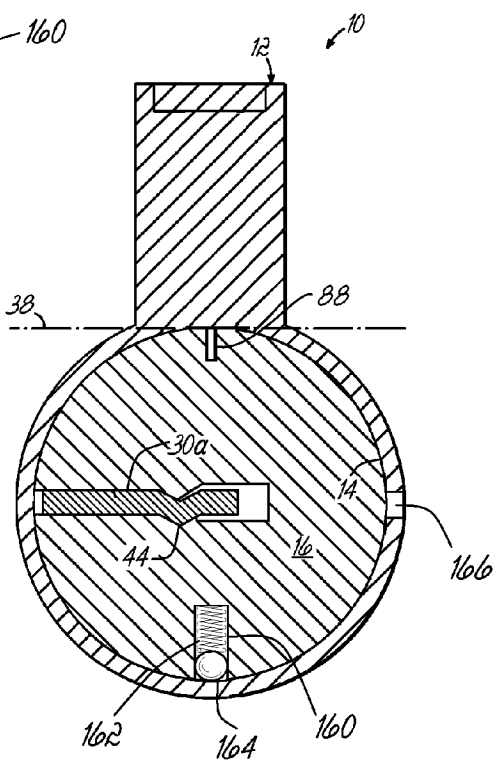
FIG. 43B shows a cross-sectional view of a plug and housing through line 43-43 of FIG. 42 of an embodiment of a lock of the present invention having a plug positioning means, with the plug in a lock programming position.
Figure 43A:
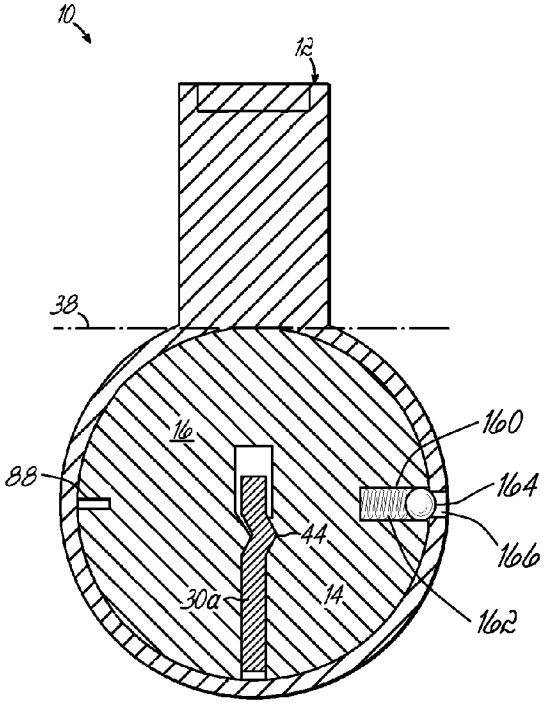
FIG. 43A shows a cross-sectional view of a plug and housing through line 43-43 of FIG. 42 of an embodiment of a lock of the present invention having a plug positioning means, with the plug in a key insertion position.

In operation, when the plug is in its first rotated position shown in FIG. 43A, the first detent cavity 160 and the second detent cavity 166 align, and the detent ball 164 rests partially out of the first detent cavity 160 and partially into the second detent cavity 166, biased in place by the detent spring 162.

When an operable key 30*a* is inserted into the lock and rotated toward its second rotated position shown in FIG. 43B, the inner surface of the bore 14 forces the detent ball 164 fully within the first detent cavity 160, where it is retained by the inner surface of the cylindrical portion 11 of the housing 12.

After the lock has been reprogrammed, as discussed herein, and the lock is rotated back toward its first rotated position. When the plug returns to the first rotated position, the first detent and the second detent cavities 160 and 166 again align. The user may hear and feel in the fingers, through the key, the impact of the detent ball 164 when driven by the detent spring 162 against the inside rim of the second detent cavity 166. This signals that the plug has been returned to the key inserted and removal position, and is properly aligned in the housing for removal of the operating key from the lock.

A typical way of forming the detent means during the making of the lock is described. While restraining the plug 16 from movement within the housing 12 and with the tumbler chambers 42 aligned with the drive chambers 40, a hole is drilled through the cylindrical portion 11 of the housing, forming the second detent cavity 166, and partially into the plug 16. A small flat surface can be machined onto the outer surface of the cylindrical portion 11 to facilitate the drilling. The plug is then removed and a larger-diameter hole is drilled into the plug, centered on the smaller partial hole, to form the first detent cavity 160. A detent ball 164 on top of a detent spring 162 are then inserted and restrained in the first detent cavity 160 as the plug 16 is inserted into the bore 14 of the housing 12. A preferred detent spring has a stainless steel wire of about size 013, and is available as part number C090x013x190 from W. B. Jones Spring Co., Inc., of Wilder, Ky.

Optionally the lock of the present invention can be configured with a second plug positioning means to provide a signal to the user that the plug has been rotated to the second rotated position within the housing for inserting the change tool and resetting the lock.

Referring now to FIGS. 23A-28B, wherein like components are referenced by like numbers, an illustrated third embodiment of the present invention is shown comprising at least one memory block associated with a retainer cavity. The memory block 90 is disposed in the plug 16 of the lock 10 and is configured to intersect the change slot 88 and retainer cavities 58. The memory block 90 prevents a user key other than the currently operable user key from being used to alter the driver, tumbler, and change ball configurations in the lock 10 in an unauthorized fashion. The memory block 90 accomplishes this by partially blocking the openings to the retainer cavities 58, so that change balls 56 cannot fit past the opening and into the retainer cavities 58. An authorized user may then insert a change tool 64 to move the memory block 90 away from the change slot 88 and expose the full diameter of the openings of the retainer cavities 58.

Figure 23B:
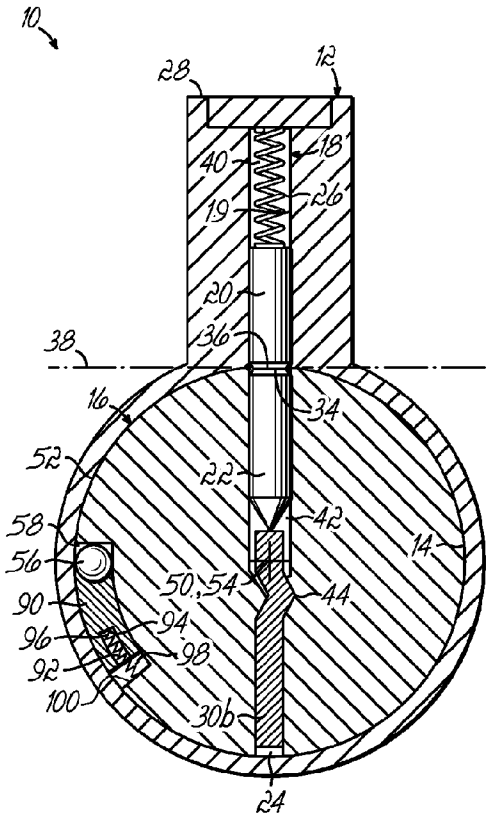
FIG. 23B is a cross-sectional view of the housing and plug taken along line 23B-23B of FIG. 23A.
Figure 23A:
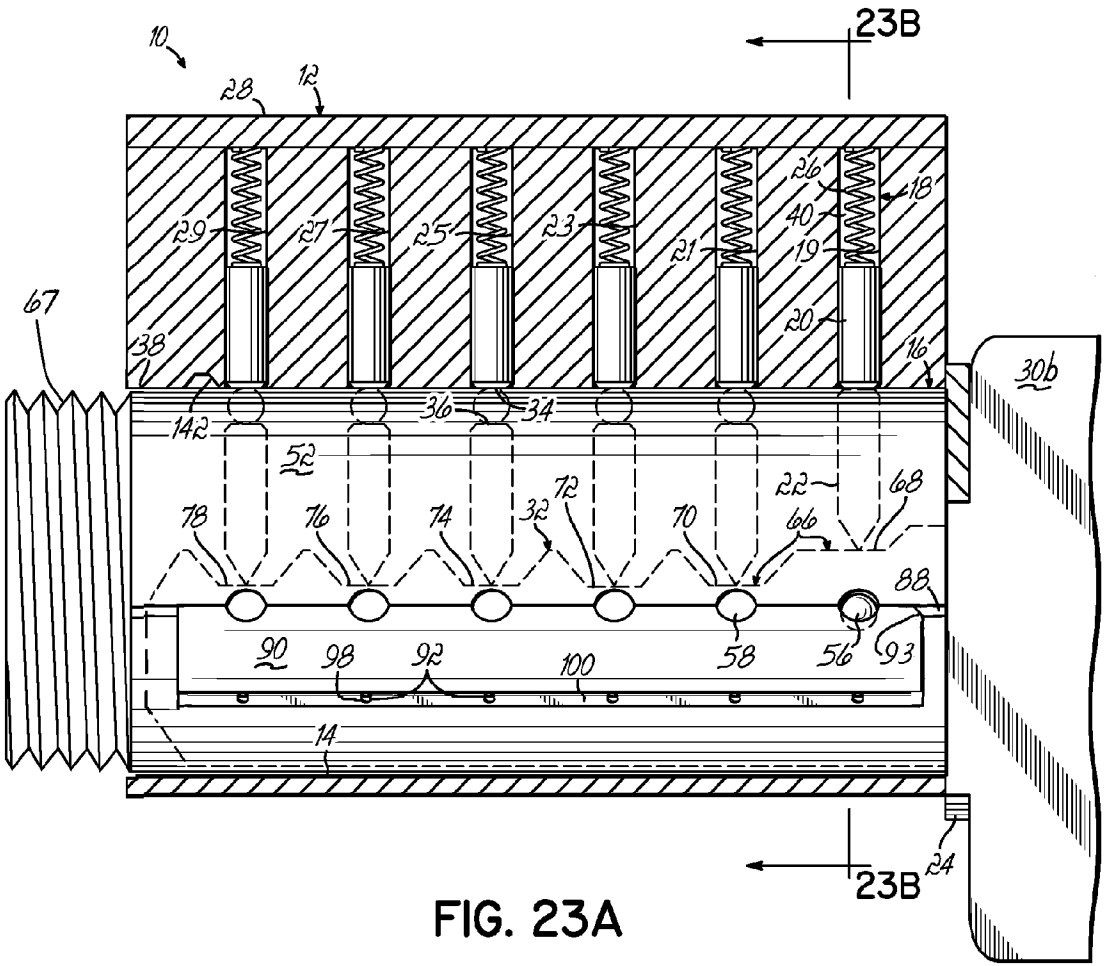
FIG. 23A is a cross-sectional view of the housing, with a side view of the plug of another embodiment of a lock assembly of the present invention further depicting a memory block in a closed position and a first key, which is operable, inserted into the keyway.

The lock 10 having a memory block 90 is shown in FIGS. 23A-23B having an inserted first key 30*b* that can operate the lock 10. The memory block 90 comprises a single block member associated with a plurality of memory block springs 92 that have a first end 94 operatively connected to a side edge 96 of the memory block 90, and a second end 98 operatively connected to an inner wall 100 located in the plug 16. The memory block springs 92 bias the memory block 90 in a direction toward the retainer cavities 58 such that the memory block 90 overlaps with and thereby reduces the size of the opening to the retainer cavities 58. As can be seen in FIG. 23A, a change ball 56 associated with the first pin chamber 19 is disposed in its second position within the corresponding retainer cavity 58. Each driver 20 in the pin chambers 18 is positioned such that its lower end 34 is flush with, and does not span, the shear line 38, thus allowing the plug 16 to rotate within the housing 16.

Figure 24B:
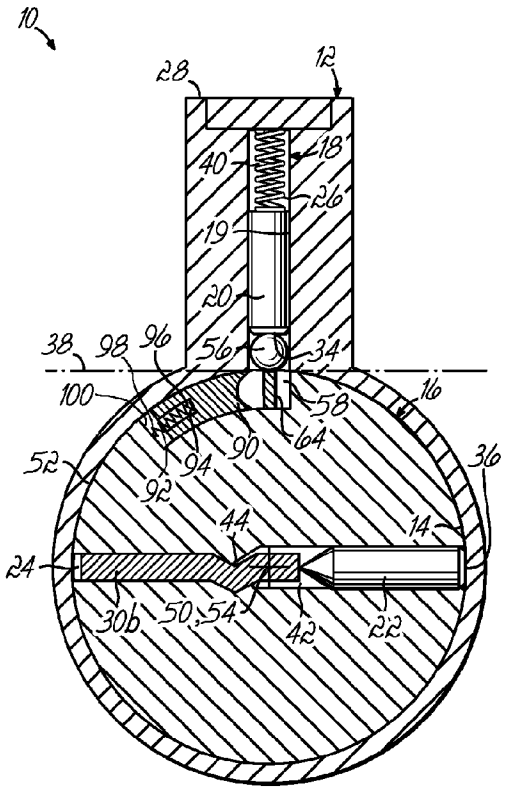
FIG. 24B is a cross-sectional view of the housing and plug taken along line 24B-24B of FIG. 24A.
Figure 24A:
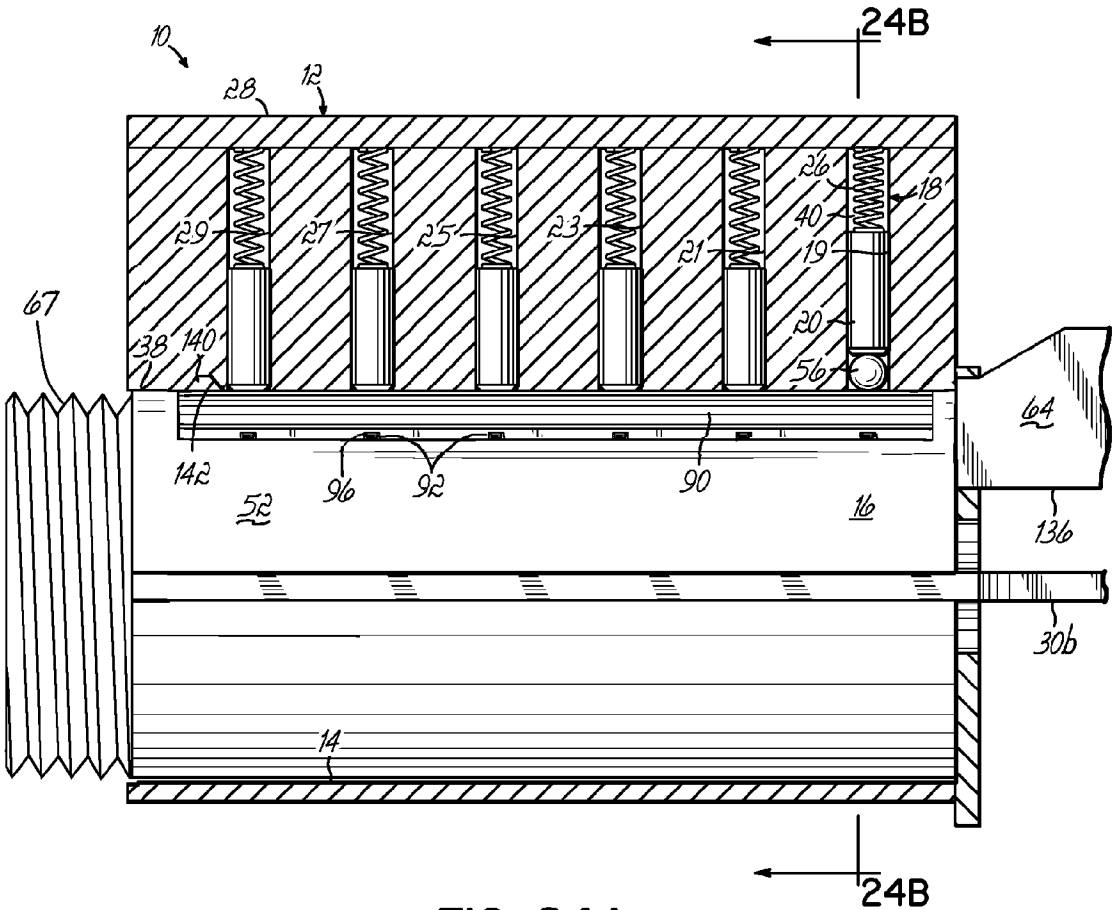
FIG. 24A is a cross-sectional view of the housing, with a side view of the plug of the lock assembly depicting a first key inserted and rotated one-quarter turn clockwise with a change tool inserted and the memory block moved back from the retainer cavities.

Referring now to FIGS. 24A and 24B, the lock 10 is depicted with the first key 30*b* inserted and with the plug 16 rotated one-quarter turn clockwise in the lock 10. A change tool 64 is shown inserted into the change slot, which results in two occurrences: (1) the change tool 64 displaces the memory block 90 away from the retainer cavities 58, thus exposing the openings to the retainer cavities 58 to their fullest size (diameter) and (2) the change tool 64 displaces any change ball 56 that had been disposed in the retainer cavities 58, into the respective driver chamber 40. In the embodiment shown in FIG. 24A, the change tool 64 has displaced the change ball 56 back up into the first driver chamber 40.

The memory bar 90 is configured with a bevel 93, shown in FIG. 23A, positioned along the change slot 88 near the entry opening on the change slot 88, illustrated as the indicator mark 114 in FIG. 1. As the change tool 64 is inserted into the change slot 88, the tool 64 engages the bevel 93, biasing the memory bar 90 radially toward the inner wall 100 sufficiently to expose the full diameter of the openings of the retainer cavities 58.

Figure 25B:
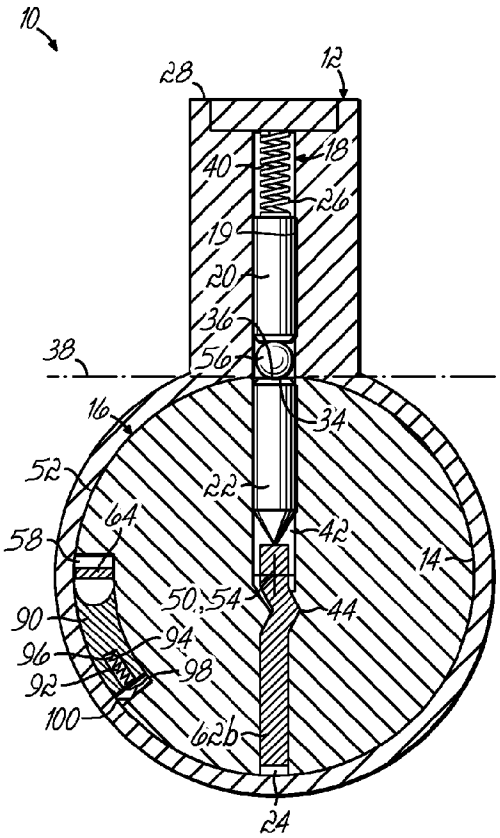
FIG. 25B is a cross-sectional view of the housing and plug taken along line 25B-25B of FIG. 25A.
Figure 25A:
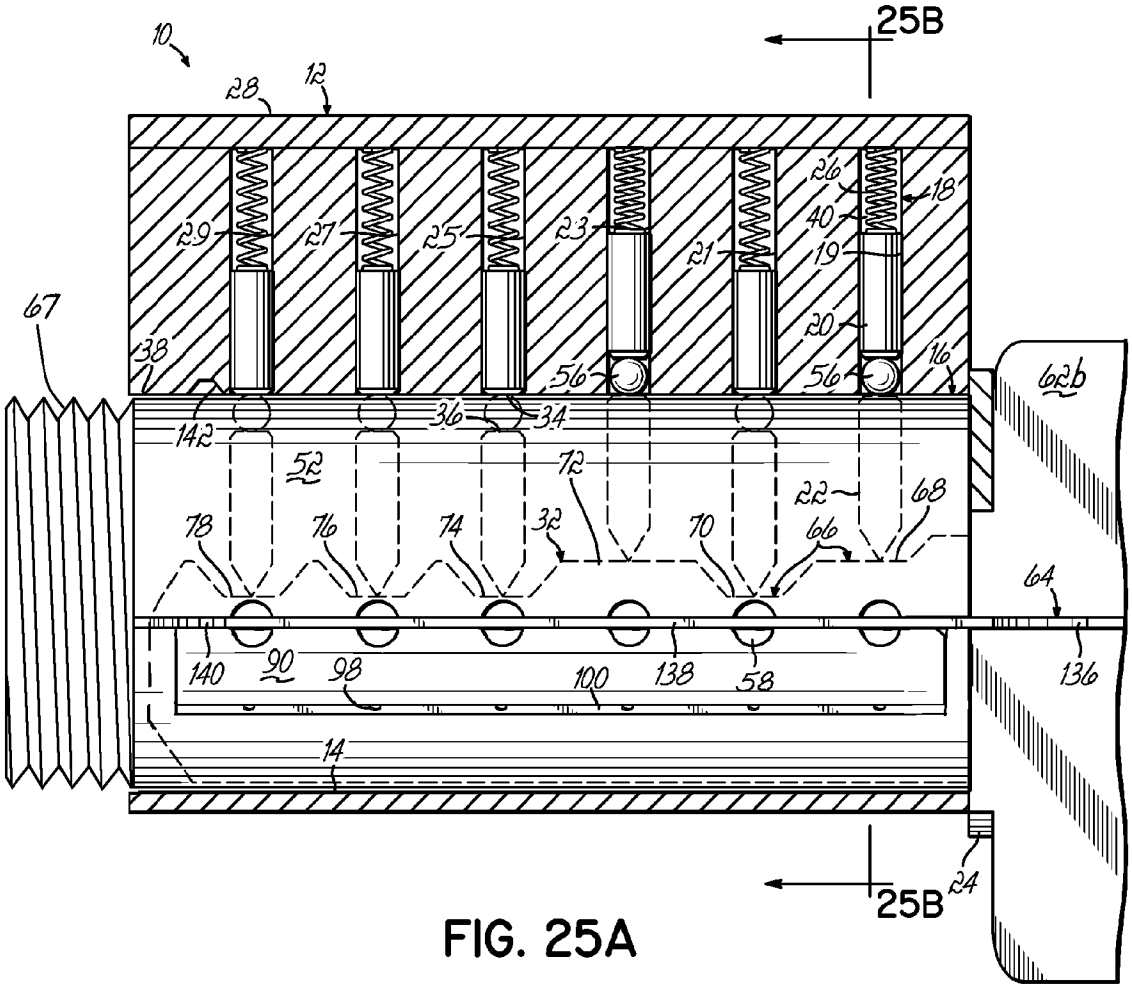
FIG. 25A is a cross-sectional view of the housing, with a side view of the plug of the lock assembly depicting the plug rotated back to its original position with a second key inserted and a change tool inserted in the change slot thereby opening the memory block.

With the change tool 64 still inserted, the plug 16 has been rotated back one-quarter turn counter-clockwise to its original position. The first key 30*b* has been removed and a second key 62*b* has been inserted, as shown in FIGS. 25A and 25B. The second key 62*b* has a different top edge contour 32 than the first key 30*b*. The illustrated embodiment, the third contour location 72 is raised in the second key 62*b*, whereas it was lowered in the first key 30*b*. As shown in FIG. 25A, the second key 62*b* raises the change balls 56 associated with the first and third pin chambers 19, 23 above the shear line 38. The driver 20 in each remaining pin chamber 18 is disposed within the driver chamber 40 of the housing 12 with its bottom edge 34 positioned along the shear line 38. In this configuration, the plug 16 can rotate within the housing 12. The change tool 64 is still inserted in the change slot 88, thus keeping the memory block 90 disposed away from the openings to the retainer cavities 58 such that the memory block 90 does not reduce the diameter of the openings.

Figure 26B:
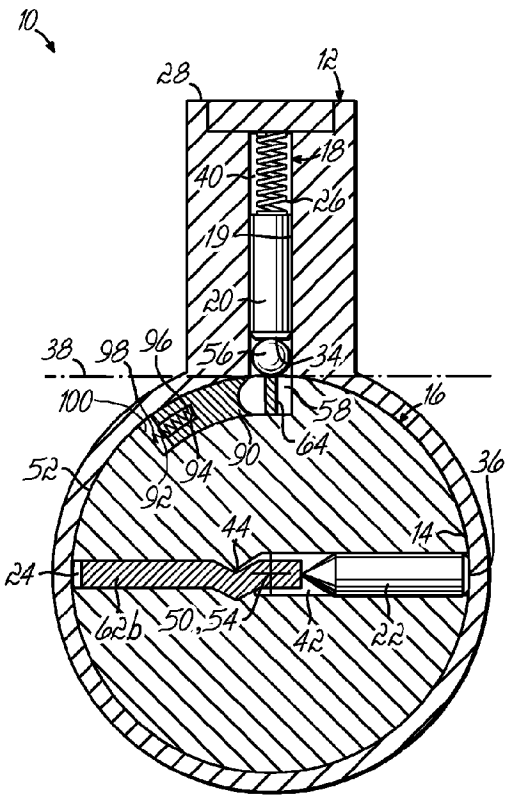
FIG. 26B is a cross-sectional view of the housing and plug taken along line 26B-26B of FIG. 26A.
Figure 26A:
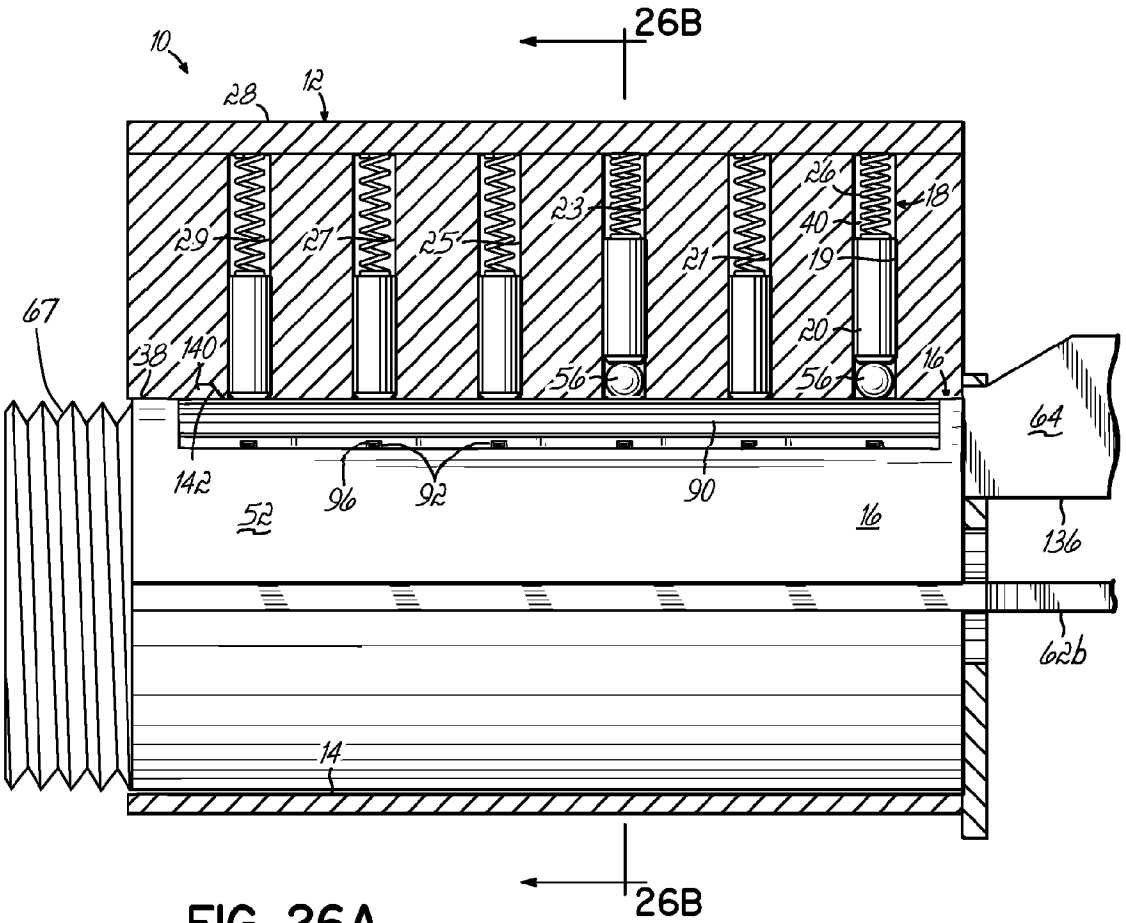
FIG. 26A is a cross-sectional view of the housing, with a side view of the plug of the lock assembly with the second key and change tool both inserted and the memory block open and the plug rotated one-quarter turn.

Referring now to FIGS. 26A and 26B, the plug 16 with the second key 62*b* inserted has been rotated one-quarter turn clockwise to bring the retainer cavity 58 and the change tool 64 (which is still inserted in the change slot 88) into alignment with the driver chambers 40. The inserted change tool 64 has engaged the bevel 93 and biases the memory block 90 away from the opening to the retainer cavities 58. The change balls 56 of the first and third pin chambers 19, 23 are still disposed within the respective driver chambers 40 above the shear line 38 and directly above the retainer cavities 58.

The change tool 64 is then pulled from the change slot 88. So long as at least some portion of the length of the change tool 64 remains in the entry to the change slot 88 and engaged with the bevel 93, the memory block 90 remains biased away from the opening to the retainer cavities 58. Thus, as the distal end of the change tool 64 is withdraw past each driver chamber 40, any change ball 56 disposed within the driver chamber 40 above the shear line 38 is forced by the driver spring 26 through the opening and into the corresponding retainer cavity 58.

Figure 27B:
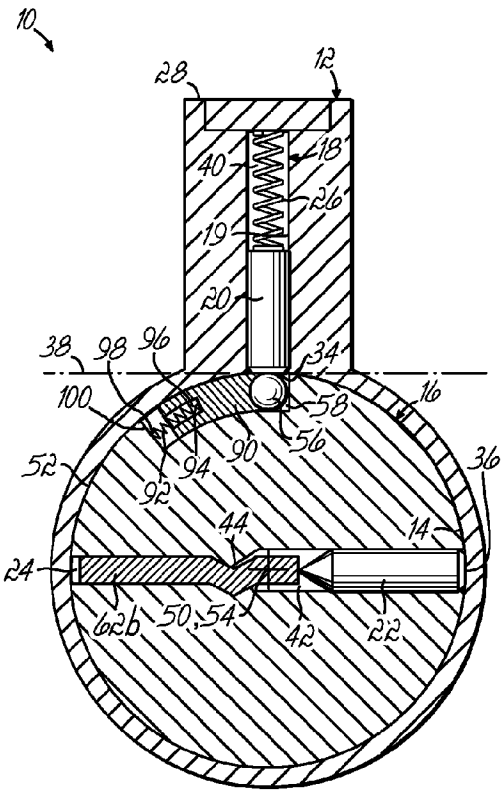
FIG. 27B is a cross-sectional view of the housing and plug taken along line 27B-27B of FIG. 27A.
Figure 27A:
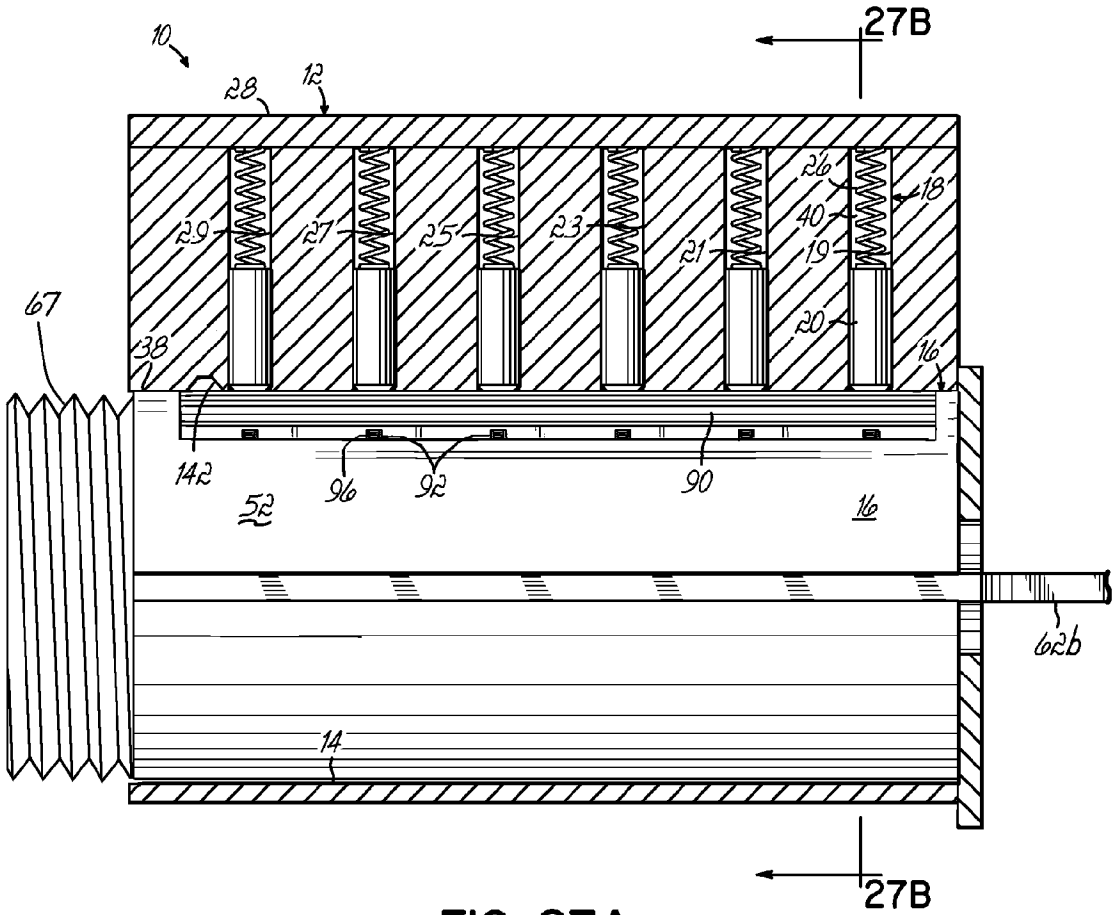
FIG. 27A is a cross-sectional view of the housing, with a side view of the plug of the lock assembly showing the second key inserted in the plug and the plug rotated one-quarter turn with the change tool now removed from the change slot.

After the change tool 64 is completely withdrawn from the change slot 88, and any change ball 56 disposed in the driver chamber 40 has been driven into its retainer cavity 58, the spring force of the memory block springs 92 biases the memory block 90 back toward the retainer cavities 58 as shown in FIGS. 27A and 27B. This again reduces the size of the openings to the retainer cavities 58 such that the operable size for the opening to the retainer cavity 58 is too small for a change ball 56 to pass into or out from the retainer cavity 58.

Figure 28B:
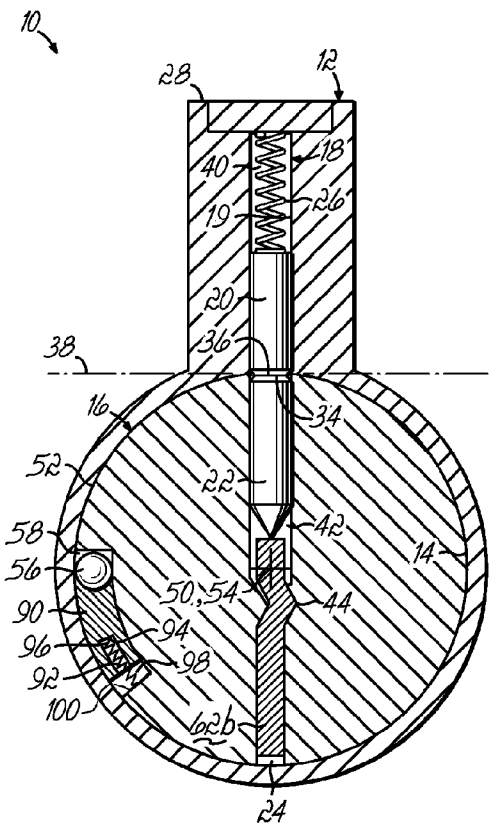
FIG. 28B is a cross-sectional view of the housing and plug taken along line 28B-28B of FIG. 28A.
Figure 28A:
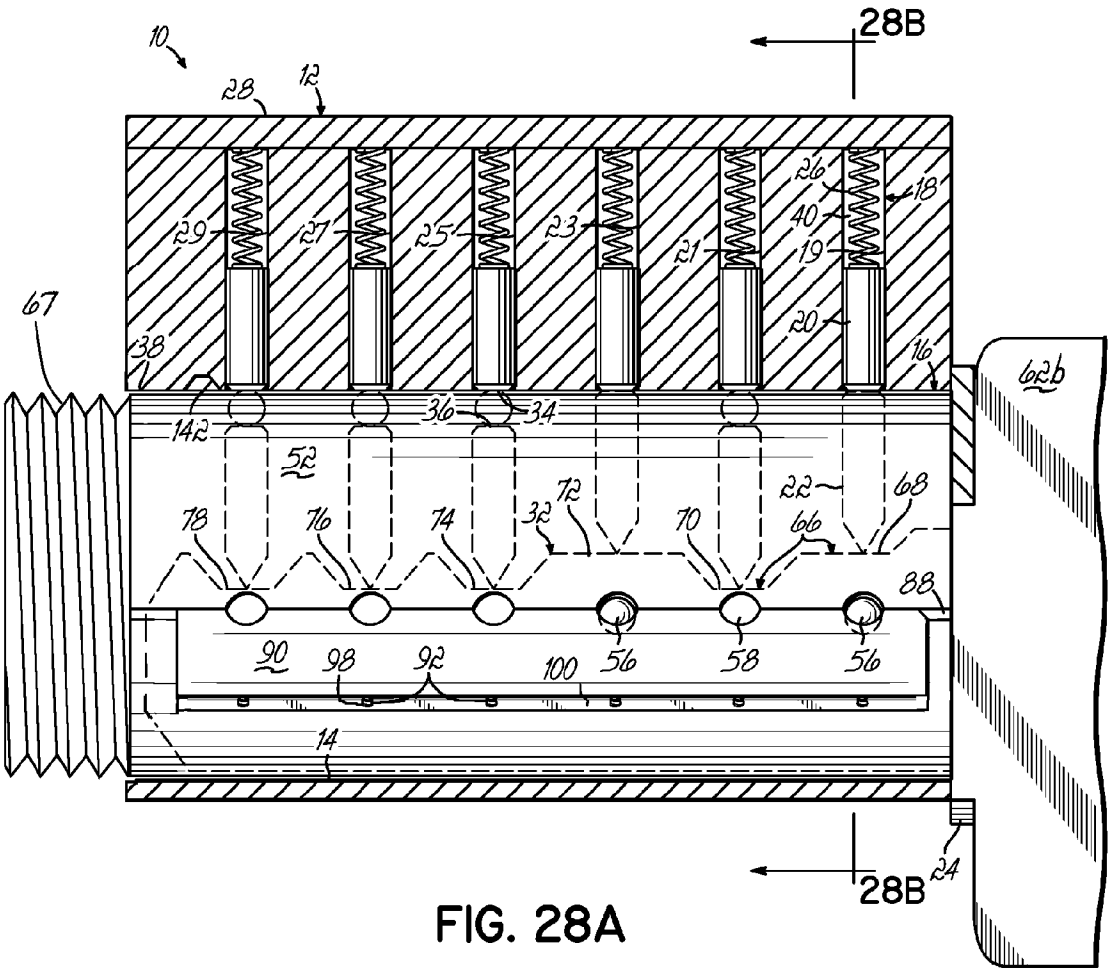
FIG. 28A is a cross-sectional view of the housing, with a side view of the plug of the lock assembly showing the plug rotated back to its original position with the change tool removed and the second key, now operable, inserted in the keyway.
Figure 29B:
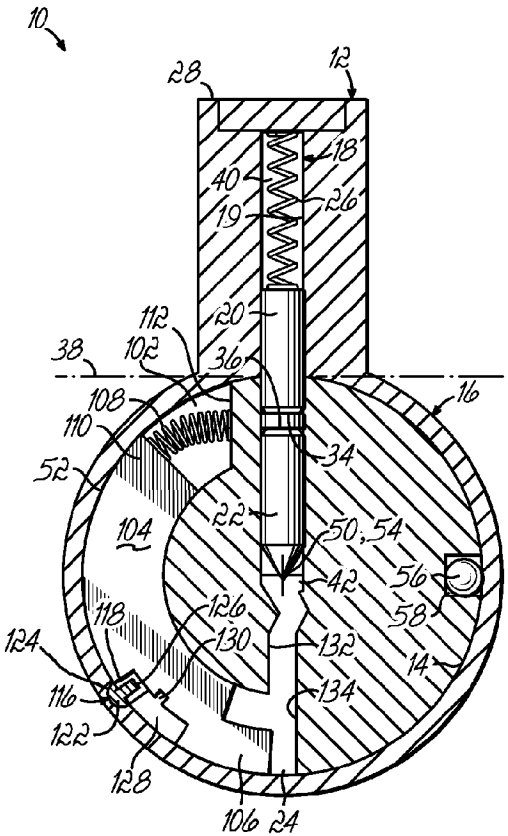
FIG. 29B is a cross-sectional view of the housing and plug with a plan view of the radial tumbler taken along line 29B-29B of FIG. 29A.
Figure 29A:
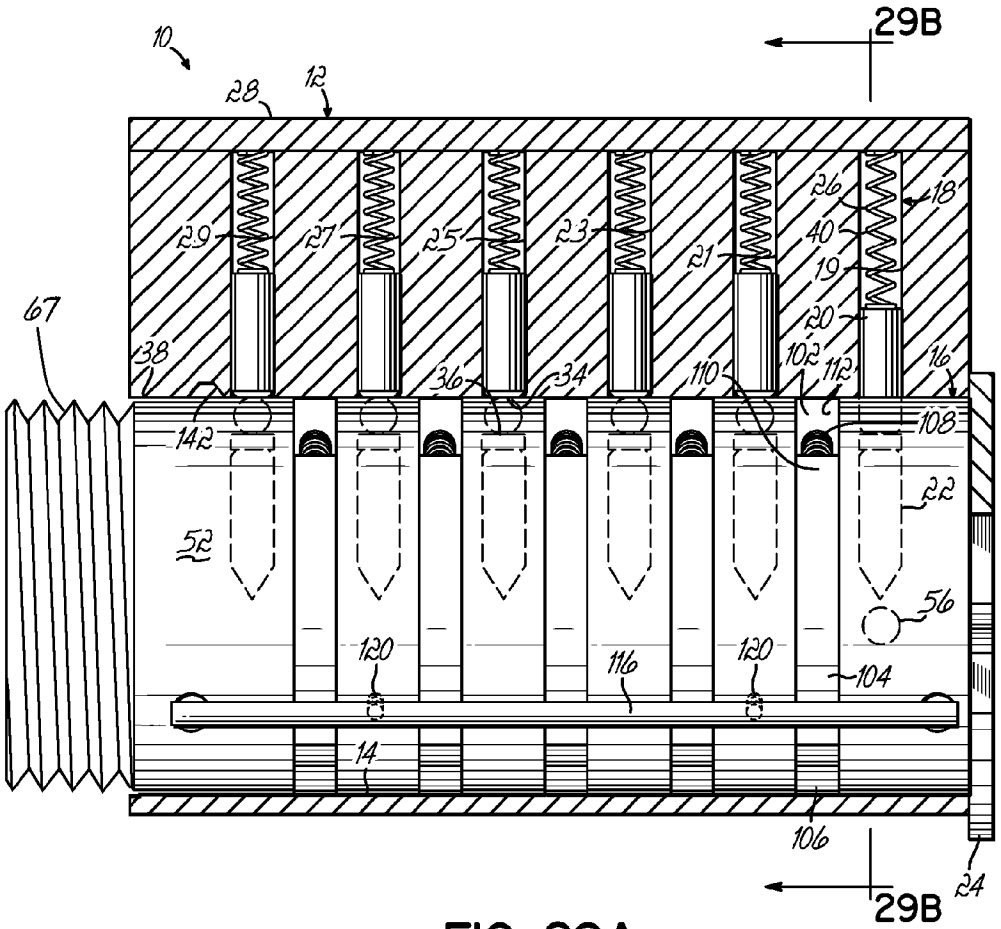
FIG. 29A is a cross-sectional view of the housing, with a side view of the plug of the lock assembly showing the plug in an original position with no key inserted and having a series of radial tumblers and change members.

With the change tool 64 removed, the plug 16 is rotated in the housing 12 back one-quarter turn counter-clockwise to the original position. As seen in FIGS. 28A and 28B, the memory block 90 remains biased by the spring force of the bias springs 92 toward the openings of the retainer cavities 58. When a subsequent key with a raised contour location 66 at one of the remaining second, fourth, fifth, or sixth contour locations 70, 74, 76, 78 (or any combination of those locations) is inserted, at least one additional change ball 56 will be displaced above the shear line 38. However, if the lock 10 is rotated without inserting a change tool 64 to open the memory block 90, the change balls 56 cannot be forced out of the driver chambers 40 and down into the retainer cavities 58. Thus, with a memory block 90, additional keys cannot change the configuration of the drivers 20, tumblers 22, and change balls 56 unless a change tool 64 is used. Likewise, reinsertion of the first key 30*b* will not operate the lock 10, since the driver 20 of the third pin chamber 23 would be disposed across the shear line 38 of the lock 10.

The illustrated embodiment uses a single unitary memory bar 90 that covers and uncovers all of the retainer cavities. Alternatively, a separate memory bar can be provided for each retainer cavity, or for a plurality of retainer cavities.

The housing 12 and the plug 16 of the lock 10 can each include an indicator mark 114 and 144, respectively, to be used in conjunction with the change tool 64 in reprogramming the lock 10.

Figure 37:
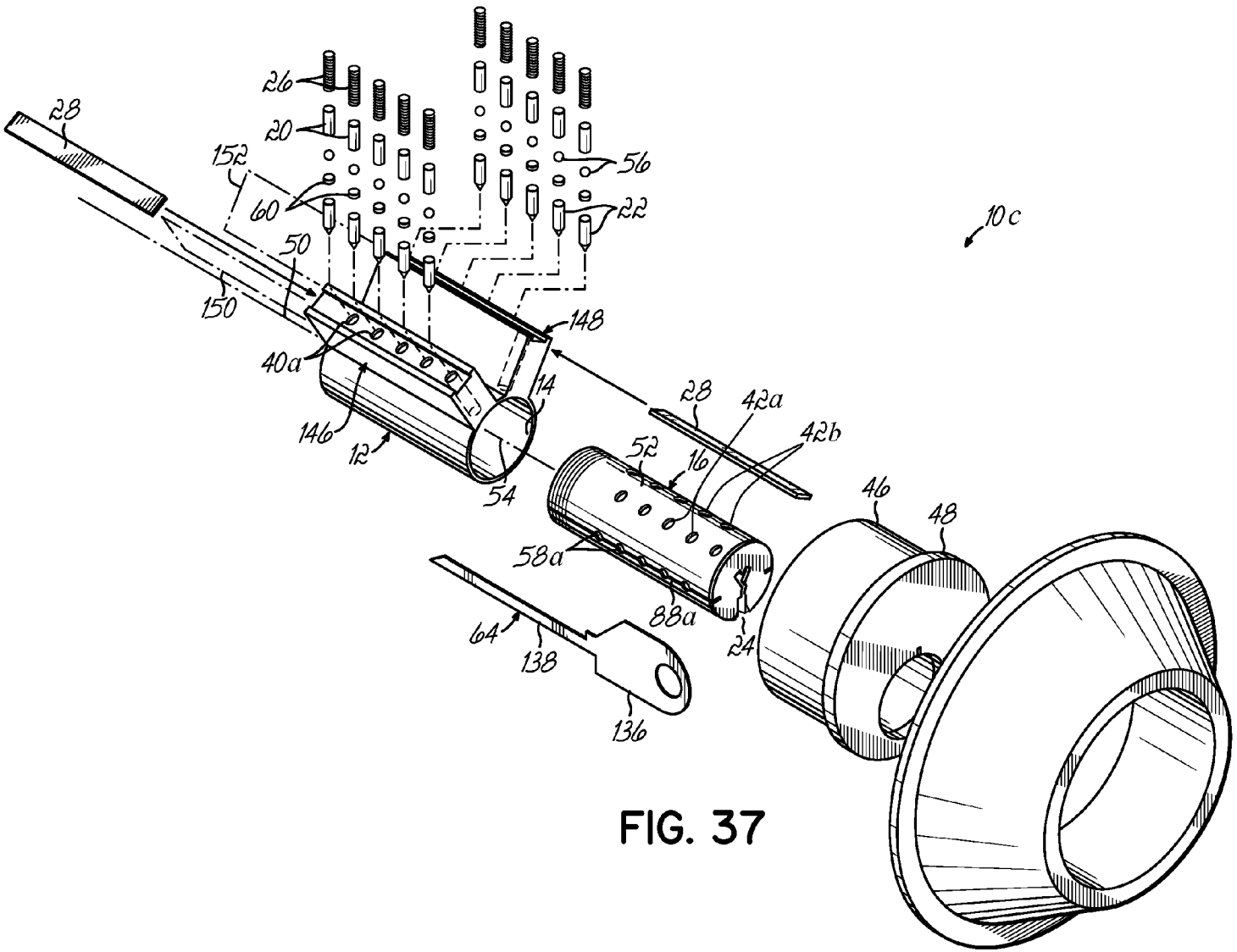
FIG. 37 is a perspective, disassembled view of the components of an embodiment of the lock assembly of the present invention having two sets of pin chambers to hold two sets of driver/tumbler stacks.
Figure 39A:
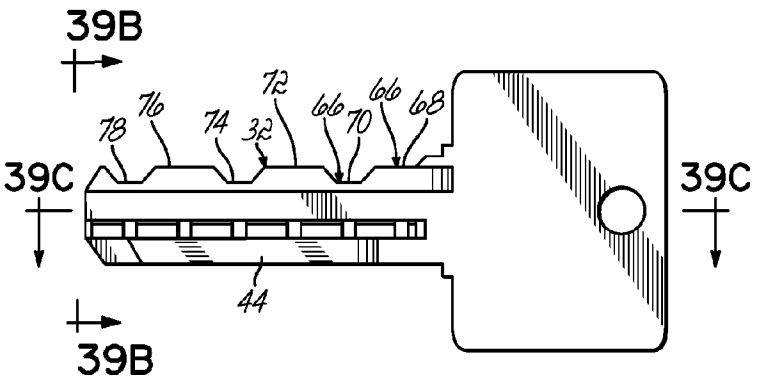
FIG. 39A is a side perspective view of a key having a top edge contour and a longitudinal contour adapted for a lock of the present invention.
Figure 39B:
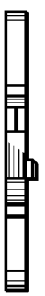
FIG. 39B is an end view of the key taken from line 39B-39B of FIG. 39A.
Figure 39C:
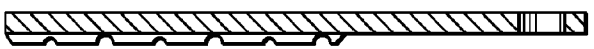
FIG. 39C is a cross-sectional view of the key taken along line 39C-39C of FIG. 39A.

Referring to FIGS. 1 and 37, in order to change the lock 10, the change tool 64 is provided for insertion into the longitudinal change slot 88. The change tool 64, suitably configured for use with the lock 10 as described, has a handle portion 136 and a blade portion 138. The blade portion 138 has a beveled edge end 141 to facilitate movement of the blade portion 138 past the retainer cavities 58 during insertion. As described above, with this change tool 64, the driver mechanism of the lock 10 can be readily changed to facilitate operation of the lock 10 with a different second key 62*a*. The blade portion 138 has a linear edge 143 that is configured to raise each change ball 56 out of its respective retainer cavity 58 when fully inserted into the change slot 88. The change tool 64 can also include a change tool notch 140 that is adapted to insert into a change tool notch groove 142 that can be disposed circumferentially in the housing 12 (see FIG. 11A). The notch 140 can register with the groove 142 to prevent the change tool 64 from being withdrawn and removed from the change slot 88 unless the retainer cavities 58 or the tumbler chambers 42 are aligned with the driver chambers 40.

The plug 16 of the embodiment illustrated in FIGS. 23 through 28 can be made by machining the plurality of tumbler chambers 42, the plurality of retainer cavities 58, and the change slot 88 into a metal cylinder, typically a cylindrical bar stock material. Alternatively, an existing conventional plug having only the plurality of tumbler chambers can be retrofitted by machining the plurality of retainer cavities and the change slot 88 therein.

In a first method of making a changeable lock plug, a standard lock plug is provided and machined. This step typically comprises disassembling an existing standard lock, by removing the plug from the lock housing, and removing the hardware, such as springs and pins (the drivers, tumblers and any master shims) from the lock plug, thereby recovering the standard lock plug.

The standard lock plug has as a keyway, an axial centerline and a circumferential surface. The standard lock plug further has a plurality of tumbler chambers 42 extending through the circumferential surface along a first line extending parallel to the axial centerline. Each tumbler chamber extends into the keyway and has a centerline that is spaced apart by a first distance from an adjacent tumbler chamber. Typically adjacent tumbler chambers are separated by the same first distance.

In the next step, the standard lock plug is machined to provide a plurality of retainer cavities 58, into the standard lock plug. The retainer cavities are formed through the circumferential surface along a second line extending parallel to the axial centerline, and hence parallel to the line of the tumbler chambers 42. Each retainer cavity extends partially into the plug body. The second line is positioned whereby the retainer cavities are displaced radially from the first line of tumbler chambers by an arc angle along the circumferential surface. Typically, the arc angle is about 30° to about 160°, more typically about 45° to about 135°, offset from the first line.

In a typical embodiment, the retainer cavities are machined to a depth into the plug body of at least its diameter, more typically at least 105% of its diameter. Typical retainer cavity diameters are from about 0.050 inches (about 1.3 mm) to 0.090 inches (about 2.3 mm), and are typically of a size, or diameter, less than the diameter of the driver and any master shim positioned within the driver chambers of the housing. More typically, the diameter of the retainer cavities are drilled to a diameter of about 95% and less than the size (diameter) of the driver. Typically, the retainer cavities are formed with a standard drilling machine.

In a next step, a slot is cut along the axial direction in the outer surface of the plug along the same line as the second bores. The slot is illustrated as the change slot 88 in the embodiments. The slot is generally formed as a u-shaped or rectangular cross section, penetrating the circumferential surface of the plug and extending radially inward toward the center axis. The slot is typically formed having a depth of approximately the same depth as the retainer cavities, and having a width of about 0.04 inches (1.0 mm) or less, and more typically of about 0.02 inches (0.5 mm) or less. The slot typically extends longitudinally completely from the front face 13 of the plug to the latch end 15 of the plug, passing through the centers of each retainer cavity. The slot can be cut by any well known means, such as a circular saw.

After forming the retainer cavities and the slot, the lock is then reassembled by reinstalling the drivers, tumblers, springs, and change balls in a programmed arrangement. The change ball is typically a spherical change ball, sized to fit within the depth of the retainer cavity, as described herein above.

In a typically method, the plug body is secured, such as by clamps, for rotational movement about its center axis. The plug is first secured in a first position whereby the tumbler chambers register with a reference point. The reference point is registered with a drilling machine. The drilling machine operates a drilling bit that is rotated at a cutting speed, and can move the drilling bit along the axis of the drill bit from a first position outside the plug surface to a second position that penetrates a depth into the plug. The plug is then rotated about its axis to a second position, which is offset radially from the first position by the arc angle. The drilling machine is then operated to drill the retainer cavity to its depth. The drilling machine is also configured for movement along the longitudinal axis of the plug, whereby successive retainer cavities can be drilled along the second line of the plug to form the plurality of retainer cavities. More typically, the drilling machine comprises a plurality of drilling bits that are configured spaced apart, whereby the plurality of retainer cavities can be machined simultaneously.

In a second method of making a changeable lock plug, a base lock plug is provided and machined. The base plug is typically a cylindrical body configured with a keyway. In this method, both the tumbler chambers and the retainer cavities, and the change slot, are machined into the circumferential surface for plug body. The plurality of tumbler chambers are machined, typically by a drilling machine, through the circumferential surface along a first line extending parallel to the axial centerline, wherein each tumbler chamber extends into the keyway. Typically, the tumbler chambers penetrate the plug surface at a position opposite (180°) from the base of the keyway. The plurality of retainer cavities are then machined through the circumferential surface along a second line as described above for the first method.

In a typically method, the base plug body is secured, such as by clamps, for rotational movement about its center axis. The base plug is first secured in a first position whereby a drilling machine registers with a reference point representing the axial centerline of a first retainer cavity. The drilling machine operates a drilling bit that is rotated at a cutting speed, and can move the drilling bit along the axis of the drill bit from a first position outside the plug surface to a second position that penetrates a depth into the plug. The drilling machine is configured for operation to drill the first tumbler chamber through the circumferential surface of the plug and into the keyway. The drilling machine is then moved along the longitudinal axis of the plug to a next position, corresponding to the axial centerline of the second tumbler chamber. The drilling machine is again operated to drill the second tumbler chamber. Successive tumbler chambers can thus be machined. Alternatively, the drilling machine can comprise a plurality of drilling bits that are configured spaced apart, whereby all required retainer cavities can be machined simultaneously along the first line.

The plug is then rotated about its axis to a second position, which is offset radially from the first position by the arc angle. The drilling machine is then operated to drill each retainer cavity to its depth, as described above.

Alternatively, the set of tumbler chambers and retainer cavities can be machined into the base plug by separate drilling machines, sequentially or simultaneously, without requiring rotational movement of the plug body.

A change slot is also formed along the second line, passing through the plurality of retainer cavities. The change slot is typically secured in placed and machined with a rotating saw. The step of forming the change slot can be performed while the plug is in the same position as for the drilling of the retainer cavities.

Referring now to FIGS. 29A-36B and 39A-39C, in another illustrated alternate embodiment wherein like components are referenced by like numbers, the plug 16 of the present invention can optionally include at least one first groove in the form of a radial slot 102 disposed in the circumference of the plug 16 extending radially and outwardly from the longitudinal axis 54 of the plug 16. This radial slot 102 forms a cavity through and within the outer periphery of the plug 16. The keyway 24 allows for the insertion of a first key 30*c* having a longitudinal contour 44 of grooves and/or ridges and a top edge contour 32. A radial tumbler 104 can be disposed in the radial slot 102, the radial tumbler 104 including a distal end 106 that extends into the keyway 24.

The radial tumbler 104 can be configured for circumferential movement within the radial slot 102 around the longitudinal axis 54 of the plug 16. The radial tumbler 104 is biased toward the keyway 24 of the plug 16 by a radial tumbler spring 108. As a result, the distal end 106 of the radial tumbler 104 projects into the keyway 24 when no key is present. Thus, not only must the top edge contour 32 of the first key 30 be of correct shape to raise the drivers 20 and tumblers 22 and any change ball 56 to match the shear line 38 of the lock 10, but the longitudinal contour 44 on the first key 30 must be a configuration that allows the first key 30 to confront distal end 106 of the radial tumbler 104 that extends into the keyway 24, and to properly position the radial tumbler 104 to allow the plug 16 to be rotated.

A plurality of radial tumblers 104 can be disposed within a plurality of radial slots 102 in the sidewall of the plug 16. For purposes of illustration, only one radial tumbler 104 will be described. Also alternatively, a secondary radial tumbler or secondary set of radial tumblers (not shown) can be provided on the opposite side of the plug 16, such that the distal ends 106 of the radial tumblers project into each side of the keyway 24.

A radial tumbler spring 108 is positioned in confronting relationship with the radial tumbler 104, between a top edge 110 of the radial tumbler 104 and an upper sidewall 112 of the plug 16. This spring 108 biases the radial tumbler 104 away from the upper sidewall 112 and toward the keyway 24. The distal end 106 of the radial tumblers 104, as shown in the illustrated embodiment, can be beveled such that a key being inserted into the keyway 24 can move past the radial tumblers 104.

The lock 10 of the illustrated embodiment can further include a sidebar 116 disposed in a longitudinal sidebar slot 118 formed in the periphery of the plug 16. Both the sidebar 116 and sidebar slot 118 extend along a line substantially parallel to the longitudinal axis 54 of the plug 16. At least one sidebar spring 120 is disposed within the plug 16 and confronts the sidebar 116 in order to bias the sidebar 116 radially outwardly from the longitudinal axis 54 of the plug 16.

The sidebar 116 of the illustrated embodiment extends substantially along the length of the plug 16 and includes a projection 122 on a first side thereof. The projection 122 is adapted to mate with a second groove 122 which is configured in the bore of the housing 12. At least one lug 126 extends radially inwardly from a second side of the sidebar 116, toward the radial tumbler 104. The lug 126, in the illustrated embodiment, is disposed substantially opposite from the projection 122 of the sidebar 116. The sidebar spring 120 biases the sidebar 116 away from the radial tumbler 104, such that the projection 122 of the sidebar 116 is disposed within the second groove 124 when the plug 16 is in an original position as shown in FIG. 9B. In the illustrated embodiment, two sidebar springs 120 are used to bias the sidebar 116.

The radial tumbler 104 further includes a sidebar groove 128, which allows for circumferential movement of the radial tumbler 104 even while the sidebar 116 is held in position with projection 122 in the second groove 124. The sidebar groove 128 in the radial tumbler 104 is only of a radial depth sufficient to house the length of the sidebar 116 when the projection 122 is disposed in the second groove 124. The radial tumbler 104 further includes a sidebar notch 130 that extends from the sidebar groove 128 in a direction orthogonal to and substantially toward the longitudinal axis 54 of the plug 16.

Figure 30B:
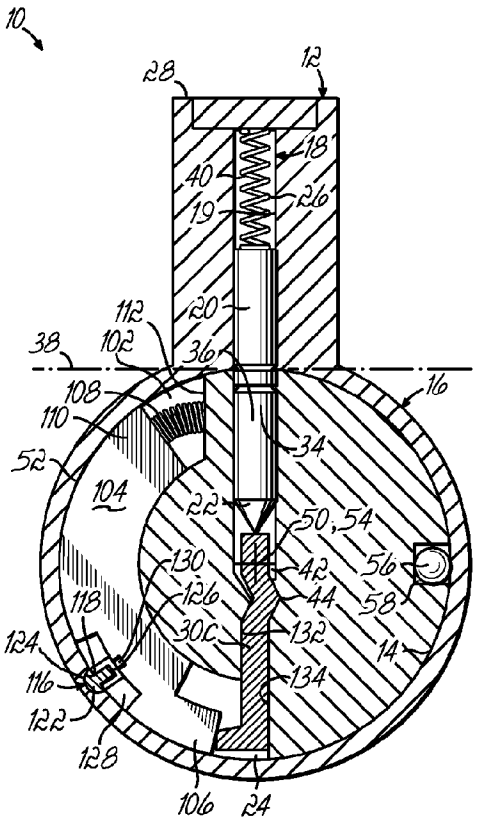
FIG. 30B is a cross-sectional view of the housing and plug with a plan view of the radial tumbler taken along line 30B-30B of FIG. 30A.
Figure 30A:
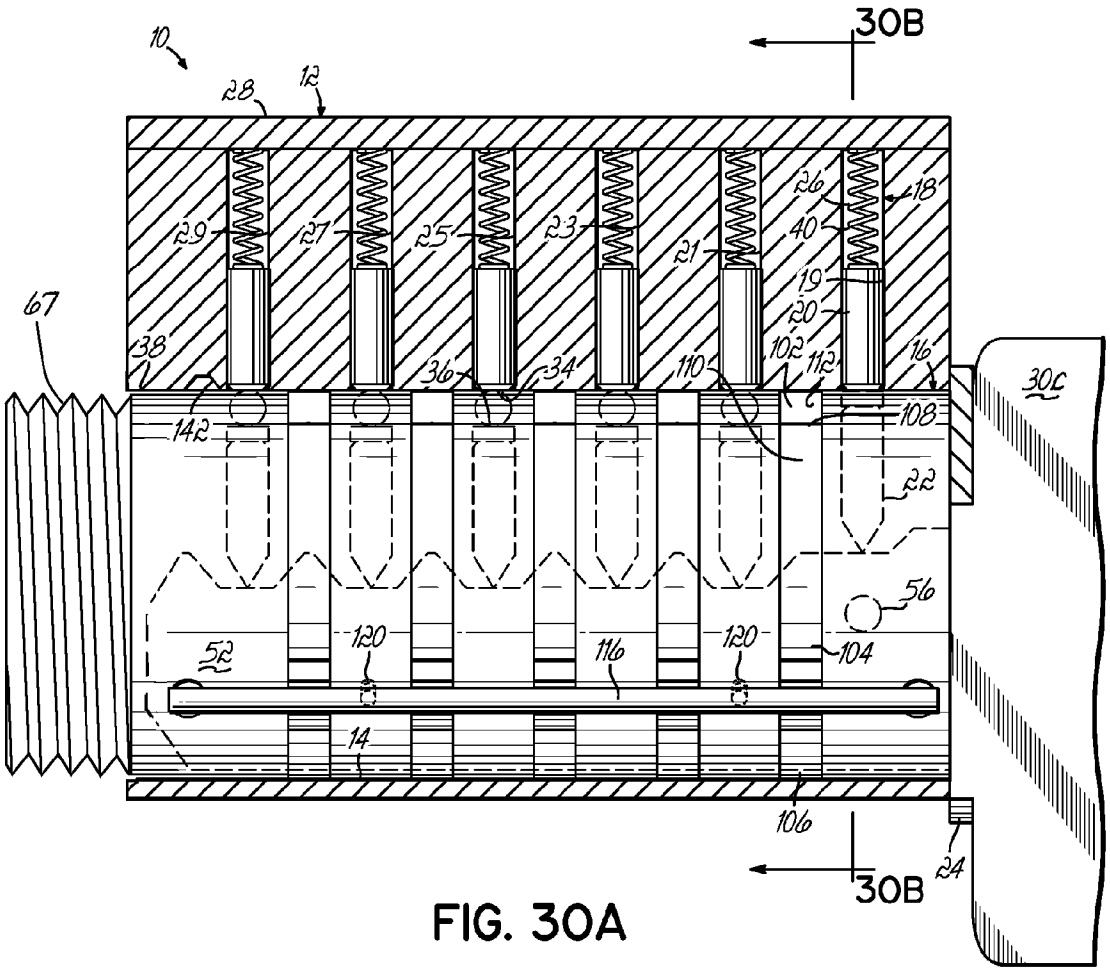
FIG. 30A is a cross-sectional view of the housing, with a side view of the plug of the lock assembly depicting the positioning of the radial tumblers and change members when a first key is inserted into the keyway.

With no key or an inoperative key inserted in the keyway 24, the radial tumbler 104 can be disposed within the radial slot 102 such that the sidebar 116 is not aligned radially with the sidebar notch 130. Thus, any attempted rotation of the plug 16 will also be prevented by the location of the projection 122 in the second groove 124 of the housing 12 (see FIG. 29B). When a proper first key 30 is inserted in the keyway 24 (as shown in FIG. 30B), the sidebar lug 126 will align radially with the sidebar notch 130 to allow displacement of the sidebar 116 out of the second groove 124 and into the sidebar notch 130 upon rotation of the plug 16.

At the time of insertion of a proper first key 30*c* and prior to the turning of the plug 16, each of the tumblers 22, drivers 20 and change balls 56 will be lifted by the top edge contour 32 of the first key 30*c* such that the junction between any two of the drivers 20, tumblers 22, and change balls 56 proximate to the shear line 38 is flush with shear line 38. Also, to enable rotation of the plug 16, the first key 30*c* must have a longitudinal contour 44 that matches the pattern of the keyway 24 formed by the distal end 106 of the radial tumbler 104. An operable first key 30*c* can operate the lock 10 having a radial tumbler on one side of the plug 16, or a lock 10 with matched radial tumblers 104 disposed on each side of the plug 16. However, hereinafter, only one radial tumbler 104 on one side of the plug 16 will be discussed in order to illustrate the principles of the present invention.

As the proper first key 30*c* is inserted, the radial tumbler 104 will move circumferentially such that the lug 126 of the sidebar 116 is positioned in radial alignment with a sidebar notch 130 disposed in the first radial tumbler 104. The sidebar lug 126 then has suitable space for movement radially (inwardly) toward the radial tumbler 104 and into the sidebar notch 130 upon turning of the first key 30*c*. When the first key 30*c* is turned, the sidebar projection 122 cams out of the second groove 124, causing the sidebar 116 to move radially inward to a position wherein the lug 126 of the sidebar 116 is accommodated by the sidebar notch 130 in the first radial tumbler 104.

With a proper first key 30*c* inserted in the lock 10 and the above-described disposition of the drivers 20 and tumblers 22, the plug 16 can be rotated to disengage the latch member (not shown) from the doorjamb slot or other recess so that the door or other member can be opened. If the top edge contour 32 of a key is inappropriate for operating the lock 10, a portion of one or more of the drivers 20 will project into a tumbler chamber 42 of the pin chambers 18, and/or a portion of one or more of the tumblers 22 will project into a driver chamber 40, to fix the plug 16 at the locking orientation so that the door or other member in which the lock 10 is installed cannot be opened. Additionally, a change ball 56 or master shim 60 could span the shear line 38, thus blocking rotation of the plug 16. Additionally, a key, even a key with a proper top edge contour 32, will be unable to operate the lock 10 if the key does not have a pre-selected design of the longitudinal contour 44 running along its length to match the contour of the keyway 24 provided by the distal ends 106 of the radial tumbler 104 projecting into the keyway 24. Such a proper longitudinal contour 44 establishes the proper alignment of sidebar lug 126 with sidebar notch 130.

With reference to FIGS. 29A-36B, the keyway 24 in the plug 16 is substantially rectangular in shape, and intersects a portion of the periphery of the plug 16. The limits of the keyway 24 are formed by a first internal side wall 132 and a second internal sidewall 134 of the plug 16. As described above, the distal end 106 of the radial tumbler 104 extends into and through a projection of at least one of the first and second internal sidewalls 132,134 of the keyway 24. This distal end 106 projects a pre-selected distance into the keyway 24. In alternate embodiments, distal ends 106 of multiple radial tumblers 104 can project through both the first and second internal sidewalls 132, 134.

Figure 31B:
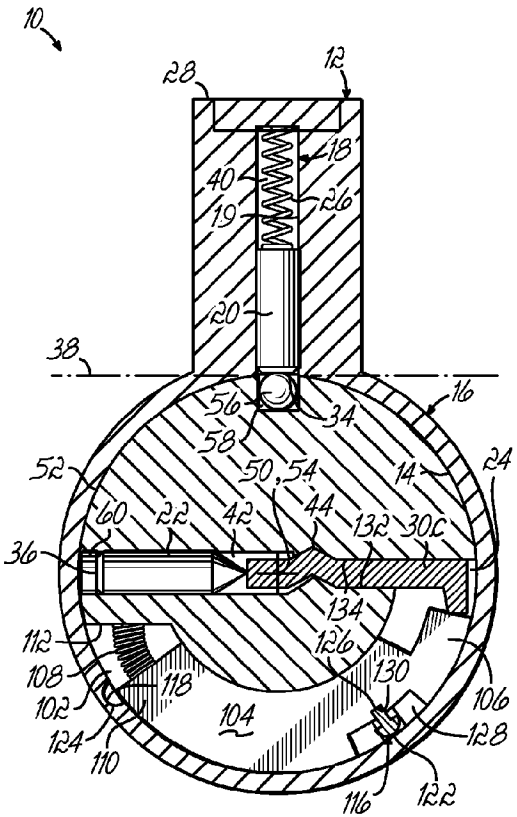
FIG. 31B is a cross-sectional view of the housing and plug with a plan view of the radial tumbler taken along line 31B-31B of FIG. 31A.
Figure 31A:
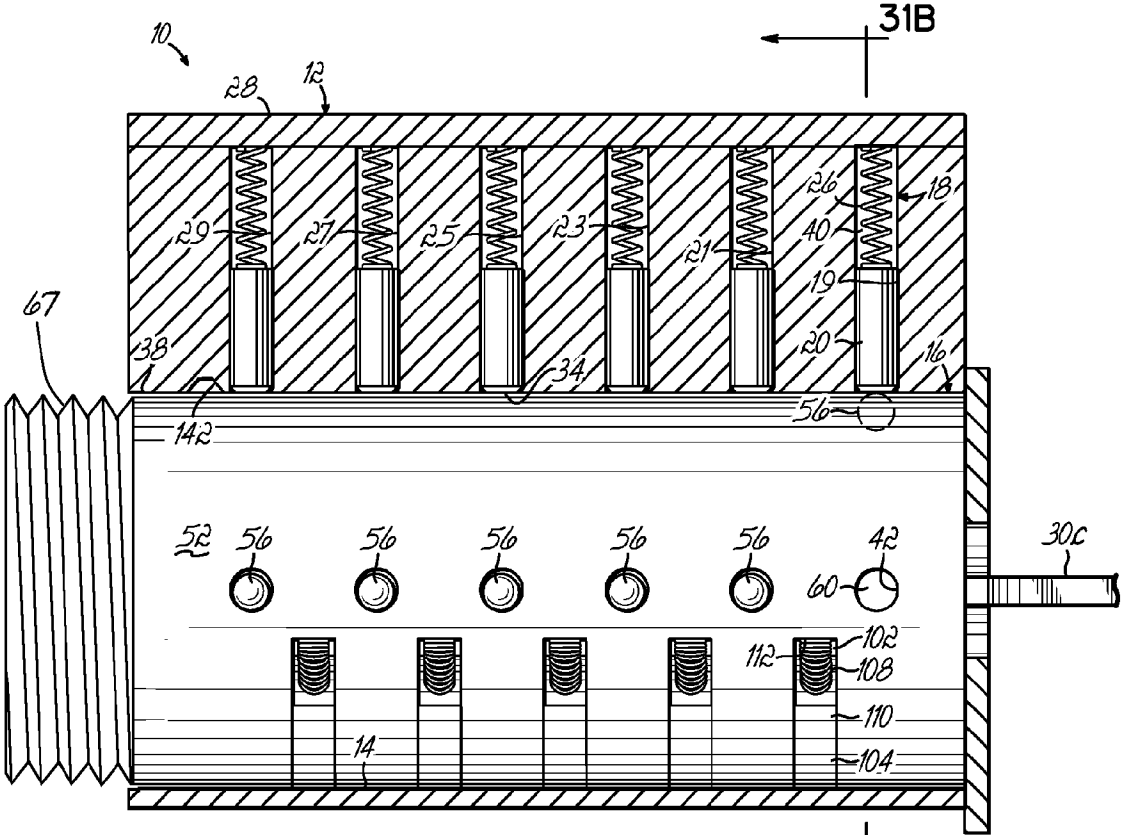
FIG. 31A is a cross-sectional view of the housing, with a side view of the plug of the lock assembly depicting the first key inserted and rotated one-quarter turn counterclockwise.
Figure 32B:
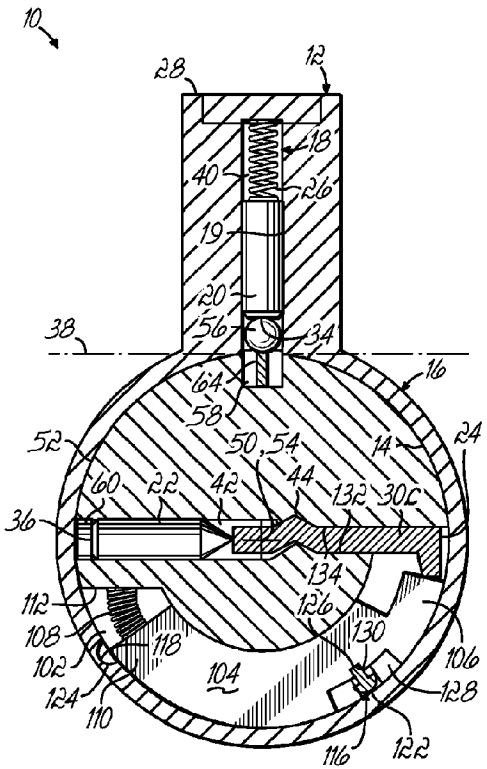
FIG. 32B is a cross-sectional view of the housing and plug with a plan view of the radial tumbler taken along line 32B-32B of FIG. 32A.
Figure 32A:
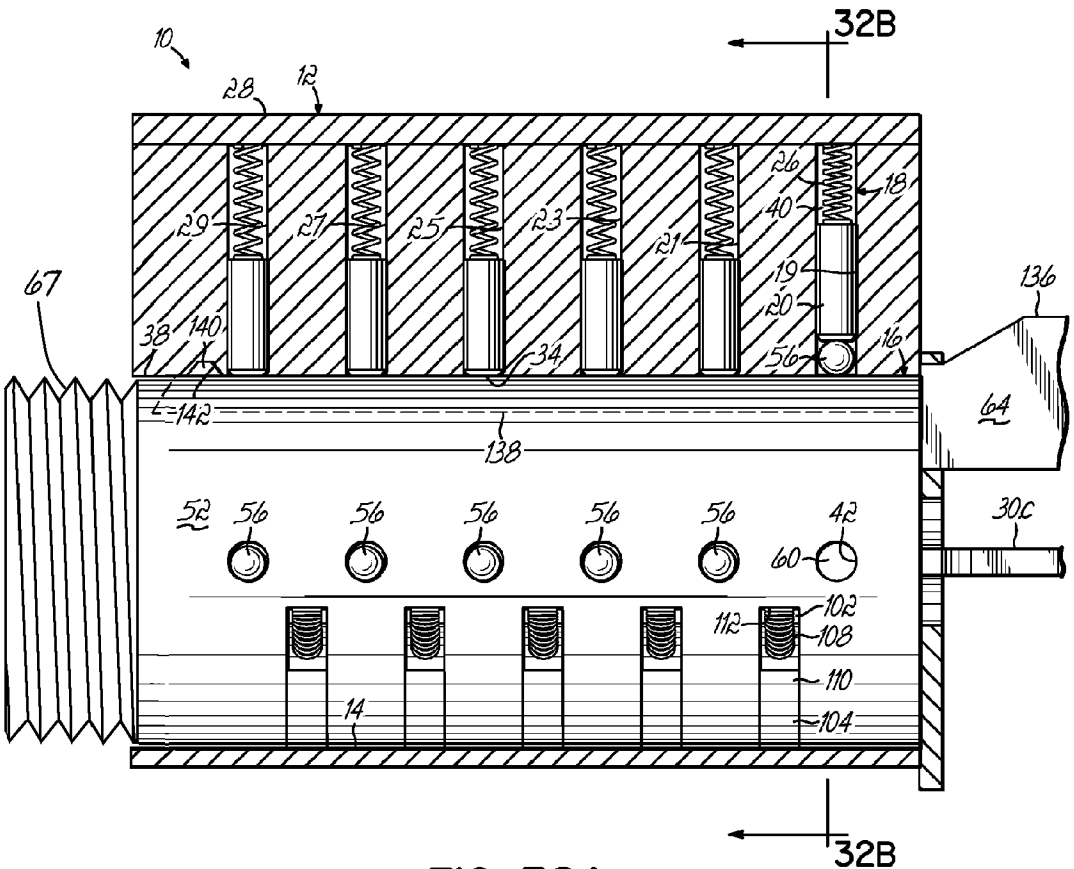
FIG. 32A is a cross-sectional view of the housing, with a side view of the plug of the lock assembly the first key inserted and rotated one-quarter turn counterclockwise with a change tool inserted in a change slot.
Figure 33B:
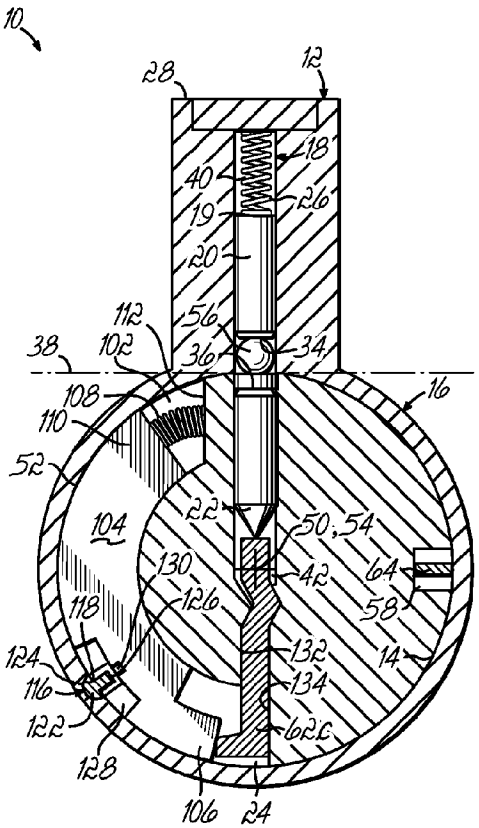
FIG. 33B is a cross-sectional view of the housing and plug with a plan view of the radial tumbler taken along line 33B-33B of FIG. 33A.
Figure 33A:
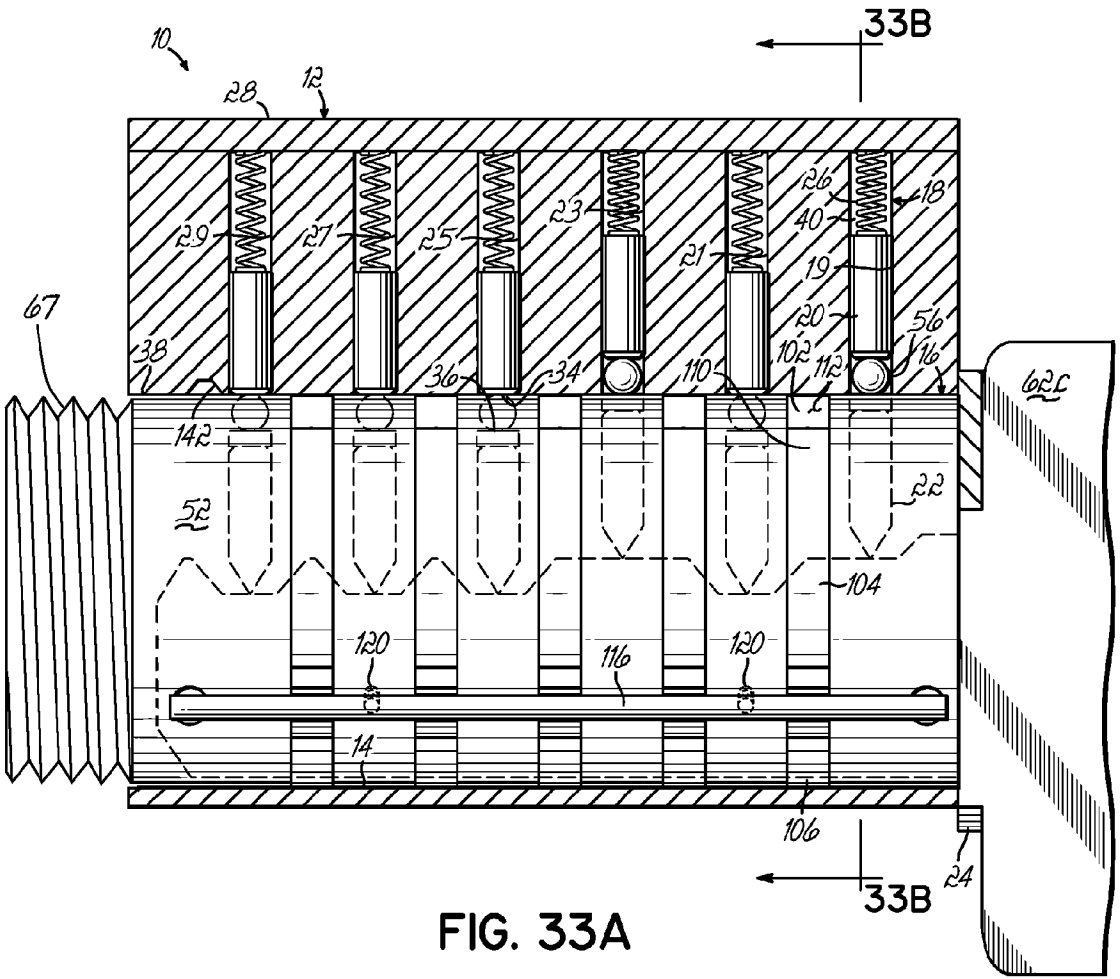
FIG. 33A is a cross-sectional view of the housing, with a side view of the plug of the lock assembly showing the plug rotated back to an original position with the first key removed and change tool still inserted in the change slot, with a new second key inserted in the keyway.
Figure 34B:
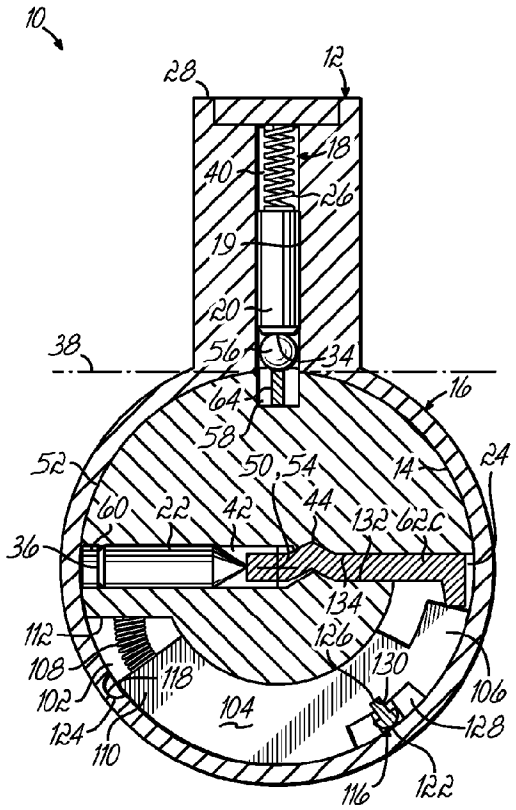
FIG. 34B is a cross-sectional view of the housing and plug with a plan view of the radial tumbler taken along line 34B-34B of FIG. 34A.
Figure 34A:
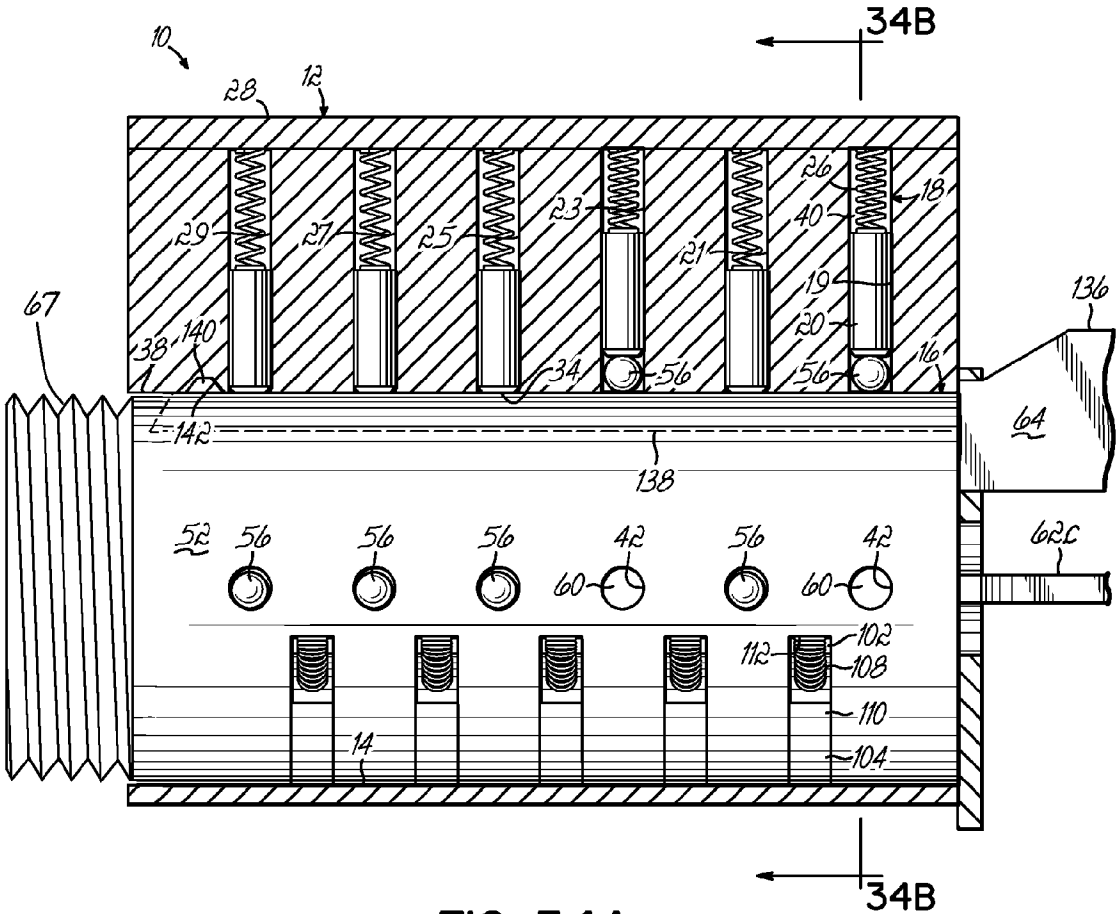
FIG. 34A is a cross-sectional view of the housing, with a side view of the plug of the lock assembly showing the second key inserted in the keyway and the plug rotated one-quarter turn counterclockwise with the change tool inserted in the change slot.
Figure 35B:
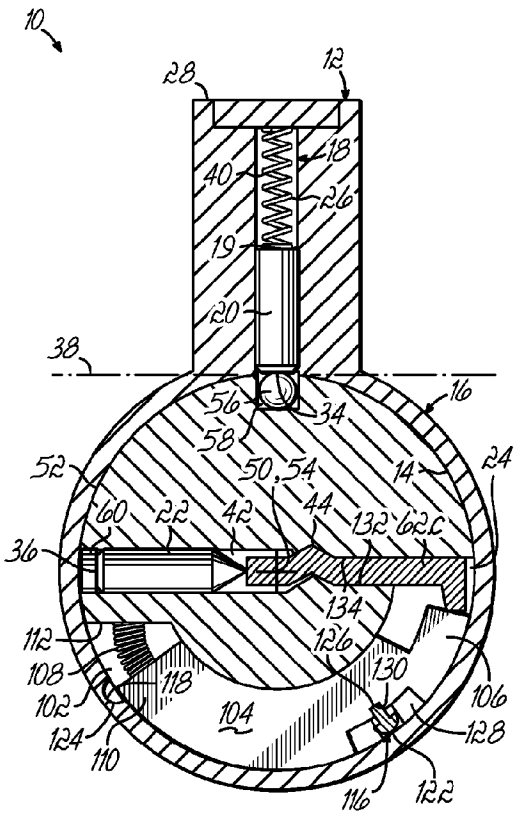
FIG. 35B is a cross-sectional view of the housing and plug with a plan view of the radial tumbler taken along line 35B-35B of FIG. 35A.
Figure 35A:
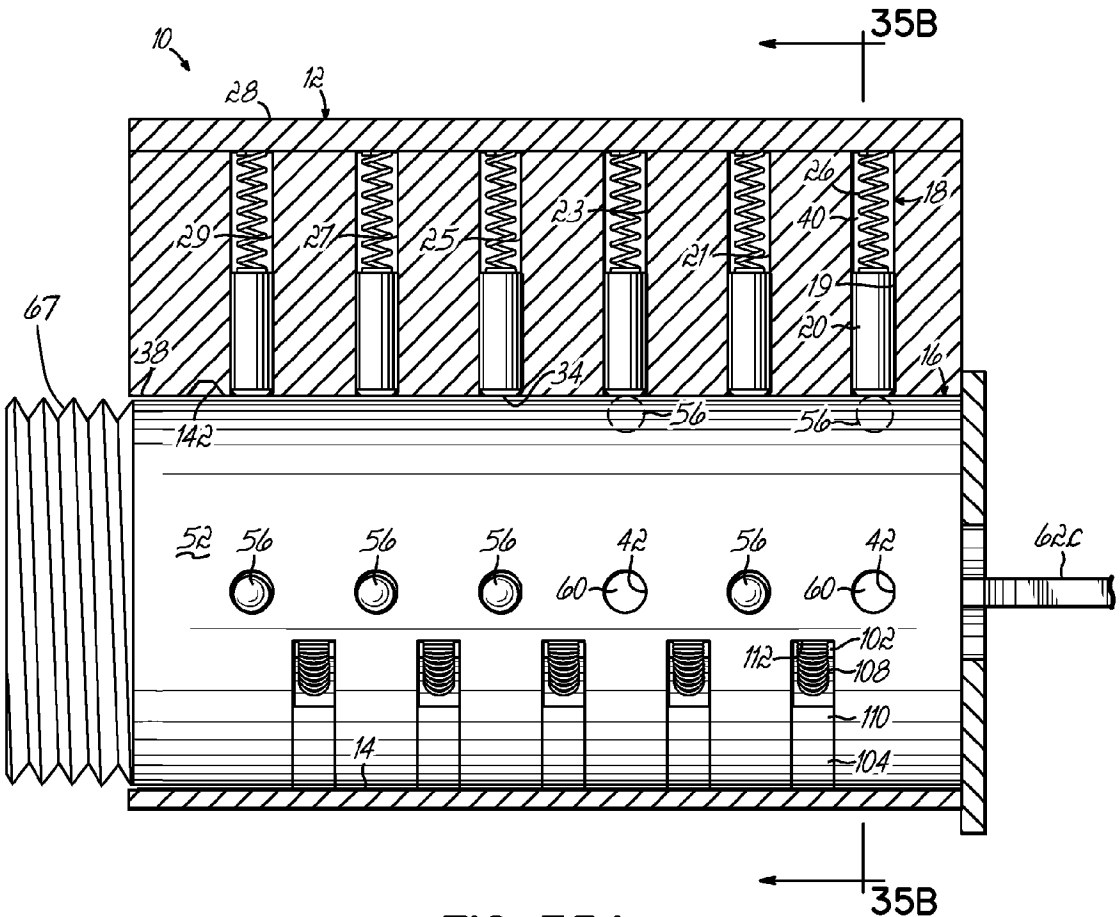
FIG. 35A is a cross-sectional view of the housing, with a side view of the plug of the lock assembly showing the second key inserted in the keyway and the plug rotated one-quarter turn counterclockwise with the change tool now removed from the change slot.
Figure 36B:
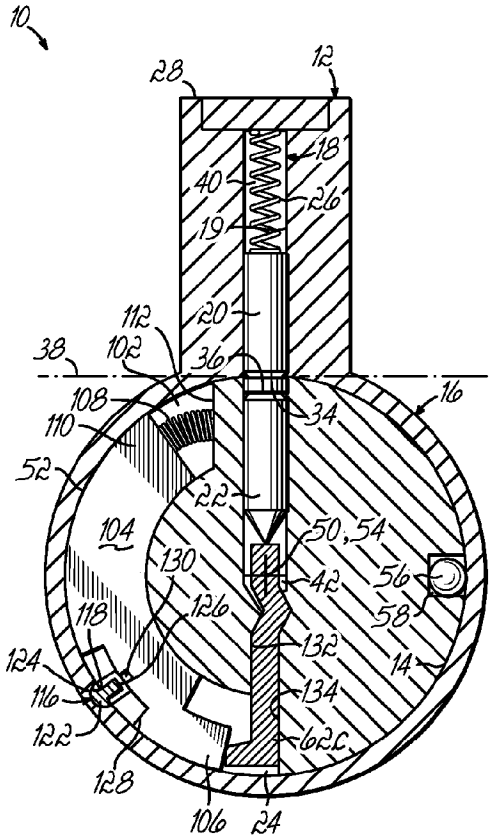
FIG. 36B is a cross-sectional view of the housing and plug with a plan view of the radial tumbler taken along line 36B-36B of FIG. 36A.
Figure 36A:
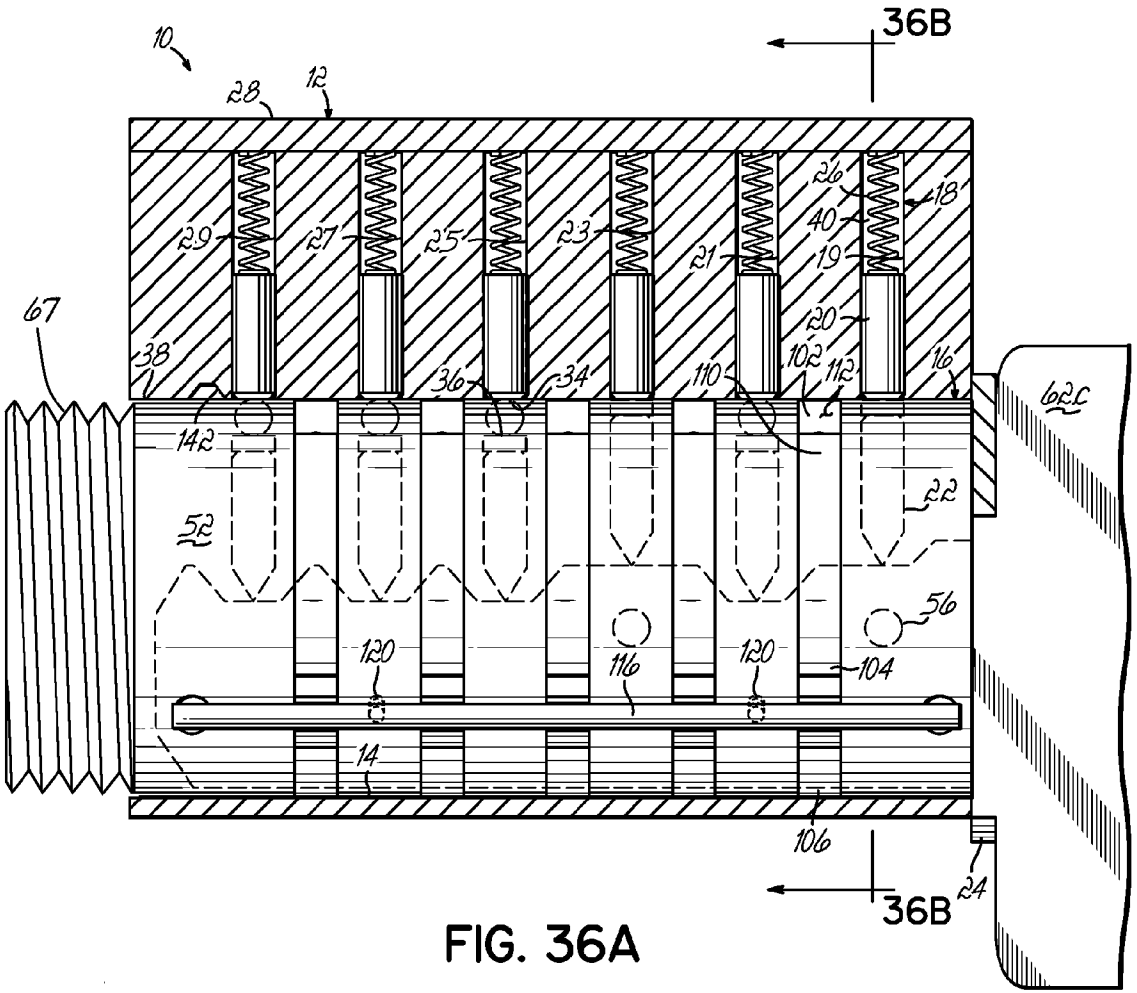
FIG. 36A is a cross-sectional view of the housing, with a side view of the plug of the lock assembly showing the plug rotated to its original position with the second key still inserted and the change members reset to a new configuration.

To reprogram the lock 10, the first key 30*c*, which is the proper key to originally operate the lock 10, is inserted into the keyway 24 (see FIGS. 30A and 30B), and the plug 16 is rotated relative to the housing 12 (one-quarter turn counter-clockwise) until a first indicator mark 114 on the face 115 of the plug 16 is aligned with a second indicator mark 144 on the face of the housing 12 (see FIGS. 1, 31A and 31B). Alignment of the indicator marks 114, 144, ensures that the retainer cavities 58 are aligned with the driver chambers 40. Referring now to FIGS. 32A and 32B, the change tool 64 is then fully inserted into the change slot 88. As the change tool 64 is inserted into the change slot 88, each successive change ball 56 located in a retainer cavity 58 is displaced from its second position in the retainer cavity 58 to its first position into the driver chamber 40 in the housing 12. The plug 16 can then be rotated back to the starting position, where the first key 30 removed from the keyway 24, and a second key 62*c* is inserted into the keyway 24 (see FIGS. 33A-33B). With the change tool 64 still inserted in the change slot 88, the plug 16 is again rotated (one-quarter turn counter-clockwise) relative to the housing until the indicator marks 114, 144 are again aligned (as shown in FIGS. 34A and 34B). The change tool 64 is then removed from the change slot 88, and a change ball 56 disposed in a driver chamber 40 is forced down into its corresponding retainer cavity 58 by to the force of driver spring 26 (see FIGS. 35A and 35B). When the plug 16 is rotated back to its originating position (see FIGS. 36A and 36B), the second key 62*c* can now operate the lock 10, but the first key 30*c* cannot.

Referring again to the sequence of Figures in to FIGS. 29A-36B, each of key 30*c* and 62*c* has been configured, when inserted into the keyway, to displace the radial tumbler 104 circumferentially into a position wherein the lug 126 of the side bar 116 is aligned radially with the side bar notch 130 in the radial tumbler 104. In this position, the projection 122 of the sidebar 116 can be displaced out of the second groove 124 so that the plug 16 can be rotated within the housing 12 of the lock 10.

Referring now to FIGS. 37, 38, and 40A-C, in an alternate embodiment of the present invention, a lock 10*c* can have a plurality of rows 146, 148 of pin chambers 18*a* and 18*b*. A first row 146 of pin chambers 18*a* is disposed in the housing 12 and plug 16 along in a first plane 150 passing through the longitudinal axis 54 of the plug 16. A second row 148 of pin chambers 18 is disposed in the housing 12 and the plug along a second plane 152 passing through the longitudinal axis 54 of the plug 16. The second plane 152 is angularly offset from the first plane 150. The housing 12 has a plurality of rows of driver chambers 40*a* and 40*b*, with driver chambers 40*a* forming a portion of the pin chambers of row 146, and the driver chambers 40*b* forming a portion of the pin chambers of row 148.

Figure 38:
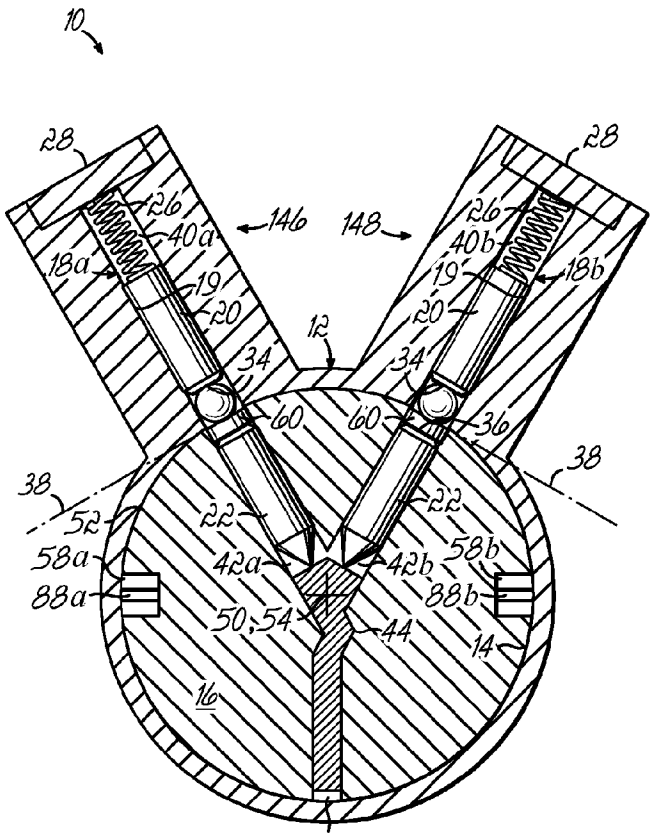
FIG. 38 is an end cross-sectional view of the plug and housing of the lock assembly of the embodiment having two separate sets of pin chambers and driver/tumbler stacks.
Figure 40B:
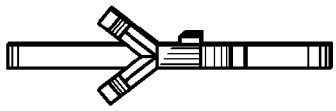
FIG. 40B is an end view of the key taken from line 40B-40B of FIG. 40A.
Figure 40C:
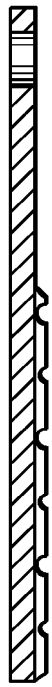
FIG. 40C is a cross-sectional view of the key taken along line 40C-40C of FIG. 40A.
Figure 40A:
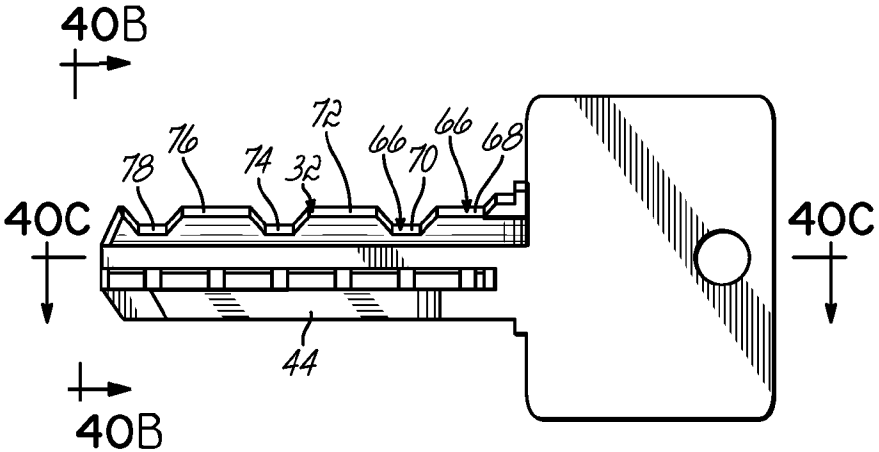
FIG. 40A is a side perspective view of a key having a Y-shape to fit a keyway of a plug having two separate sets of pin chambers, the key having top edge contours and longitudinal contours adapted for a lock of the present invention.

The plug 16 has a plurality of rows of tumbler chambers 42*a* and 42*b*, each configured to align with a corresponding row of the drive chambers 40*a* and 40*b* when the lock is in its neutral or first rotated position shown in FIG. 38. The plug also has a plurality of rows of retainer cavities 58*a* and 58*b*, and a plurality of change slots 88*a* and 88*b*.

Each of the pin chambers 18 is adapted to receive at least a driver 20, a tumbler 22, optional, though preferably, a change ball 56, and optionally, though preferably, a master shim 60.

The lock of the illustrated embodiment operates as desirable scribed hereinbefore for the first and second embodiments of the invention having a single row of pin chambers, with the added requirement that operation of the illustrated lock requires both sets of change members to move between the respective pin chambers, 18*a* and 18*b*, and retainer cavities, 58*a* and 58*b*.

The provision of a second row of pin chambers, which increases the number of stacks of drivers 20, tumblers 22, and change balls 56, increases the number of lock change combinations, thereby increasing the security and utility provided by the lock 10*c*. Although the illustrated embodiment depicts two rows 146, 148 of a pin chamber 18 that contain driver/ tumbler stacks, an additional row or more of such pin chambers 18 can be included in the lock 10 of the present invention.

Also, the embodiment of the lock 10 illustrated in FIGS. 37 and 38 can include additional components such as a memory block 90, radial tumblers 104, and sidebars 116, as described above with respect to alternate embodiments of the present invention.

Figure 41B:
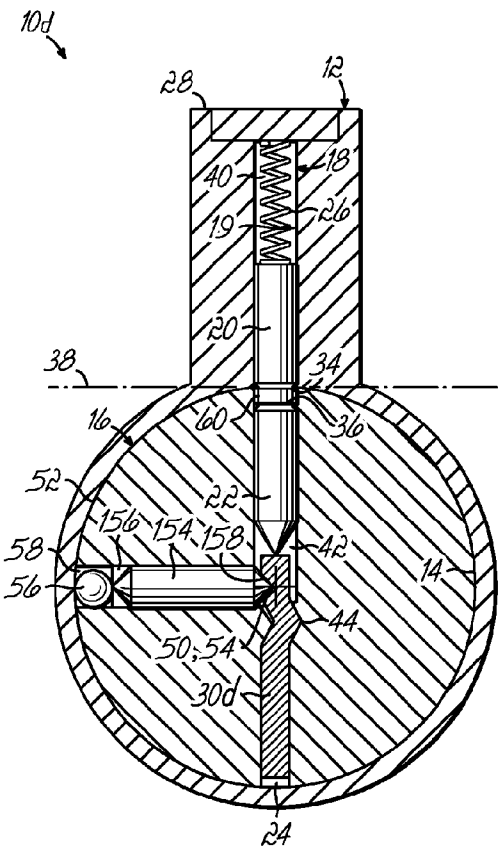
FIG. 41B is a cross-sectional view of the housing and plug with a plan view of the anti-tamper pin, taken along line 41B-41B of FIG. 41A.
Figure 41A:
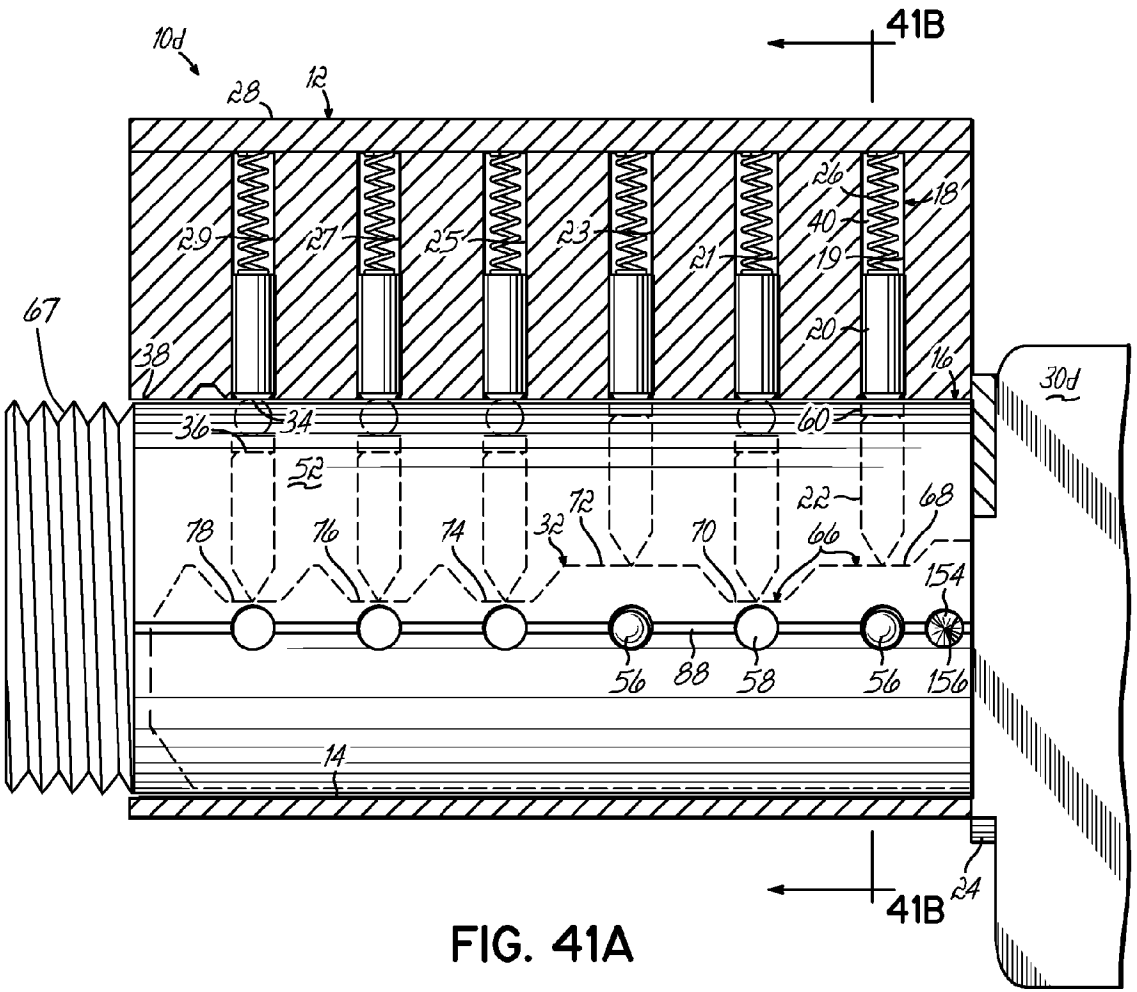
FIG. 41A is a cross-sectional view of a housing, with a side view of the plug of an embodiment of a lock of the present invention having an anti-tamper pin.

In an alternate embodiment of the present invention depicted in FIGS. 41A and 41B, the lock 10*d* includes at least one an anti-tamper pin 154 that rests and is movable within an anti-tamper orifice or passage 156 in the plug 16. The anti-tamper pin 154 has a first position wherein a first end of the anti-tamper pin 154 blocks can intersect with and thereby block the longitudinal change slot 88, whereby a change tool 64, or any other object, cannot be fully inserted into the change slot 88. A proper first key 30*d* comprises an anti-tamper groove 158 that registers with a second end of the anti-tamper pin 154 when the anti-tamper pin 154 is in a second position. With the key 30*d* inserted in the keyway, the change tool 64 can be inserted without impediment into the change slot 88, to move the anti-tamper pin 154 to its second position.

The embodiments of a changeable lock assembly can be used in a variety of locking devices. These locking devices include both commercial and residential locks, and include by example, knob locks, deadbolt locks, and padlocks. The operation of a typical knob lock includes the use of the operable key both to unlock and lock the door knob by turning a latch that is secured to the latch end 15 of the plug. The latch typically unlocks the door knob, which can then turn or rotate by hand, and thereby operate an elongated bolt that engages and disengages the jamb of the door or other object that is being locked. The operation of a typical dead-bolt lock includes the use of the operable key to unlock and rotate a latch that drives an elongated bolt to engage and disengage the jamb of the door or other object that is being locked. These locks are well-known to one skilled in the art.

The operation of a typical padlock includes the use of the operable key to unlock aJ-shaped shackle. In a typical padlock configured in a locked position, a bolt within the lock body (or a pair of bolts) is biased into a position within a groove in each leg of the shackle, to positively restrain the shackle from withdrawing from the body. The design and operation of a typical padlock is described in U.S Pat. No. 3,710,603 (Miller) and U.S. Pat. No. 4,776,187 (Evans et al), both incorporated herein by reference. The padlock is typically configured whereby the rotation of the key with the plug causes the bolt(s) to be displaced from the grooves, thereby allowing the shackle to withdraw from the body. A typical, conventional padlock is configured whereby the inserted key will only rotate in one direction to unlock the shackle, and is typically provided with a spring or other means for biasing the bolt, as well as the plug and the key, back toward its initial or "key-insertion" position.

Figure 44B:
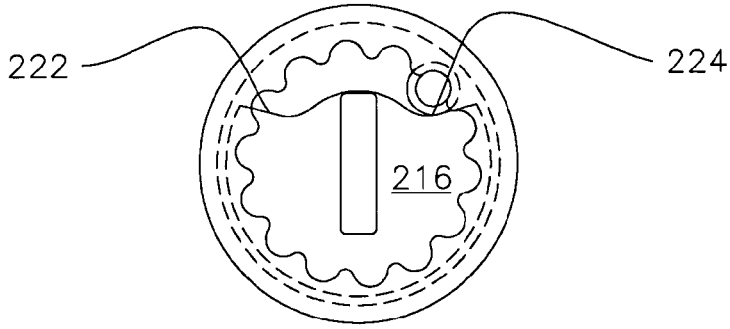
FIG. 44B shows the end view of the plug of FIG. 44A, in a reprogramming position.
Figure 44A:
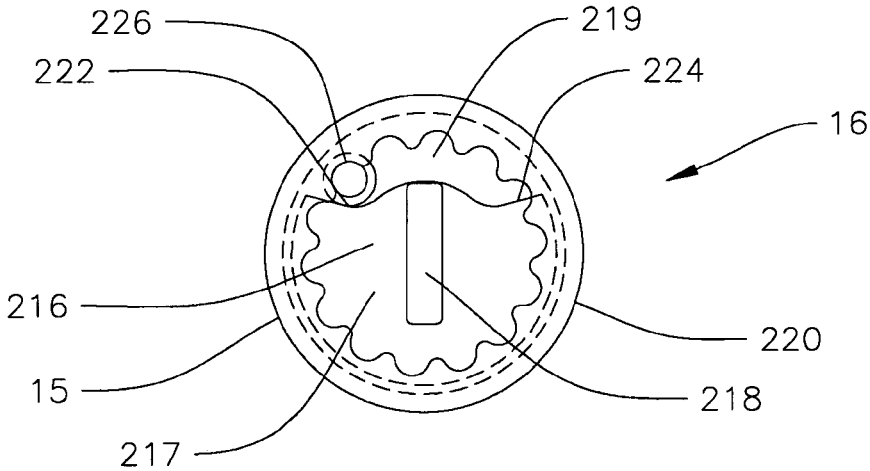
FIG. 44A shows an end view of the plug of an embodiment of a padlock of the present invention having a latch with a lazycam, in an initial position.
Figure 44C:
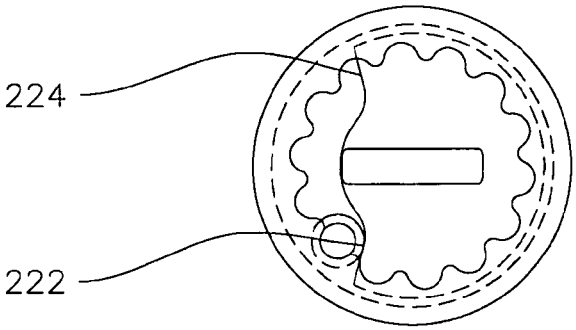
FIG. 44C shows the end view of the plug of FIG. 44A, in a second unlock position.

The padlock of the present invention comprises a changeable lock assembly configured to rotate in both the first direction (generally clockwise, facing the keyway) and the second direction. FIGS. 44A, 44B, and 44C show an end view of the plug of the padlock in its initial position, and when rotated in both the first and second directions. Rotation of the plug in the first direction, from a first position shown in FIG. 44A to a second unlock position shown in FIG. 44C, can unlock the padlock. As with conventional padlocks, the lock is typically configured with a spring or biasing means to return the rotated plug back to the initial "key insertion" position. Rotation of the plug in the second direction (generally, counterclockwise), from the first position shown in FIG. 44A to a reprogramming position shown in FIG. 44B, can provide for reprogramming of the lock in accordance with the invention described hereinabove. Preferably, the rotation of the plug in the second direction will not unlock the padlock. To avoid unlocking the padlock when the plug is rotated in the second direction, the latch-rotating end 15 of the plug is provided with a tailpiece or latch 216 comprising a shaft 218 extending from a generally rounded base 217. The base 217 is rotatably retained to the latch end 15 with a threaded nut 220. The base 217 has a forward face 222 and a reverse face 224 defined by an opened wedge portion 219 (typically of about one-quarter to one-third of the circumference). The stop pin 220 that extends from the latch end 15 can restrict rotation of the latch 216 within the span of the opened portion 219 between the forward face 222 and the reverse face 224.

When the key is operated in the lock, the clockwise rotation of the key in the plug turns the plug and forces the stop pin 220 against the forward face 222 of the latch 216, which drives the latch to rotate in the clockwise direction, (counter-clockwise when viewed from the rear of the plug, as shown in FIG. 44C. The rotation of the latch disengages the bolt(s) from the grooves in the shackle and unlocks the padlock. A spring or other biasing means (not shown) returns the latch, the plug, and the inserted key back to the initial position.

The latch 216 of a typical padlock is configured to prevent its rotation in the counterclockwise direction. When the key rotates the plug counterclockwise to the second rotating or programming position, clockwise when viewed from the rear of the plug, as shown in FIG. 44B, the stop pin 220 is free to move within the opened portion 219 of the restrained latch 216. This arrangement is conventionally called a "lazy cam", where the cam or tailpiece is configured to remain stationary while the cylinder plug is partially rotated.

Optionally, the rotation of the plug in the second direction can also unlock the padlock, although the process of unlocking the padlock can make the reprogramming of the changeable lock assembly more complicated.

In the padlock of the present invention, the plug can be placed into its second rotated position shown in FIG. 44B within the housing, wherein the retainer cavities and change slot align or register with the driver chambers. The lock configuration of the padlock can be reprogrammed using a change tool to operate with a different user key of a subset of user keys, as described herein before for the second embodiment of the changeable lock assembly. Alternatively, the lock configuration of the padlock can be configured to operate with a progression of different though complementary user keys, as described herein before for the first embodiment of the changeable lock assembly. Each of the user keys can reprogram the lock for use by displacing a change member from a pin chamber into a retainer cavity, which disables any user keys of the subset of keys from operating the lock which are configured to move less than the current number and configuration of change members.

While the invention has been disclosed by reference to the details of preferred embodiments of the invention, it is to be understood that the disclosure is intended in an illustrative rather than in a limiting sense, as it is contemplated that modifications will readily occur to those skilled in the art, within the spirit of the invention and the scope of the appended claims.

The invention claimed is:

1. A changeable lock assembly that can be reconfigured to operate with different keys of a set of user keys, without disassembling the lock, comprising:

a) a set of keys, the set of keys comprising at least a first user key having a first contour edge that operates the lock in a first lock configuration but does not operate the lock in a second lock configuration, and a second user key having a second contour edge that operates the lock in the second lock configuration but does not operate the lock in the first lock configuration, wherein the first contour edge and the second contour edge have at least a first contour position and a second contour position that are differently configured;

b) a housing having a generally cylindrical bore with an inner surface and a plurality of generally cylindrical driver chambers intersecting the bore surface;

c) a plurality of generally cylindrical drivers, each driver having a diameter and being positioned and movable within one driver chamber, and being urged toward the bore surface;

d) a plug having a generally cylindrical periphery and rotatably mounted within the bore so as to form a shear line at the interface of the bore surface and the plug periphery, the plug further having:

1) a longitudinal axis;

2) a keyway intersecting the periphery and parallel to the longitudinal axis and configured to receive a key selected from the set of keys;

3) a plurality of generally cylindrical tumbler chambers intersecting the periphery and the keyway, and being generally orthogonal to the longitudinal axis, each tumbler chamber being aligned with a driver chamber when the plug is at a first rotated position with respect to the housing so as to form a pin chamber; and 4) a plurality of retainer cavities intersecting the periphery, each retainer cavity being spaced apart from a corresponding tumbler chamber and aligned with a corresponding driver chamber when the plug is at a second rotated position with respect to the housing, each retainer cavity having an opening of a size smaller than the diameter of the driver, wherein the driver can not enter through the opening and into the retainer cavity when the plug is in its second rotated position; and 5) a change tool slot configured parallel to the longitudinal axis, that extends from the front face of the plug and intersects a portion of each of the plurality of retainer cavities;

e) a separate change tool having a blade portion with an upper edge that intersects all of the plurality of retainer cavities when the change tool is inserted within the change tool slot;

f) a plurality of tumblers, each tumbler being positioned and movable within one tumbler chamber; and g) a plurality of lock configuration change balls, each change ball being associated with one pin chamber, having a first position within the pin chamber between the driver and tumbler, and a second position within the retainer cavity, wherein when the plug is in the second rotated position and the change tool is inserted within the change tool slot, the upper edge of the change tool raises all of the plurality of change balls when disposed in the respective retainer cavities to a position where, upon subsequent rotation of the plug away from the second rotated position, all of the raised change balls are isolated in the corresponding driver chambers.

2. The changeable lock assembly of claim 1 wherein the first contour position of the first key is a lower position and the second contour position of the first key is a raised position, and wherein, when the lock is configured to operate with the first key, a first change ball corresponding to the first contour position is disposed in its pin chamber, and a second change ball corresponding to the second contour position is disposed in its retainer cavity.

3. The changeable lock assembly of claim 2 wherein the first contour position of the second key is a raised position and the second contour position of the second key is a lower position, wherein the driver that is disposed in the pin chamber corresponding to the second contour position spans across the shear line when the second key is inserted into the keyway, whereby the plug can not rotate within the housing, such that the second key can not operate the lock.

4. The changeable lock assembly of claim 1 wherein the lock is operable with a user key only when the change tool is remote from the change tool slot.

5. The changeable lock assembly of claim 1 wherein the change tool has a linear upper edge.

6. The changeable lock assembly of claim 1, wherein the set of keys further comprises a programming key having a contour edge configured to raise all of the change balls, when disposed in the associated tumbler chambers, above the shear line upon its insertion into the keyway, and, upon its operation of the lock, to move the change balls into the respective retainer cavities upon rotation of the plug to its second rotated position, wherein the lock can be operated with the programming key, but not with the user keys.

7. The changeable lock assembly of claim 1 wherein at least one change ball is disposed in the second position to configure the lock for operation with one of the user keys.

8. The changeable lock assembly of claim 1 further comprising a plurality of master shims, wherein one of the plurality of master shims is disposed between each tumbler and the change ball when the change ball is in its first position, the master shims having a first diameter and the retainer cavity having a second diameter, the first diameter being greater than the second diameter.

9. The changeable lock assembly of claim 8 further comprising a master key having a contour edge configured to raise the plurality of master shims above the shear line, wherein any change ball positioned above the master shims can not be deposited into the retainer cavity in the second rotated position.

10. The changeable lock assembly according to claim 1 wherein the upper edge of the inserted change tool raises at least the centerline of all of the plurality of change balls when disposed in the respective retainer cavities above the shear line.

11. The changeable lock assembly of claim 1, wherein the number of the plurality of drivers and the plurality of tumblers is six or more.

12. The changeable lock assembly according to claim 1, wherein the separate change tool is a single separate change tool.

13. A changeable lock assembly that can be reconfigured to operate with different keys of a set of user keys, without disassembling the lock, comprising:

a) a set of keys, the set of keys comprising at least a first key having a first contour edge that operates the lock in a first lock configuration but does not operate the lock in a second lock configuration, and a second key having a second contour edge that operates the lock in the second lock configuration but does not operate the lock in the first lock configuration, wherein the first contour edge has at least a first contour position and a second contour position that are differently configured than the first contour position and second contour position of the second contour edge;

b) a housing having a cylindrical bore with an inner surface and a plurality of generally cylindrical driver chambers intersecting the inner surface;

c) a plurality of cylindrical drivers, each driver being positioned and movable within one driver chamber and being urged toward the bore surface;

d) a plug having a cylindrical periphery and rotatably mounted within the bore so as to form a shear line at the interface of the bore surface and the plug periphery, the plug further having:

1) a keyway configured to receive a key selected from the set of keys;

2) a plurality of cylindrical tumbler chambers intersecting the periphery and the keyway, each tumbler chamber being aligned with a driver chamber when the plug is at a first rotated position with respect to the housing so as to form a pin chamber; and 3) a plurality of retainer cavities intersecting the periphery, each retainer cavity being spaced apart from a corresponding tumbler chamber and aligned with a corresponding driver chamber when the plug is at a second rotated position with respect to the housing, each retainer cavity having an opening of a size smaller than the diameter of the driver, wherein the driver can not enter through the opening and into the retainer cavity when the plug is in its second rotated position; and 4) a change tool slot that intersects a portion of each of the retainer cavities; and 5) a change tool having a blade portion with a linear upper edge that intersects all of the plurality of retainer cavities when inserted within the change tool slot;

e) a plurality of tumblers, each tumbler being positioned and movable within one tumbler chamber; and f) a plurality of lock configuration change balls, each change ball being associated with one pin chamber, having a first position within the pin chamber between the driver and tumbler, and a second position within the retainer cavity;

wherein when the plug is in the second rotated position and the change tool is inserted within the change tool slot, the linear upper edge of the change tool raises all of the plurality of change balls, when disposed in the respective retainer cavities, to a position where, upon subsequent rotation of the plug away from the second rotated position, all raised change balls are isolated in the corresponding driver chambers.

14. The changeable lock assembly of claim 13 wherein the lock is operable with a user key only when the change tool is remote from the change tool slot.

15. The changeable lock assembly of claim 13 wherein at least one change ball is disposed in the second position to configure the lock for operation with one of the user keys.

16. The changeable lock assembly according to claim 13 wherein the linear upper edge of the inserted change tool raises at least the centerline of all of the plurality of change balls, when disposed in the respective retainer cavities, above the shear line.

17. The changeable lock assembly of claim 13, wherein the number of the plurality of drivers and the plurality of tumblers is six or more.

18. A changeable lock assembly that can be reconfigured to operate with different keys of a set of user keys, without disassembling the lock, comprising:

a) a set of keys, the set of keys comprising at least a first user key having a first contour edge that operates the lock in a first lock configuration but does not operate the lock in a second lock configuration, and a second user key having a second contour edge that operates the lock in the second lock configuration but does not operate the lock in the first lock configuration, wherein the first contour edge and the second contour edge have at least a first contour position and a second contour position that are differently configured;

b) a housing having a generally cylindrical bore with an inner surface and a plurality of generally cylindrical driver chambers intersecting the bore surface;

c) a plurality of generally cylindrical drivers, each driver having a diameter and being positioned and movable within one driver chamber, and being urged toward the bore surface;

d) a plug having a generally cylindrical periphery and rotatably mounted within the bore so as to form a shear line at the interface of the bore surface and the plug periphery, the plug further having:

1) a longitudinal axis;

2) a keyway intersecting the periphery and parallel to the longitudinal axis and configured to receive a key selected from the set of keys;

3) a plurality of generally cylindrical tumbler chambers intersecting the periphery and the keyway, and being generally orthogonal to the longitudinal axis, each tumbler chamber being aligned with a driver chamber when the plug is at a first rotated position with respect to the housing so as to form a pin chamber; and 4) a plurality of retainer cavities intersecting the periphery, each retainer cavity being spaced apart from a corresponding tumbler chamber and aligned with a corresponding driver chamber when the plug is at a second rotated position with respect to the housing, each retainer cavity having an opening of a size smaller than the diameter of the driver, wherein the driver can not enter through the opening and into the retainer cavity when the plug is in its second rotated position; and 5) a change tool slot configured parallel to the longitudinal axis, that extends from the front face of the plug and intersects a portion of each of the plurality of retainer cavities;

e) a separate change tool having a blade portion with an upper edge that intersects all of the plurality of retainer cavities when the change tool is inserted within the change tool slot;

f) a plurality of tumblers, each tumbler being positioned and movable within one tumbler chamber; and g) a plurality of lock configuration change balls, each change ball being associated with one pin chamber, having a first position within the pin chamber between the driver and tumbler, and a second position within the retainer cavity, wherein when the plug is in the second rotated position and the change tool is inserted within the change tool slot, none of the plurality of change balls can be disposed in the second position within the plurality of retainer cavities.

19. The changeable lock assembly of claim 18 wherein the lock is operable with a user key only when the change tool is remote from the change tool slot.

20. The changeable lock assembly according to claim 18 wherein the upper edge of the inserted change tool raises at least the centerline of all of the plurality of change balls, when disposed in the respective retainer cavities, above the shear line.

* * * * *